US007037251B2

(12) United States Patent
Stefanoni

(10) Patent No.: US 7,037,251 B2
(45) Date of Patent: May 2, 2006

(54) MACHINE FOR THE PRODUCTION OF FLEXIBLE MATERIAL SHEETS

(75) Inventor: Cesare Stefanoni, Lecco (IT)

(73) Assignee: Fabio Perini S.p.A., Lucca (IT)

( * ) Notice: Subject to any disclaimer, the term of this patent is extended or adjusted under 35 U.S.C. 154(b) by 0 days.

(21) Appl. No.: 10/486,786

(22) PCT Filed: Aug. 13, 2002

(86) PCT No.: PCT/IT02/00538

§ 371 (c)(1),
(2), (4) Date: Feb. 13, 2004

(87) PCT Pub. No.: WO03/016184

PCT Pub. Date: Feb. 27, 2003

(65) Prior Publication Data

US 2004/0232609 A1 Nov. 25, 2004

(30) Foreign Application Priority Data

Aug. 17, 2001 (IT) ..... MI2001A1800

(51) Int. Cl.
*B31B 1/14* (2006.01)

(52) U.S. Cl. ..... 493/359; 493/353; 493/360; 493/434; 493/442; 493/475; 493/478

(58) Field of Classification Search ..... 493/475, 493/756, 478, 479, 434, 442, 435, 471, 352, 493/353, 356, 357, 359, 360
See application file for complete search history.

(56) References Cited

U.S. PATENT DOCUMENTS

| | | | | |
|---|---|---|---|---|
| 2,047,710 | A | 7/1936 | Schwartz | |
| 3,689,061 | A | 9/1972 | Nystrand | |
| 3,870,292 | A | 3/1975 | Bradley | |
| 4,475,730 | A | 10/1984 | Trogan | |
| 4,861,326 | A * | 8/1989 | Kuhner et al. | 493/359 |
| 5,165,671 | A * | 11/1992 | Motooka | 270/47 |
| 5,558,615 | A * | 9/1996 | Albert | 493/477 |
| 5,676,630 | A | 10/1997 | Mayr | |
| 5,904,277 | A | 5/1999 | Niedermeyer | |
| 5,910,090 | A * | 6/1999 | Taute | 53/504 |
| 6,024,685 | A | 2/2000 | Kirsch | |
| 6,761,678 | B1 * | 7/2004 | Miescher et al. | 493/434 |

FOREIGN PATENT DOCUMENTS

| | | |
|---|---|---|
| DE | 44 07 375 A1 | 9/1995 |
| EP | 0 302 031 A2 | 2/1989 |

* cited by examiner

*Primary Examiner*—John Sipos
*Assistant Examiner*—Christopher Harmon
(74) *Attorney, Agent, or Firm*—Breiner & Breiner, L.L.C.

(57) ABSTRACT

Machine for the production of flexible material sheets comprising at least one folding unit housing at least one cutting cylinder, to which a suction cylinder is opposed, and a gripping cylinder for transversal folding and/or conveying flat products by suction. A second suction cylinder for a second transversal fold and/or for conveying flat products and a second conveyor cylinder for conveying folded products or flat unfolded products may be associated downstream to said machine.

17 Claims, 44 Drawing Sheets

1
8'
2'
2
7
7
7
8'
4
3

8'
2'
2
1
3

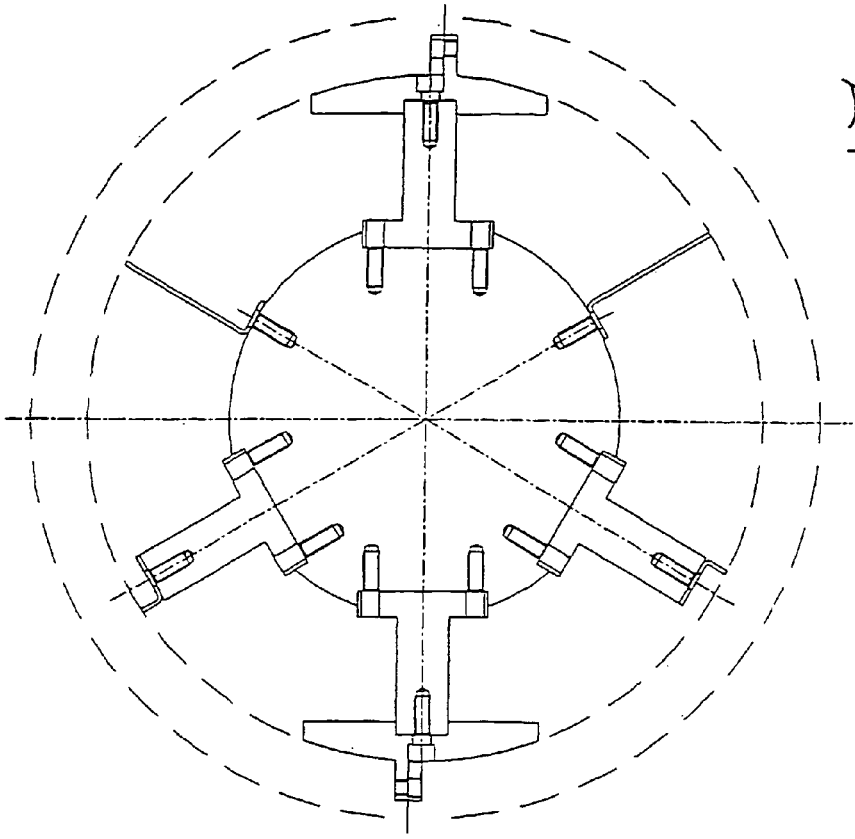
Fig. 21
Fig. 22
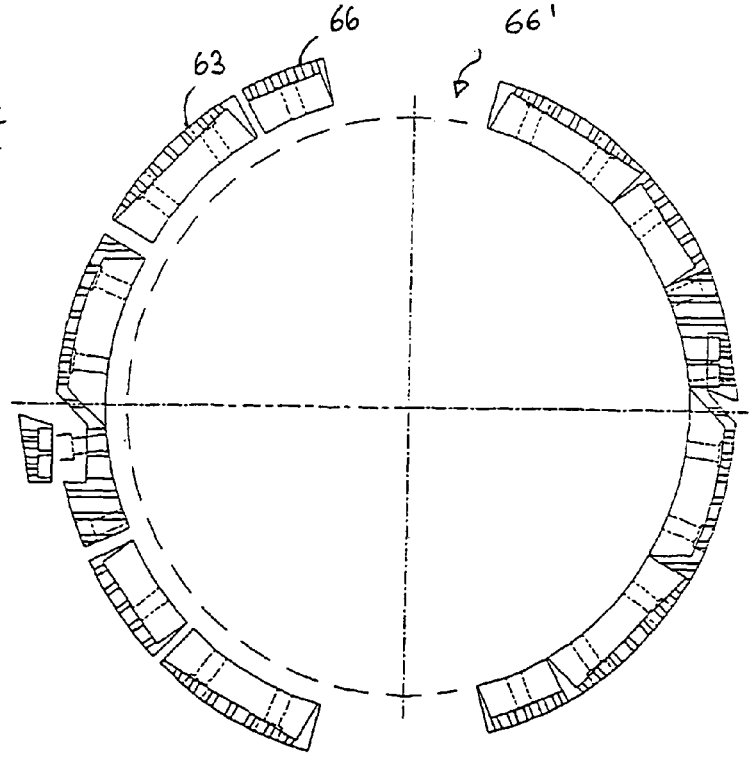

Fig. 40
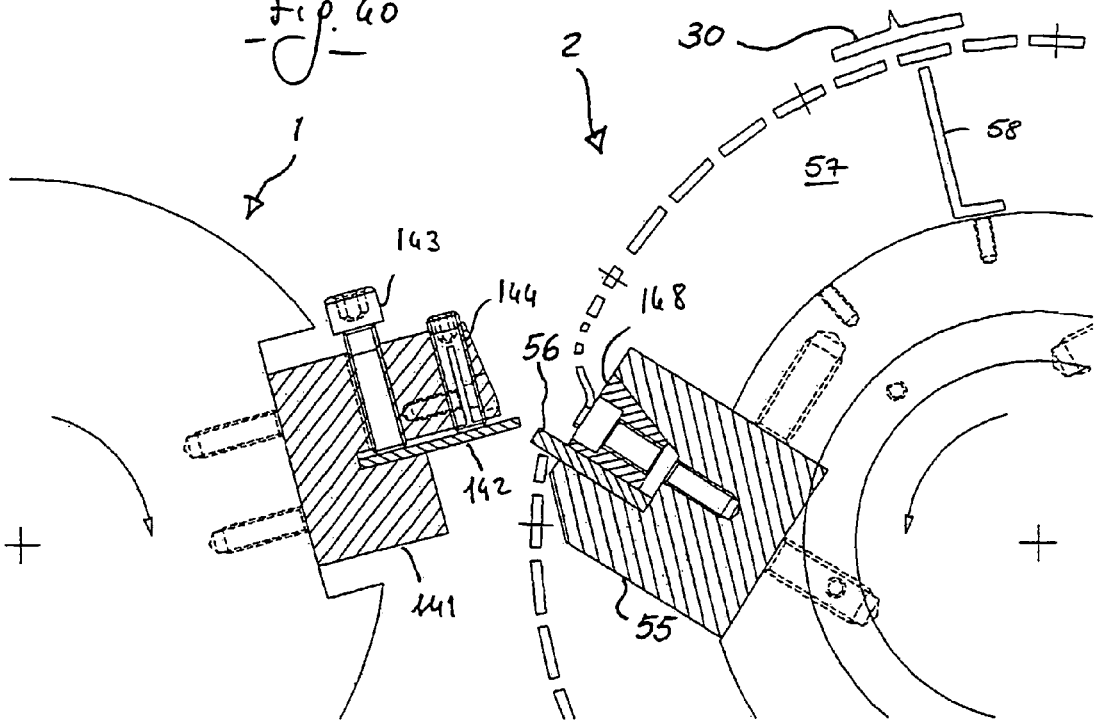
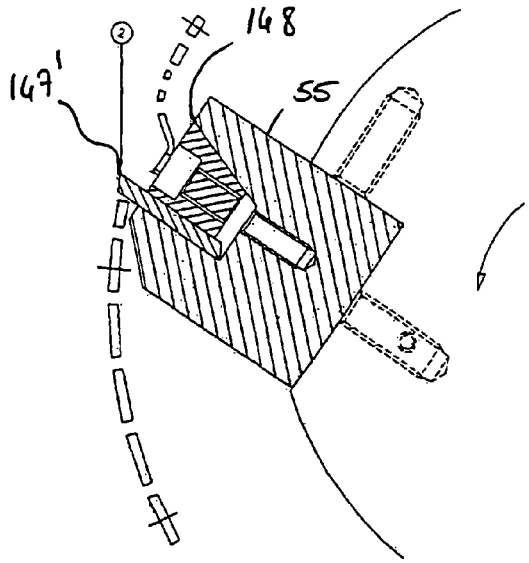
Fig. 41

Fig. 56
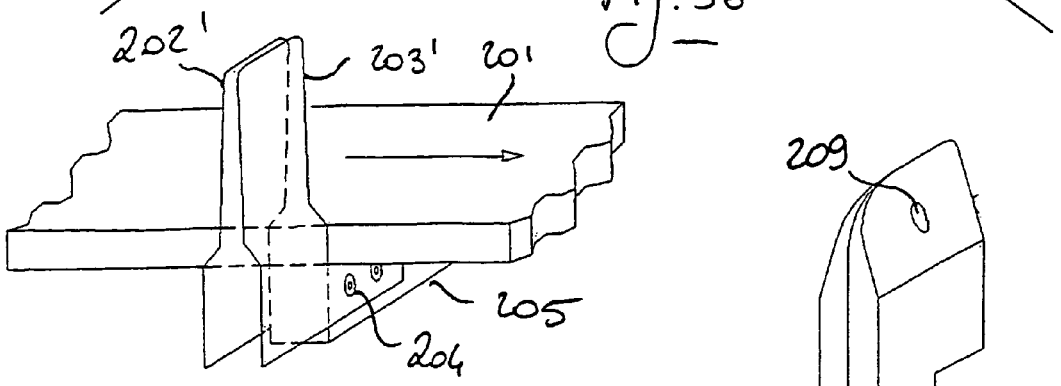
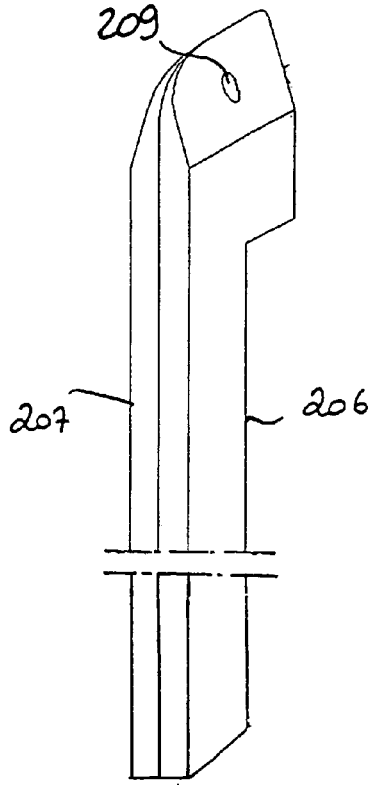
Fig. 57
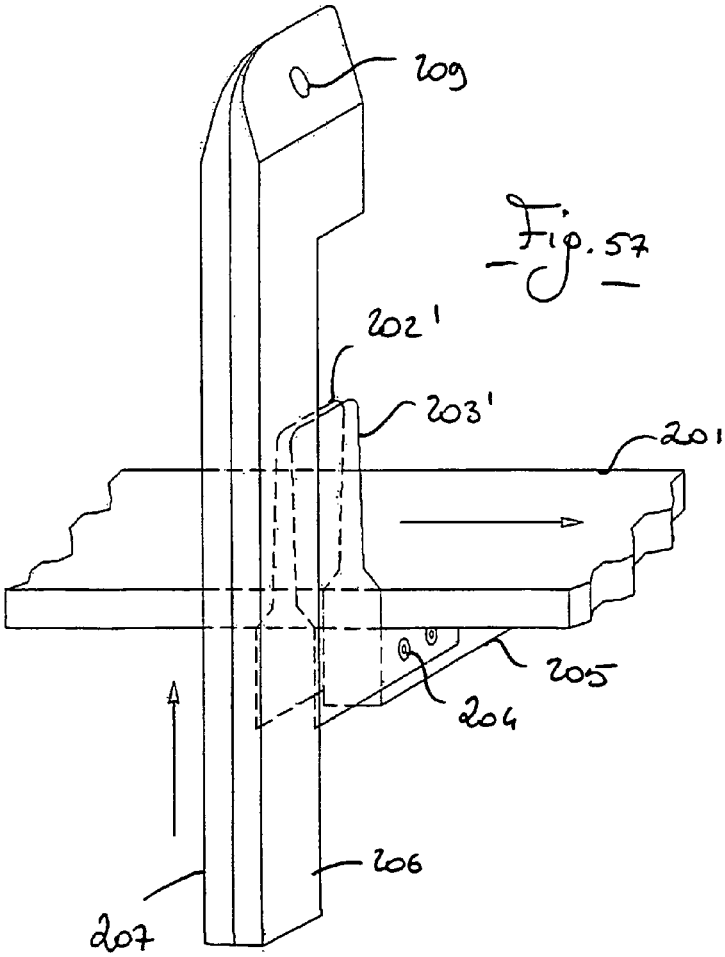

MACHINE FOR THE PRODUCTION OF FLEXIBLE MATERIAL SHEETS

The invention relates to a machine for the production of flexible material sheets.

More specifically, the invention relates to a machine for processing paper and similar materials, starting from reels, to obtain square or rectangular sheets, either flat or comprising one, two or more folds. The typical products which can be obtained with the machine according to the invention are sheets for photocopiers, note pads or books, brochures, business forms, cardboard or adhesive labels, place mats and coasters, napkins, dry and moist towelettes, towels, paper items for personal hygiene and tableware, and the like.

The machine according to the invention cuts, folds (when required), conveys, stacks the product and subdivides an exact number of sheets into packages.

The machine can be included in a process cycle comprising a number of processing phases prior to the intervention of the machine, such as unwinding, calandering, printing, embossing, and a number of processing phases following the intervention of the machine, such as packaging in shrink-wrap packages, in envelopes or in boxes, boxing of several packages, palletizing and stocking.

As known, when processing paper products, and more generally sheets or strips of flexible material, the single products which can be obtained are sheets of raw material, cut and folded in the form of squares or rectangles. Cutting must always be performed, while folding is optional. These operations are performed when the paper is wound on the rotating cylinders which form the heart of machines of this type. The strip is cut in the orthogonal direction with respect to the direction of movement. This will herein be called "transversal cut". The fold is also made along the same direction, and will consequently herein be called "transversal fold".

A first shortcoming of machines of the known type is related to the dimensions of the products which can vary only within a very limited range. It is noted that, with reference to this matter, we will herein specify that the "format" of the product will be changed when the dimensions change without changing the shape of the product. The current operation of the machine according to the invention is "format change". The "range of formats" is the set of various sizes which can be obtained for each item.

In the art, the strip of paper can be folded longitudinally in the direction of unwinding before being introduced in the machine. In this case, the aforesaid products will increase the total number of folds.

Alternatively, the semifinished strip is preventively and longitudinally folded prior to being introduced in the machine.

It is also possible that the edges of the folded products do not perfectly coincide. In practice, this solution—called "staggered folding"—is used to permit faster opening of the product by hand. The opposite solution, in which the folded edges coincide exactly, is called "in line folding" and ensures a better appearance of the folded product, to the expense of making the product slower to open in use.

Given such premises, it is noted that production must be discontinued in the known machines when passing from one product to another. Additionally, staggering of folds cannot be currently adjusted while the machine is running.

At the end of these production phases, the single products must be grouped in packages, of various numbers and possible configurations. All of the single product types described above, and other types of products, must be either grouped or subdivided into packages containing the exact amount of products and conveyed to the following processing phases. However, there is no machine to date capable of counting, subdividing and conveying both flat unfolded products and products with one or more transversal folds. Furthermore, no device to date is capable of subdividing the product in "single vertical packages", "double vertical packages" and "large horizontal packages".

In other words, there are no machines to date capable of producing, counting, subdividing in portions and automatically conveying all the aforesaid products in a single productive unit.

Given these premises, it is understood that all the machines existing today require deep structural transformations either for passing from one item to another presenting a different shape, for passing from one format to another for products whose shape is similar, or for subdividing the products in different packages. Such transformations interrupt production for long periods of time, hindering and making the changes costly. In other machines made to date, the cutting and folding unit, as well as the automatic conveying unit, must be entirely replaced when changing item, format or package of products.

Another shortcoming of these implementations occurs when changing the configuration despite they permit working on one or more lines, for example between two or three lines. This is because the configuration requires deep structural modifications of the production machine. For this reason, the number of lines in the current machines is generally fixed beforehand and is a constraint for configuring the entire production unit.

The object of the invention is to solve the aforesaid shortcomings by providing a particularly integrated and flexible system.

These objects according to the invention are reached by a machine for processing flexible material sheets, as described in claim 1, to which reference is made for the sake of brevity.

The machine for processing flexible material sheets according to the invention presents numerous and important advantages, which will be briefly outlined in the text that follows.

Firstly, the machine groups all the mechanical devices required for the production of all the aforesaid items, as well as all the devices required for counting, subdividing in portions and automatically conveying such items.

The machine can be used for working on a number of lines, varying in the range from one to four at the same time, for parallel productions, for multiplying the obtainable production proportionally to the adopted number of lines. This is because the working width of the cylinders of the machine can be divided into one or more parallel lines, providing maximum flexibility and possibility of rapid change in configuration.

There are other working characteristics which include the possibility of changing the product type or the possibility of changing the format (i.e. the length between two successive transversal cuts) by means of a touch screen control panel.

Staggering can be adjusted during production, again by means of a touch screen control panel, and a self-adjusting shears cutting feature with quick transversal blade change can be provided for operation on up to four parallel production lines.

The invention will now be described in detail, by the way of example only, with reference to the accompanying drawings wherein:

FIG. 1 schematically illustrates a cross-sectional view according to a vertical plane of a first embodiment of the invention;

FIGS. 2 to 5 show the first cylinders of the machine according to the invention, in different working configurations;

FIGS. 6 to 13 indicate some of the possible combinations of kits which can installed in the machine according to the invention;

FIG. 14 schematically illustrates the timing device between transversal cutting unit and manual check unit;

FIG. 15 schematically illustrates the ⅛ folding cartridge timing device;

FIGS. 21–24 illustrate various embodiments of the suction cylinder;

FIG. 27 shows a detail of the machine according to the invention, while

FIG. 29 illustrates a detail referred to the ejection system of the machine according to the invention, while

FIG. 40 is an enlargement of FIG. 19 and illustrates in detail the concept used for quickly changing the blades and the counterblades for making transversal cuts;

FIG. 41 illustrates a particular type of counterblade;

FIG. 42 shows a cutting system along the longitudinal axis of the cutting cylinders and anvil cylinders, while

Figure 44:
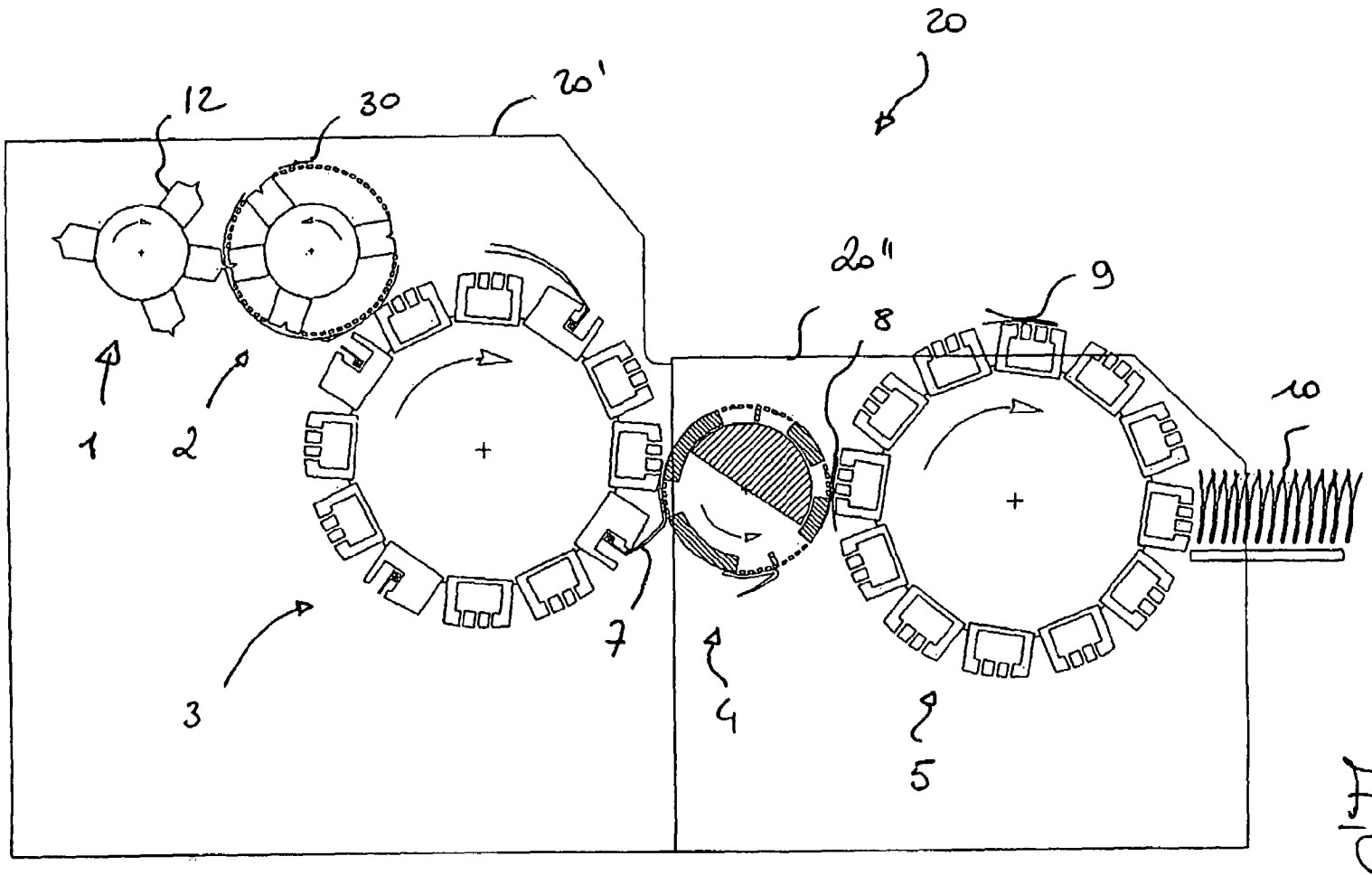
FIG. 44 illustrates a cross-sectional view of the ¼ folding unit and the ⅛ folding unit assembled together.
Figure 45:
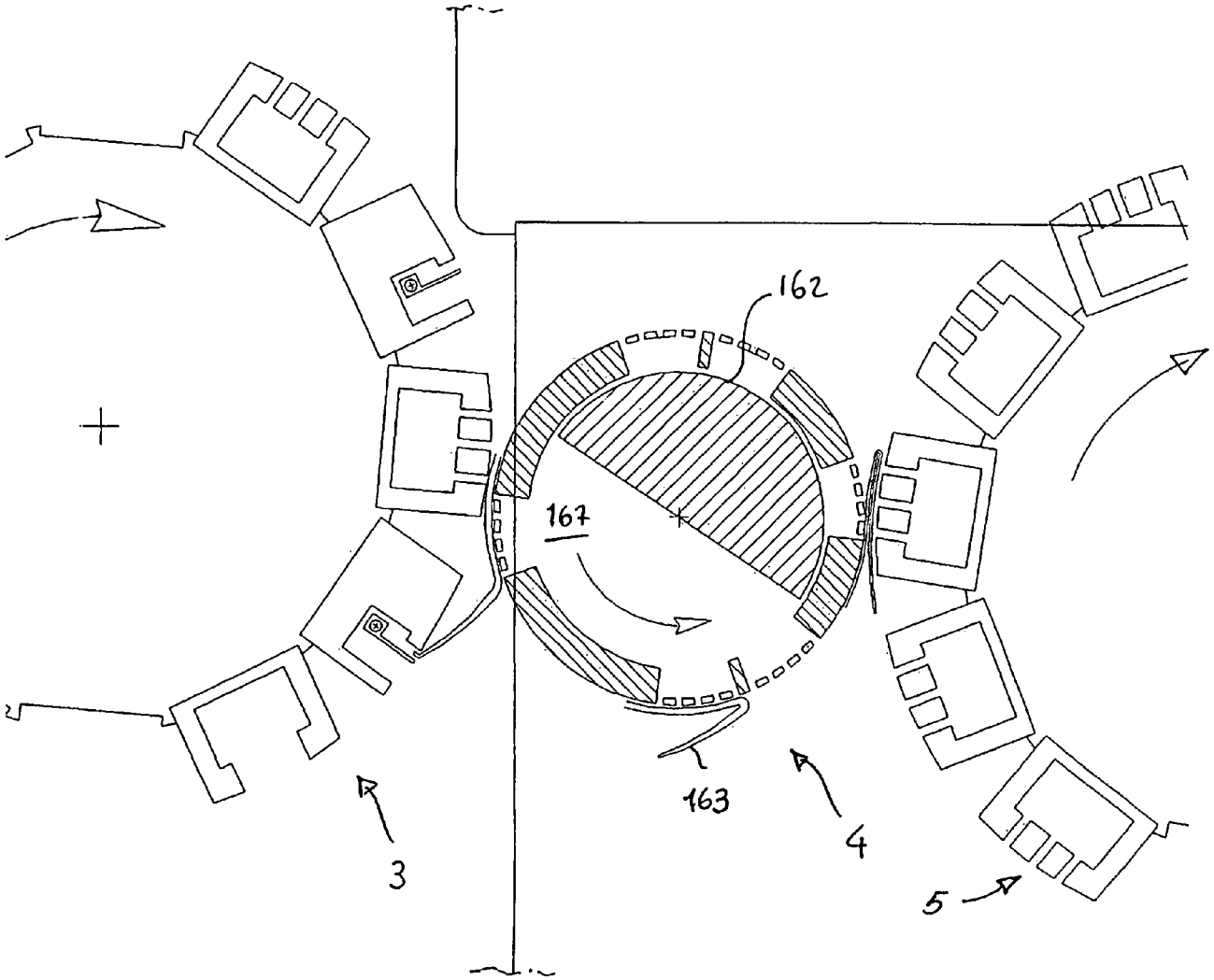
Figure 46:
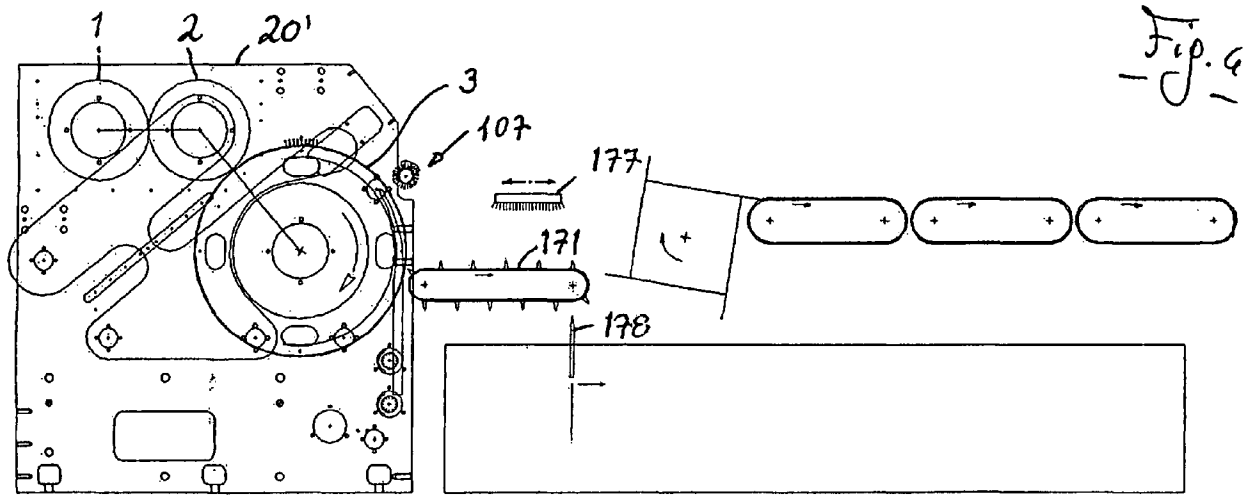
Figure 47:
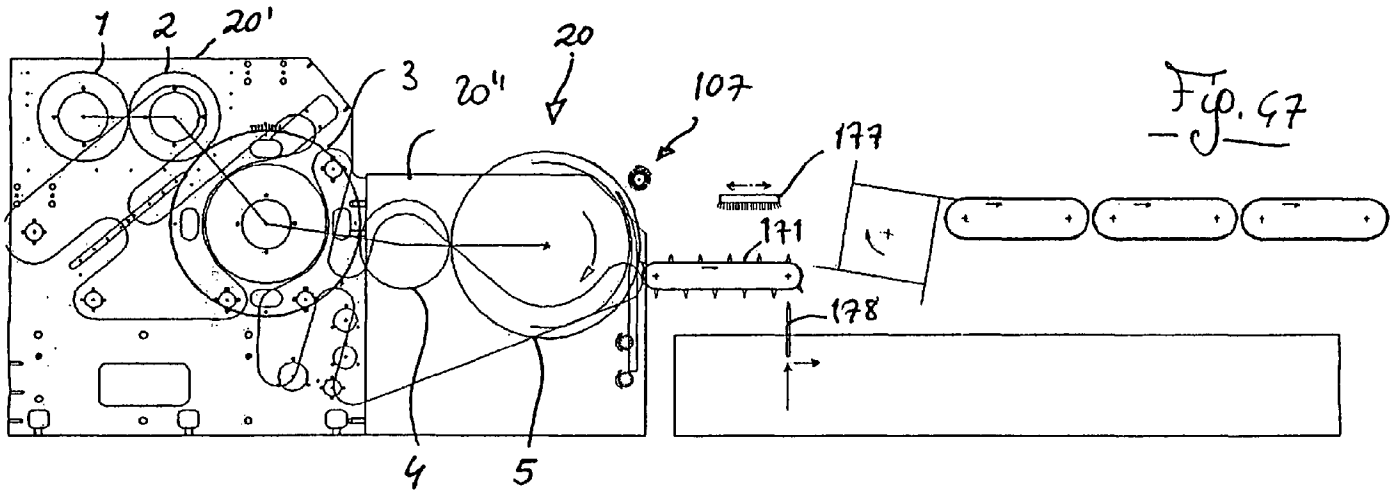
Figure 48:
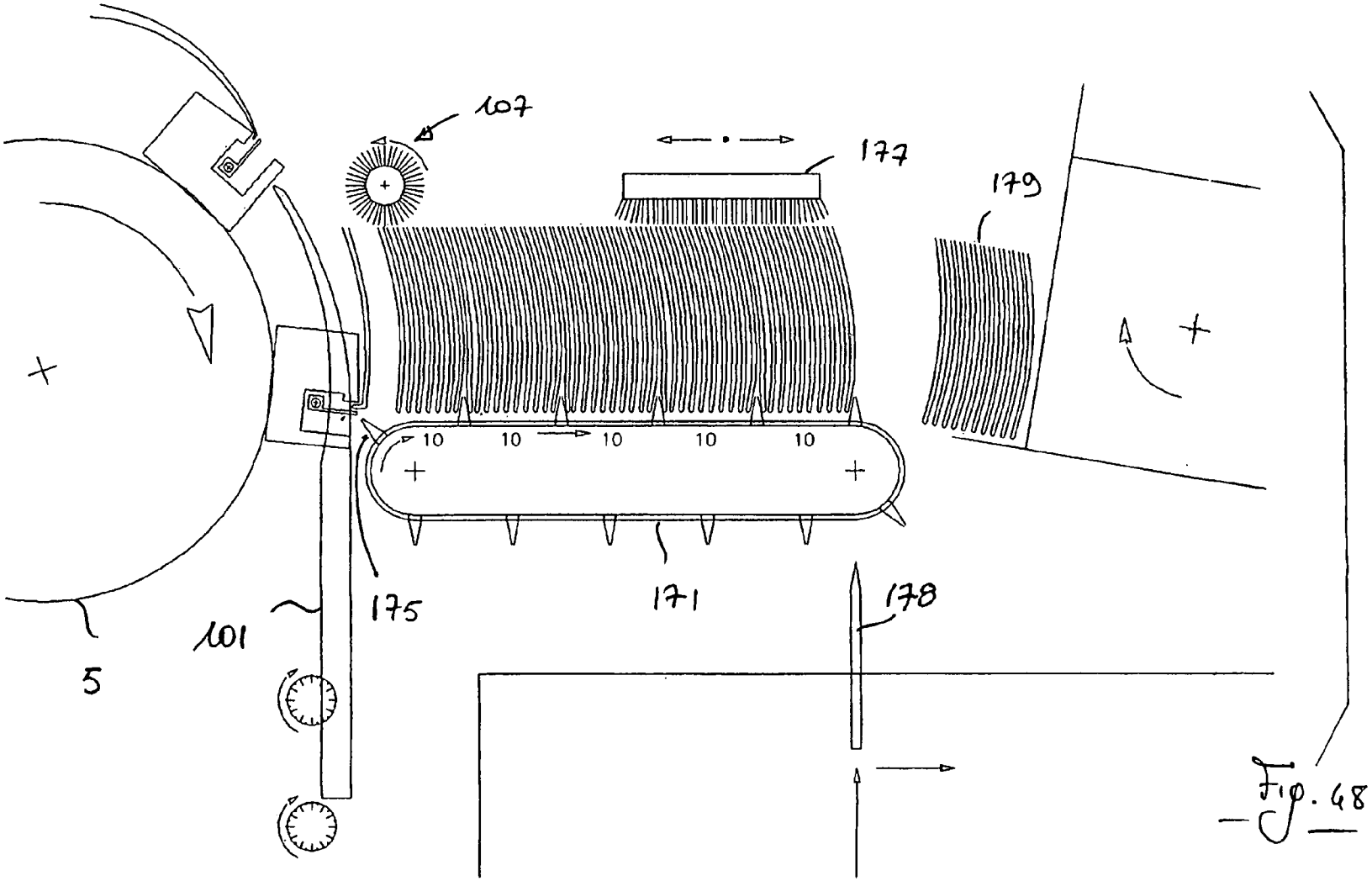
Figure 69:
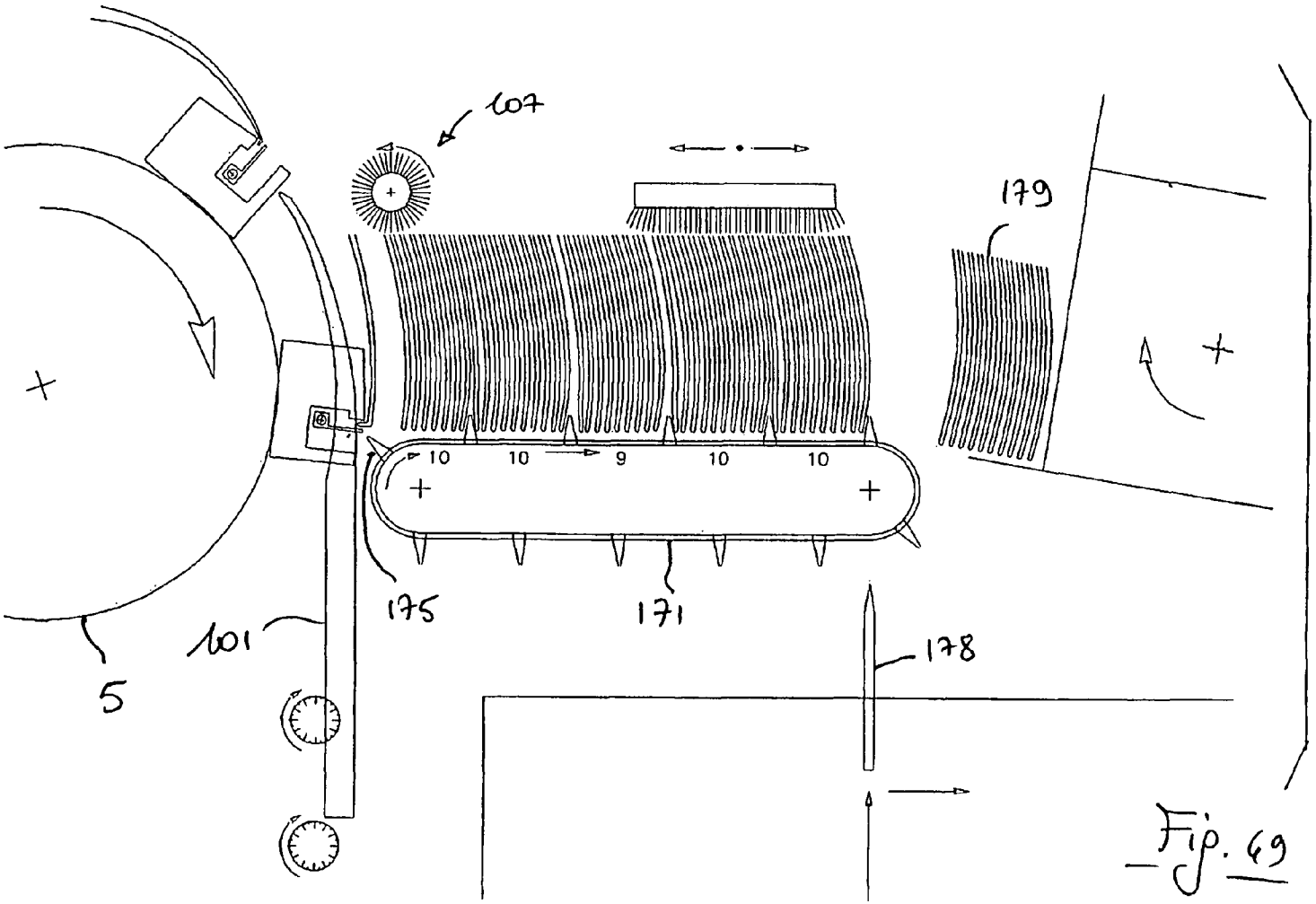
Figure 50:
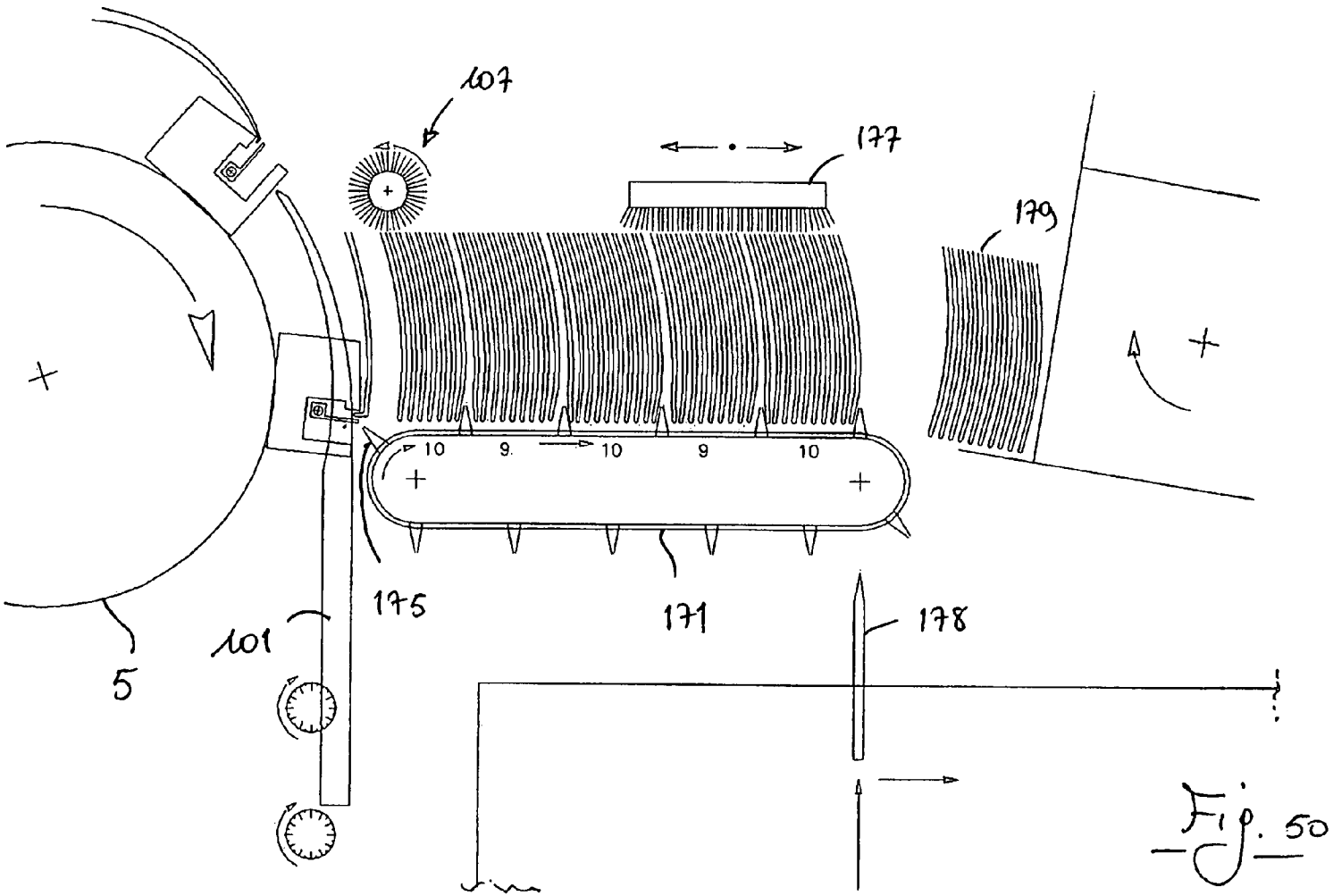
Figure 51:
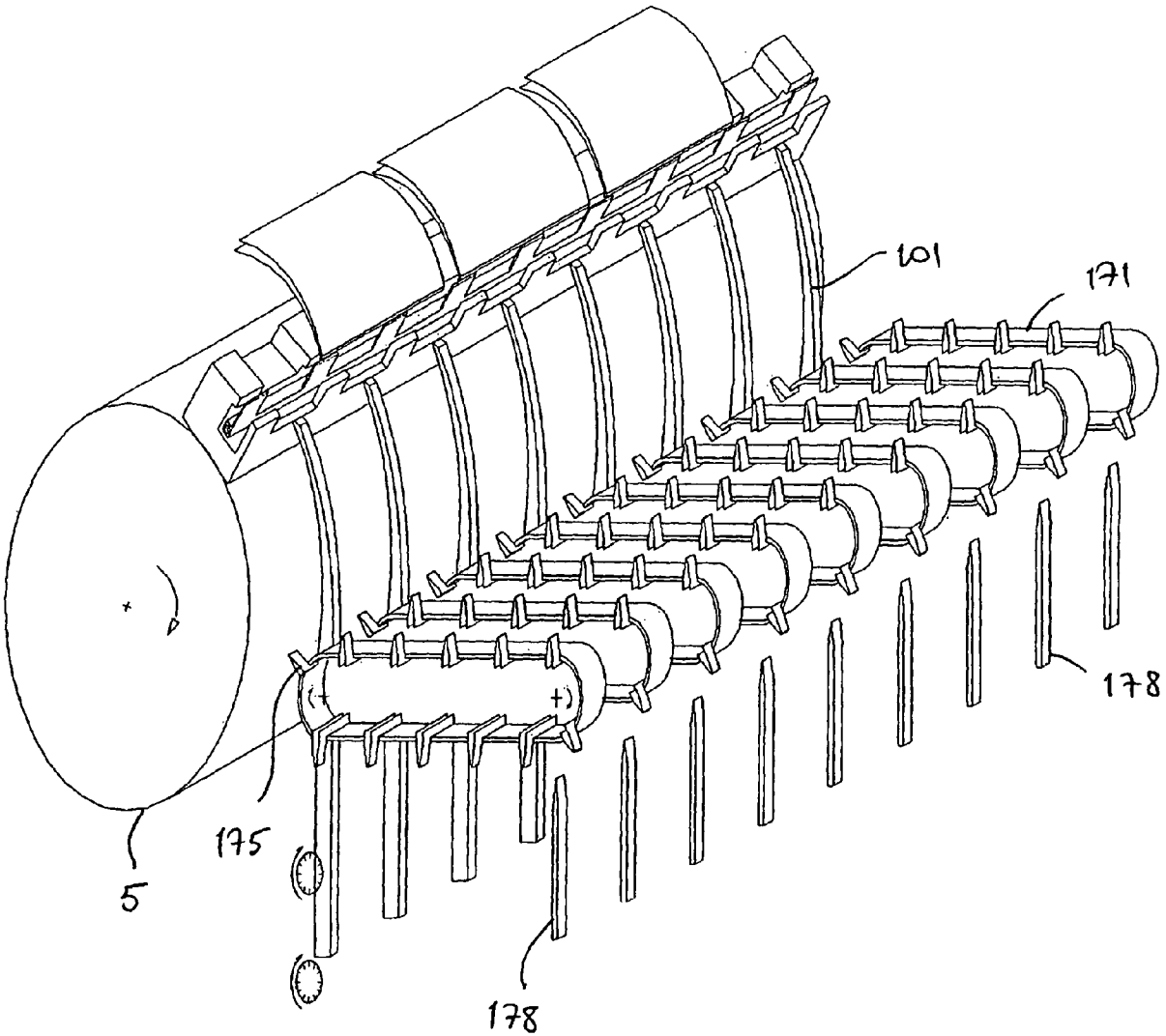
Figure 52:
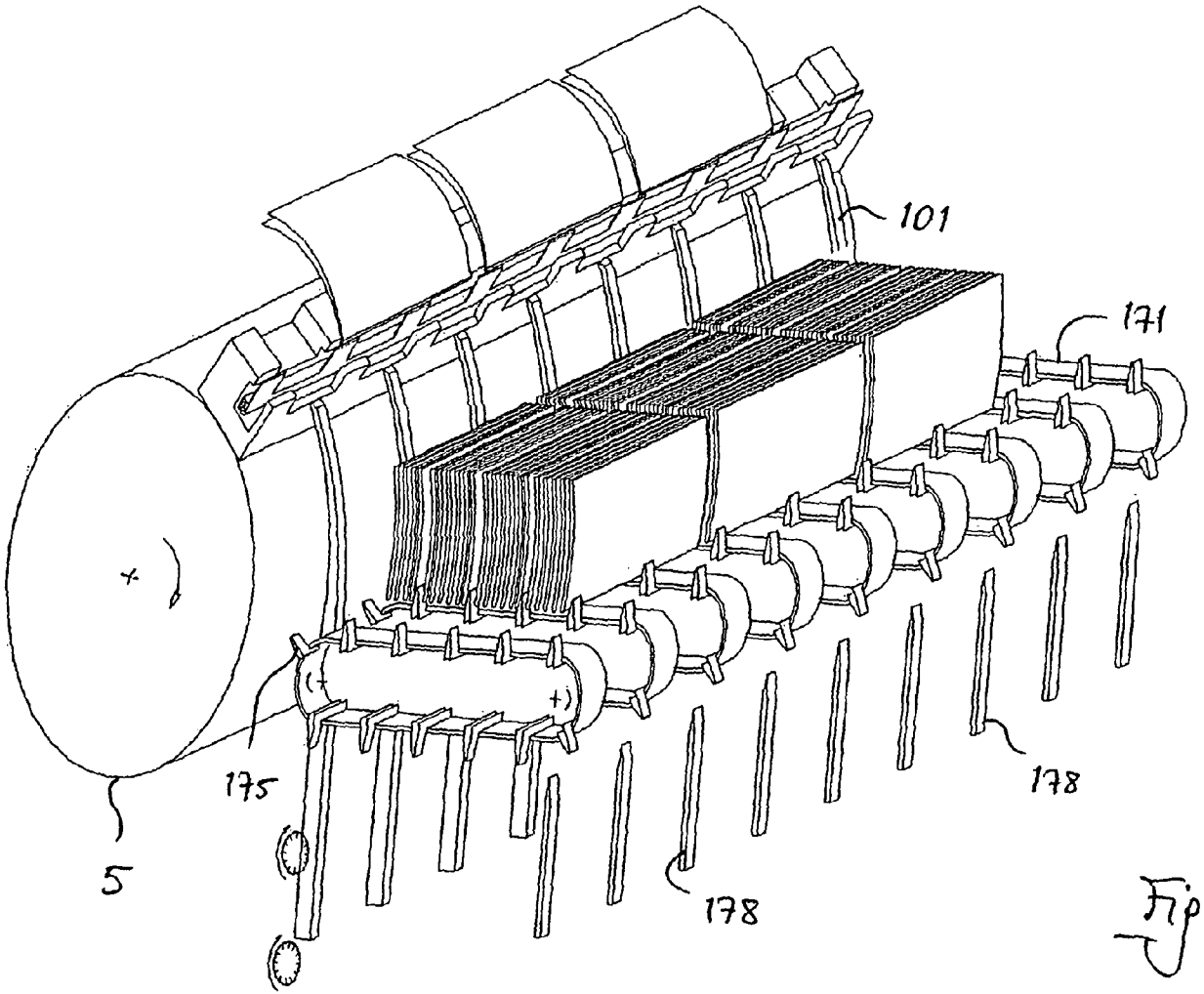
Figure 53:
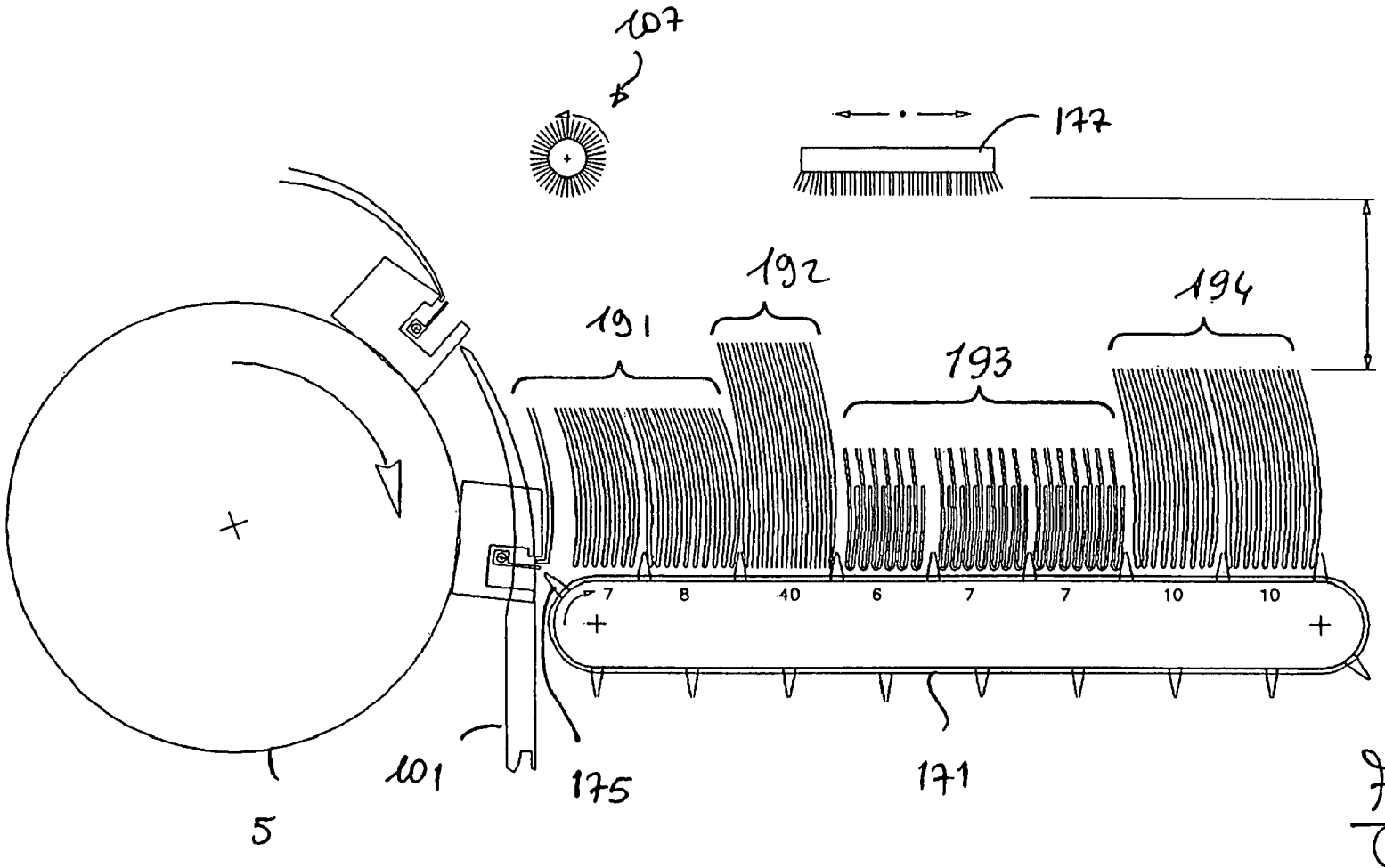
Figure 54:
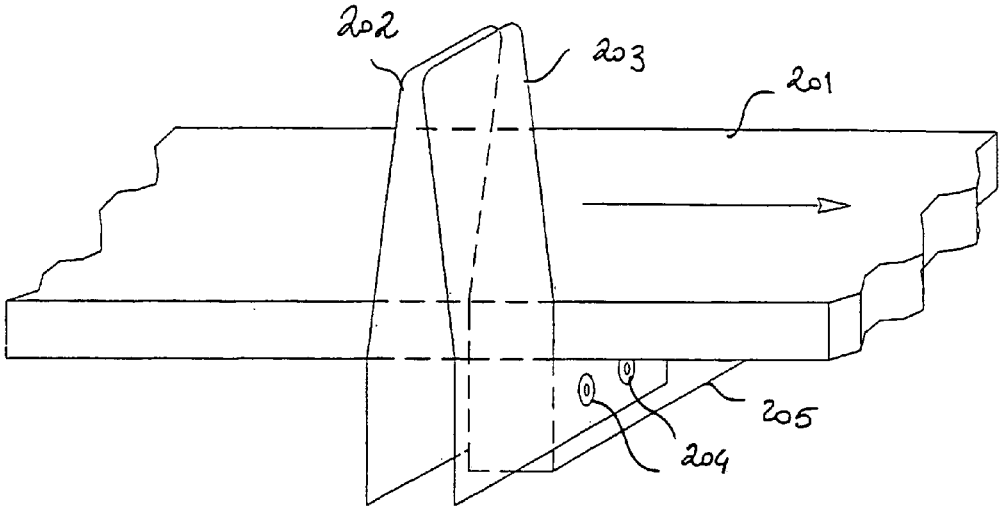
Figure 55:
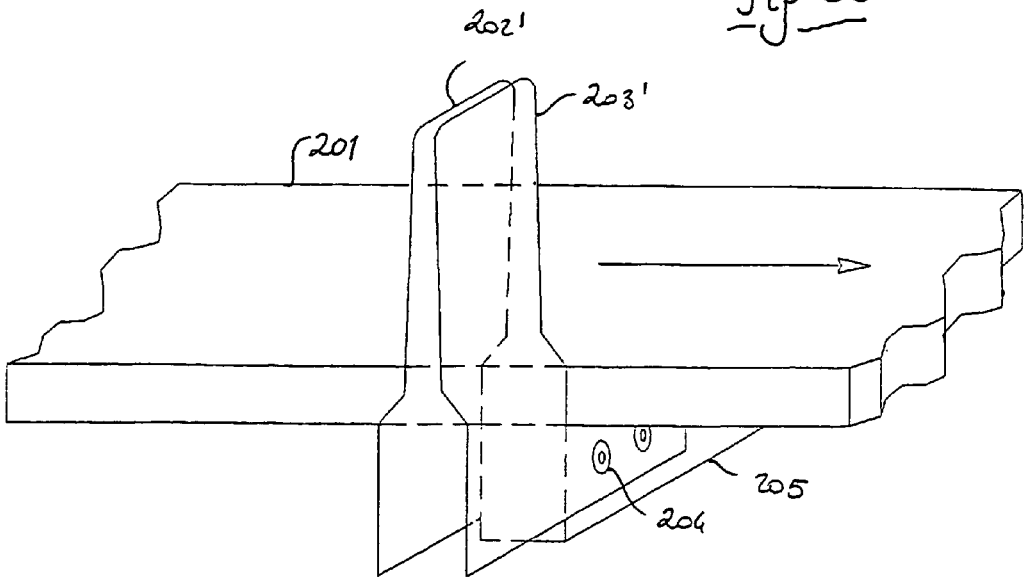
Figure 58:
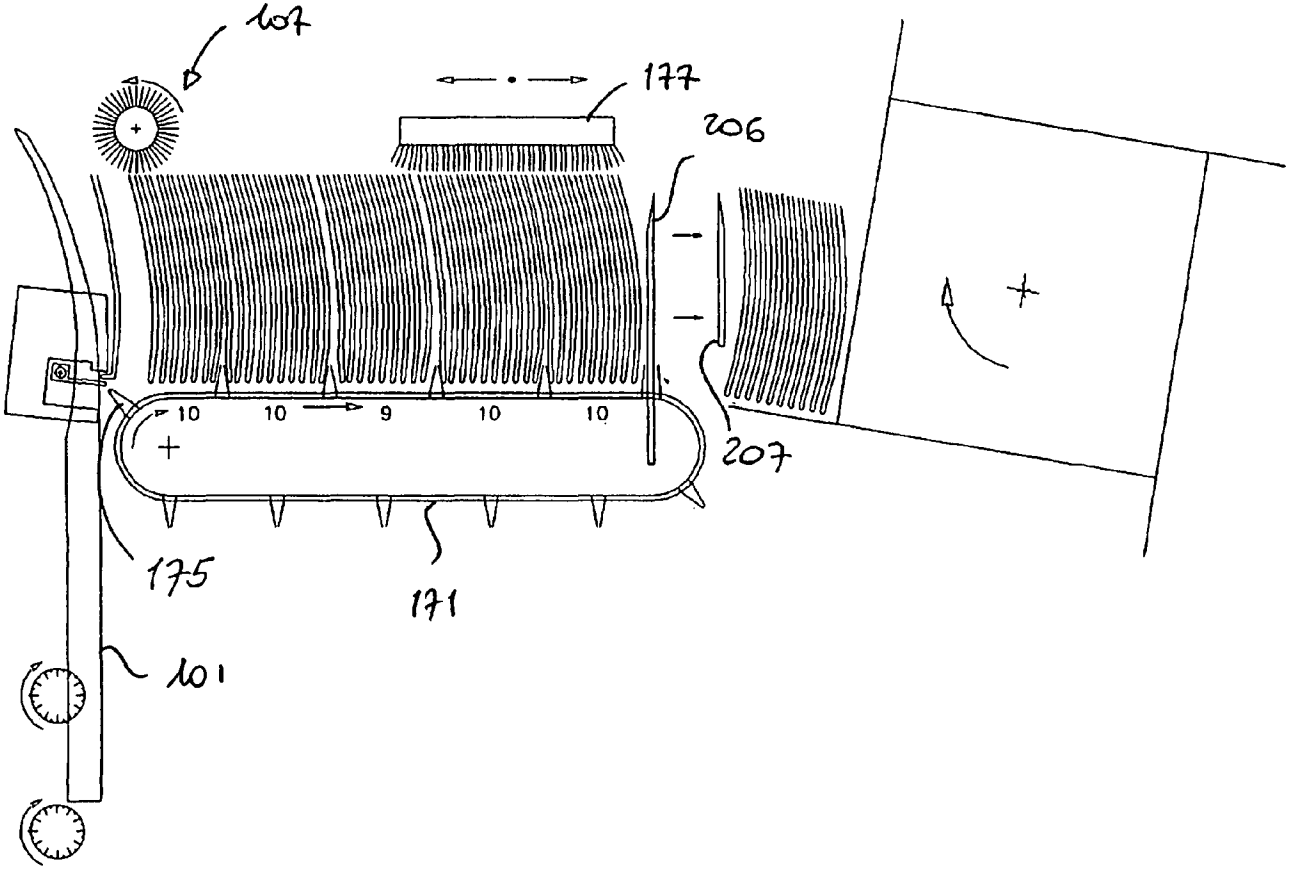
Figure 61:
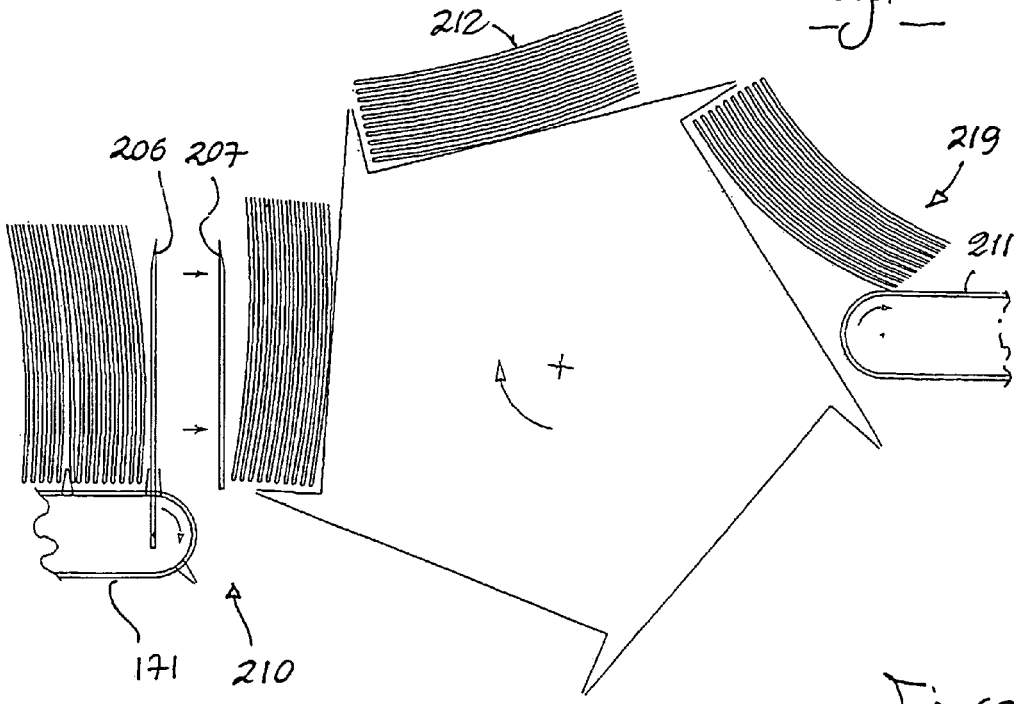
Figure 62:
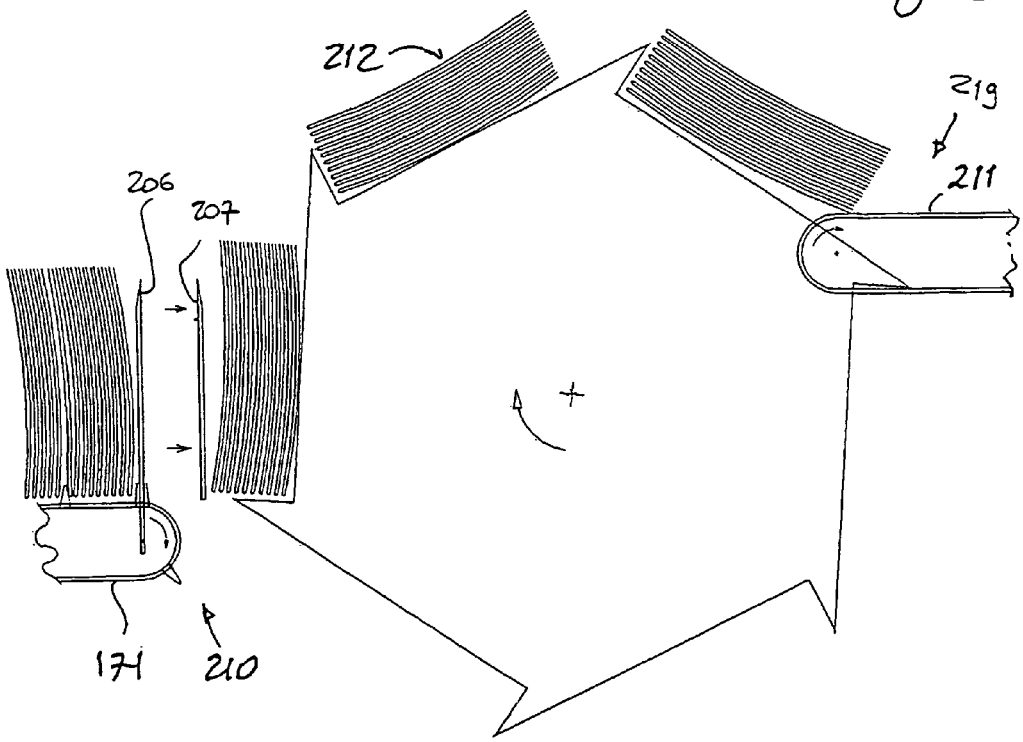
Figure 64:
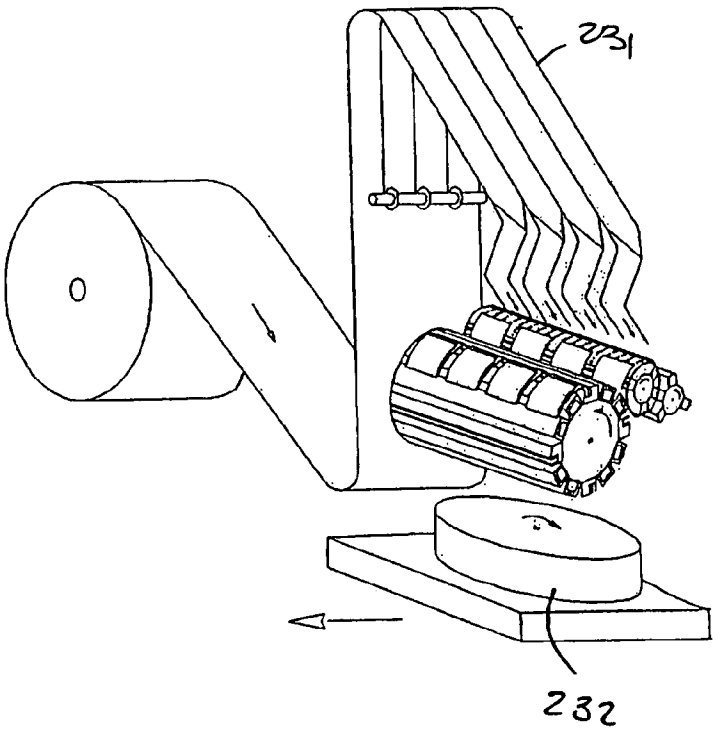
Figure 63:
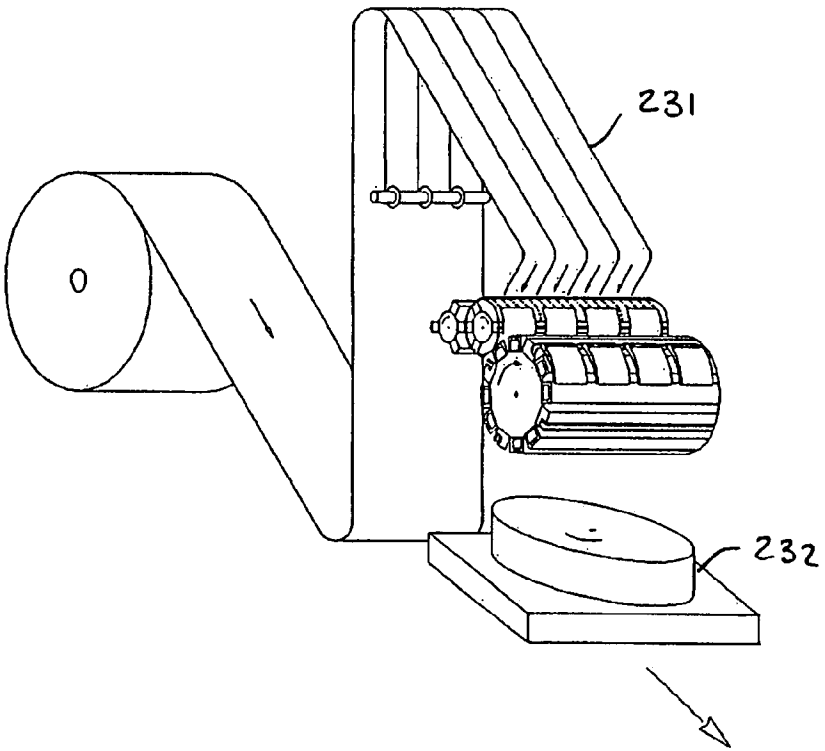

FIG. 45. is an enlargement of FIG. 44., showing the ⅛ folding cylinder only;

FIG. 46 shows the automatic conveyor unit assembled after the ¼ folding unit, while FIG. 47 shows the same unit fitted on the ⅛ folding cartridge;

FIGS. 48 to 50 illustrate the conveyor unit in the machine according to the invention in various different working situations;

FIGS. 51 and 52 are perspective views of the conveyor unit in the machine according to the invention in various different working conditions;

FIG. 53 illustrates different products of various thickness and heights, presented on the same conveyor unit;

FIGS. 54 and 55 illustrate two different embodiments of the counting system of the machine according to the invention;

FIGS. 56 and 57 illustrate the separating vanes in the machine according to the invention in two different operative positions;

FIG. 58 illustrates a phase in the package separation cycle;

FIGS. 59 to 62 illustrate different embodiments of the package tipping system; and FIGS. 63 and 64 illustrate the concept of orienting the base of the folding unit in the selected direction and the practical implementation of by means of a rotating base.

Figure 1:
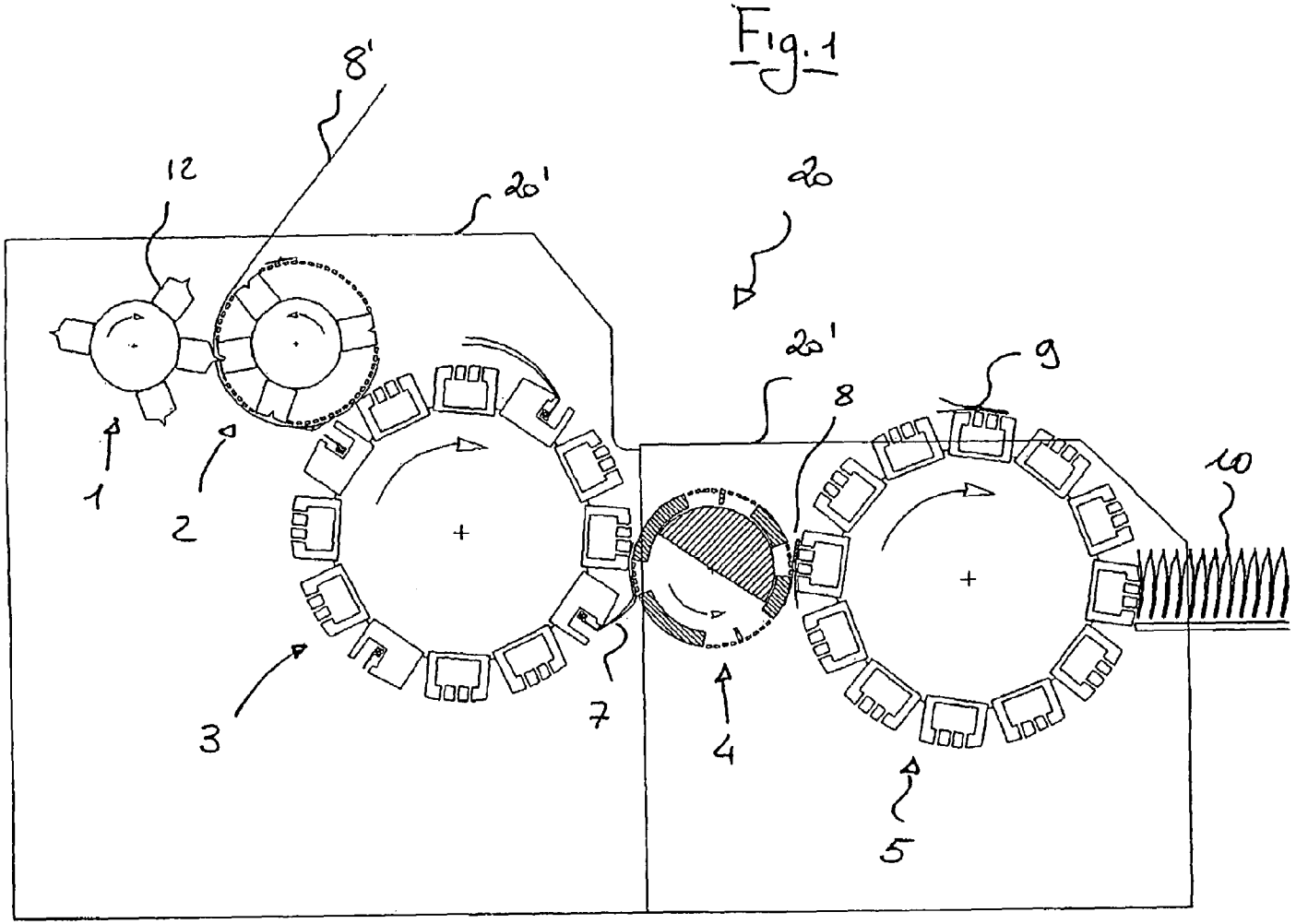
Figure 2:
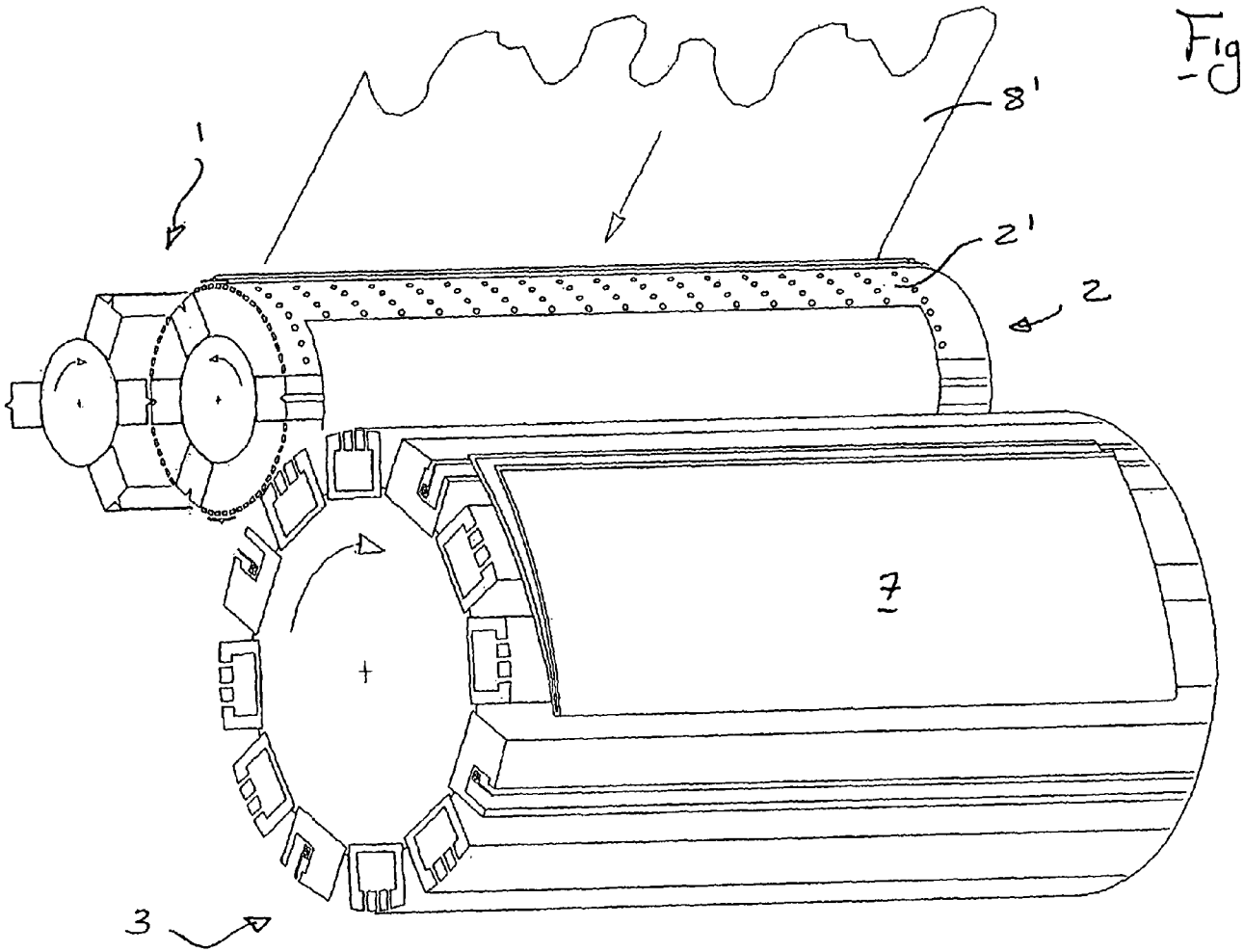
Figure 3:
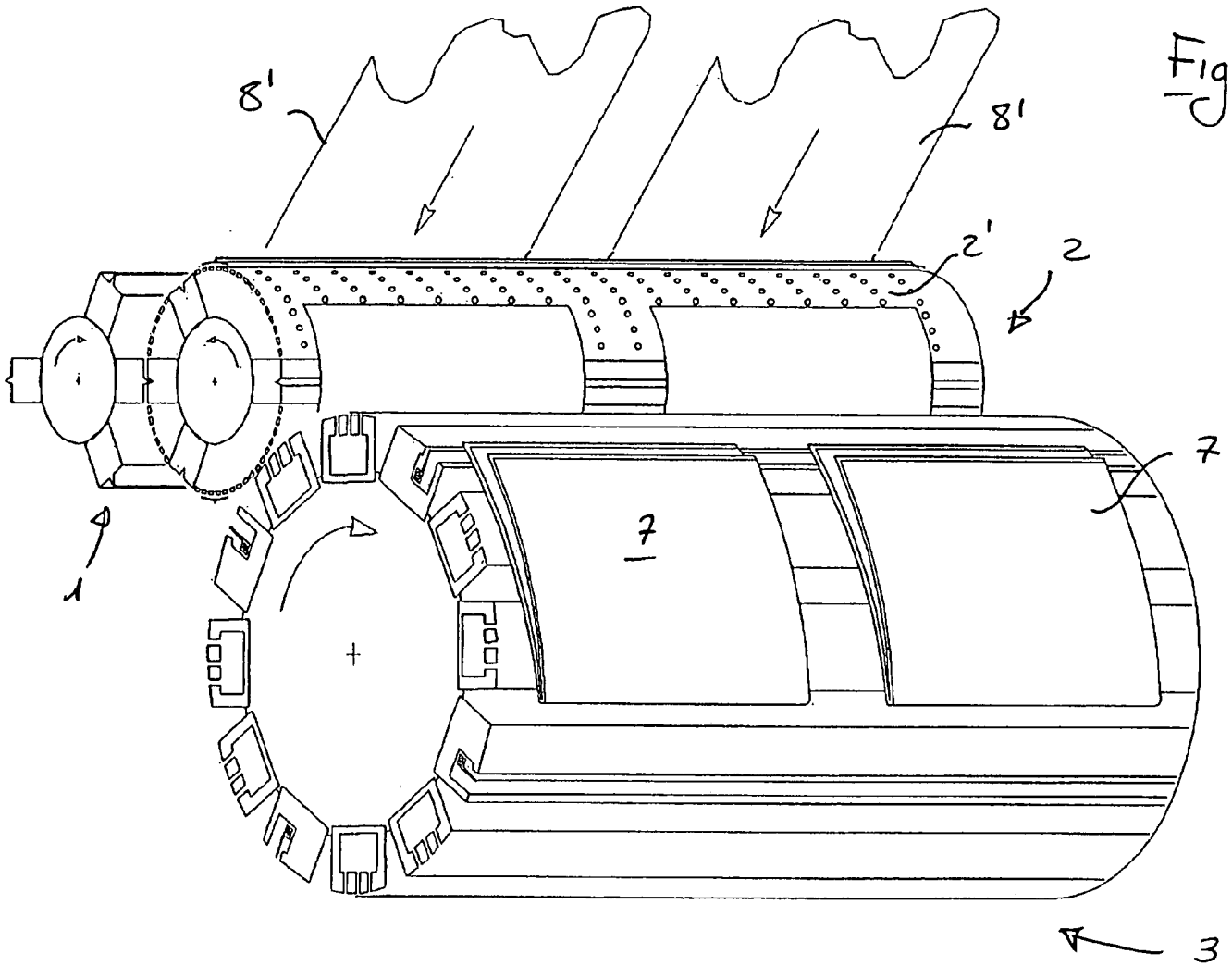
Figure 4:
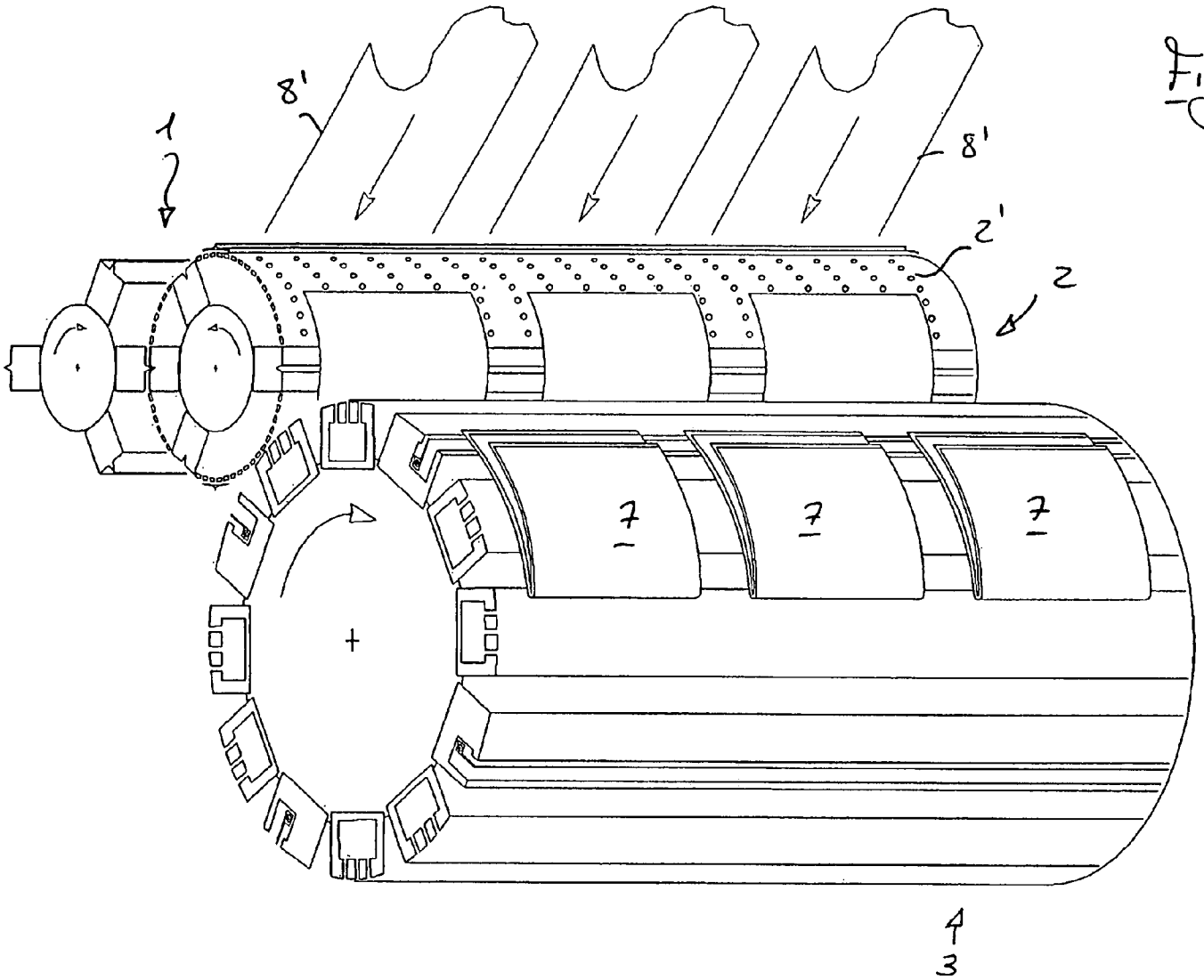
Figure 5:
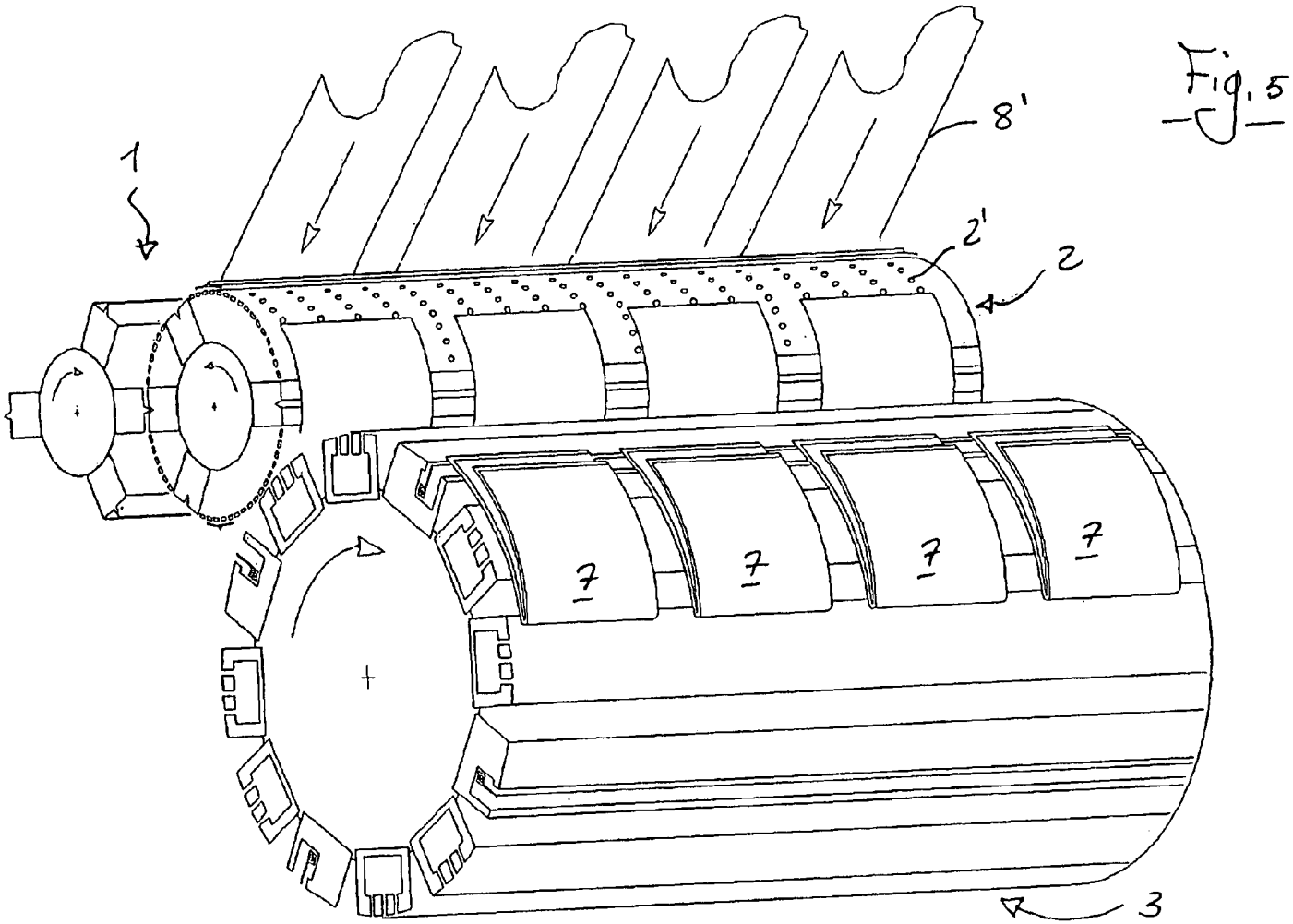

The machine according to the invention will now be described in detail with initial reference to FIG. 1. FIG. 1 schematically illustrates a cross-sectional view according to a vertical plane of a first embodiment of the machine according to the invention, generally indicated by reference numeral 20. The machine 20 comprises a ¼ folding unit, indicated by reference numeral 20', and a ⅛ folding unit, indicated by reference numeral 20". The machine 20 comprises a transversal shear cutting cylinder 1, which may have two, three or four developments, and a counterpoised suction cylinder 2 to obtain variable formats, by acting as a transversal cutting anvil, also with two, three or four developments. Subsequently, there is a gripping cylinder 3 for transversal folding 3, and/or for conveying the flat product by suction and a suction cylinder 4 for the second transversal fold, and/or for conveying the flat product by vacuum. Finally, the cylinder unit is completed by a conveyor cylinder, for conveying the ⅛ folded product, the ¼ folded product or the flat unfolded product.

In practice, FIG. 1 also shows a product which is let into the machine 20 in the form of the strip 8' in various phases of the process, and specifically shows a ¼ folded napkin 6, which has just been taken by the gripper, and the instant 7 in which the gripper opens, while the napkin is withheld by vacuum by the cylinder 4. The ⅛ folding operation is carried out in this position. Instant 8—in which the vacuum of cylinder 4 is stopped by a specific lateral valve and the ⅛ napkin is conveyed to the last cylinder 5—is also visible. The cylinder 5 also houses a suction kit 9, fitted on the cylinder 5, which withholds the napkin until the stop rack, where suction is discontinued by the operation of a lateral valve. The cylinders 3 and 5 are essentially identical, having from 4 to 6 developments, and having a diameter which is preferably double that of the cylinders 1, 2, 4. They have twelve assembly positions and can accept any combination of suction kits and/or transversal gripping kits.

FIG. 1 also shows a unit 10 for counting, subdividing and automatically conveying the packages. This is an optional unit, however, and can be replaced by a stop rack with product gathering table for manual counting and subdivision.

A gripping kit 11 fitted on the gripping cylinder 3 is also provided. The most versatile configuration entails mounting four gripping kits 11 and eight suction kits 9 on the cylinder, but other configurations can be adopted as required. The kits are rapidly installable.

It is noted that the transversal cutting kit 12 mounted on the cylinder 1 can be installed in the form of two 180° parts and/or three 120° parts. Both solutions are illustrated in this view. Alternatively, four 90° parts can be mounted. The object of this solution is to extend the range of obtainable formats.

Briefly, the operation of said machine 20 is as follows. The machine 20, which as illustrated is extremely flexible, works by exploding an aspirated-mechanical folding principle. By the way of a brief explanation, the suction cylinder 2 withholds the paper during the cutting operation and determines the possibility of obtaining several different formats using the same folding unit. The same suction cylinder 2 supports the transversal cut, called a sheared cut, which is made with the co-operation of the cylinder 1, which permits processing very difficult raw materials (e.g. air-laid, non-woven, imitation leather). Subsequently, the paper is transferred to the folding cylinder or gripping cylinder 3, by means of the comb-gripper pair, i.e. by mechanical folding (gripping), and by means of vacuum, in the case of flat products. Subsequently, the cut paper is passed to the cylinders 4 and 5, which are also equipped with suction and gripping functions, for in line or staggered book folding. Finally, the conveyor is innovative, suitable for ¼ folding, for ⅛ book folding and for unfolded products.

The examination of FIGS. 2 to 5 shows that the main cylinders—i.e. cylinders 1, 2, and 3—each present a surface which is designed to be entirely exploited in width and to accept the subdivision of the strip on several parallel lines distanced by a gap which may also be very small (e.g. up to 10–20 mm). The suction surface 2', the transversal cutting shear blades, the transversal gripping, the product ejection teeth and the entire automatic conveyor unit were carefully studied to achieve this effect. Incidentally, it is stressed that other realizations of the known art permit processing on one or more lines, but changing configuration, e.g. between two and three lines, requires deep structural modifications to the production machine and that the time required for the change often makes the operation excessively costly.

We will now examine the concept of the format kit and the product kit, showing how they can be combined to extend production versatility.

The following format kits are available for transversal cuts within the following dimensional limits:

"30-48 kit" with two 180° blades for transversal cutting formats from 300 to 480 mm (basic formats).

"20-32 kit" with three 120° blades for transversal cutting formats from 200 to 320 mm.

"15-24 kit" with four 90° blades for transversal cutting formats from 150 to 240 mm.

The following product kits are available to product items with different shapes, while respecting the formats shown above:

"Gripping kit" for transversal folds exploiting the mechanical gripping concept.

"Suction kit" for transversal folds exploiting vacuum.

"Conveyor kit", the same as the suction kit described, above without changes, which is also used to convey flat products without transversal folds.

The following interchangeable cartridge units, to be installed after the ¼ folding unit, are available to produce items with different shapes, while respecting the formats shown above:

"⅛ folding cartridge" suitable for adding a second transversal fold, also capable of transferring the flat product without adding a fold. It is compatible with all the products and formats mentioned above.

"Automatic conveyor unit" for counting, subdividing and packaging all the products and formats mentioned above.

Different architectures and combinations of kits are possible to combine different items and different formats. In practice, installing all the product kits, all the format kits and all the interchangeable cartridges at the same time is not mandatory. The machine can run with a very essential basic configuration, which is a cost-effective entry level configuration. All accessory kits can be installed at a later time, when production needs so require. The conveyor unit can be installed at any later time. The ⅛ folding cartridge can be installed at any time and the installation of the cartridge does not compromise the possibility of making the formats and the products described above. Any combination of the gripping kit and the suction kit can be mounted on the cylinders 3 and 5. The particularly advantageous combinations will be described below. The format kits are all compatible with all the interchangeable cartridges and the product kits. The format kits can be combined in various ways, for example as follows:

"30-48 kit" for basic formats+"20-32 kit" installed at the same time.

"30-48 kit" for basic formats+"15-24 kit" installed at the same time.

The illustrations in FIGS. 6–13 indicate some possibilities of combinations of the kits. Other solutions are possible but only the most interesting combinations for the market of tableware and personal hygiene products, such as napkins, place mats and towelettes, will be listed here for the sake of brevity.

The installation of the "15-24" format kit entails modifications to the cutting and suction cylinders. However, the interest for the equipment is limited to the field of moist or dry towelettes for personal hygiene. For greater clarity, in FIGS. 6 to 13, the gripping cylinder 3 is shown without an external surface covering the empty compartments and the empty spaces between the kits. Naturally, the illustrations are very schematic.

Figure 6:
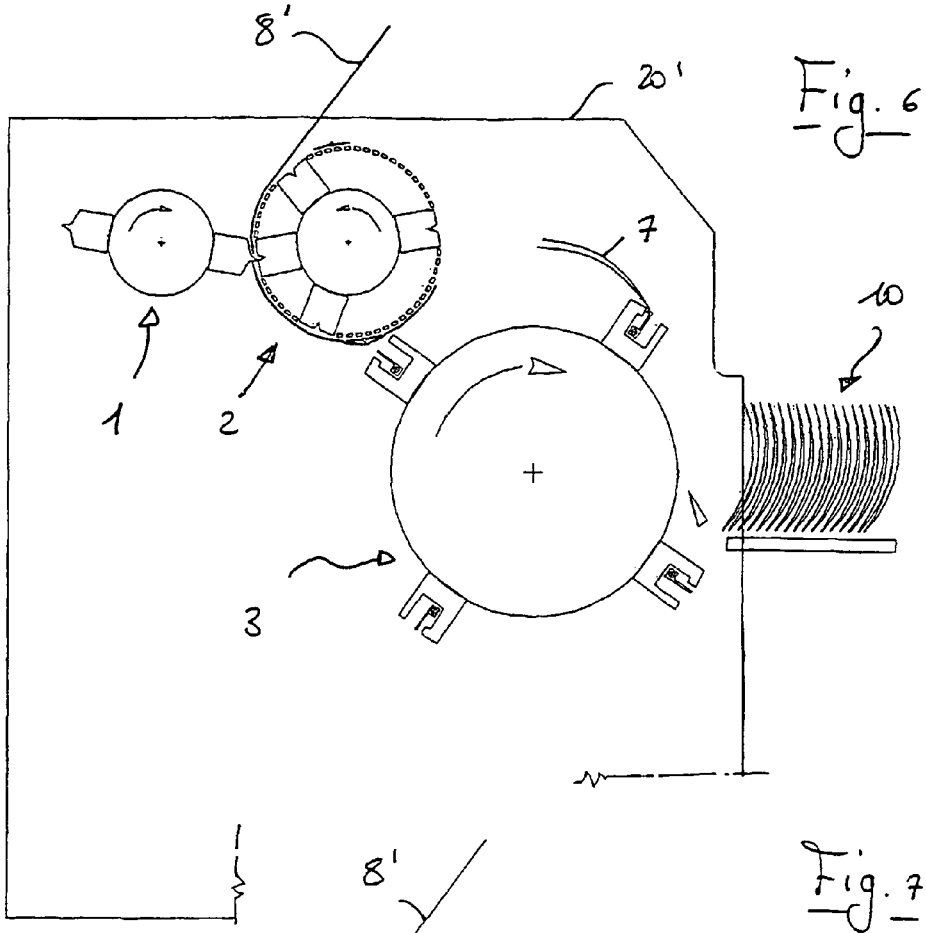
Figure 7:
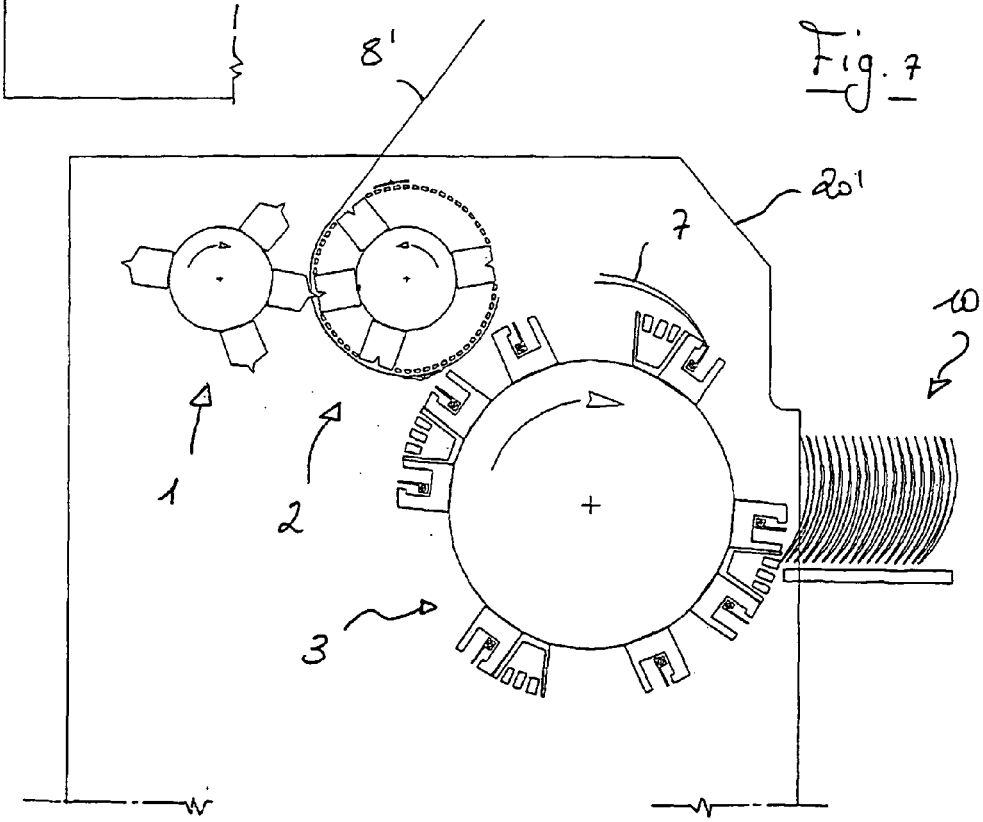
Figure 8:
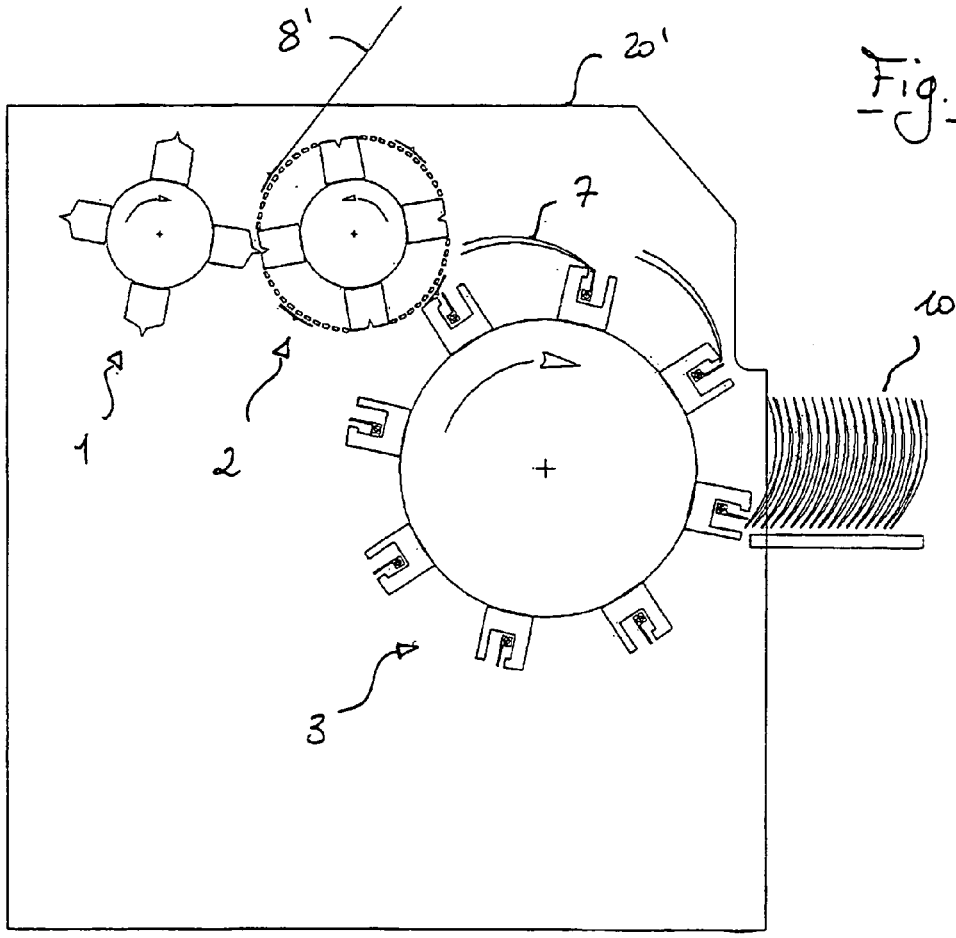
Figure 9:
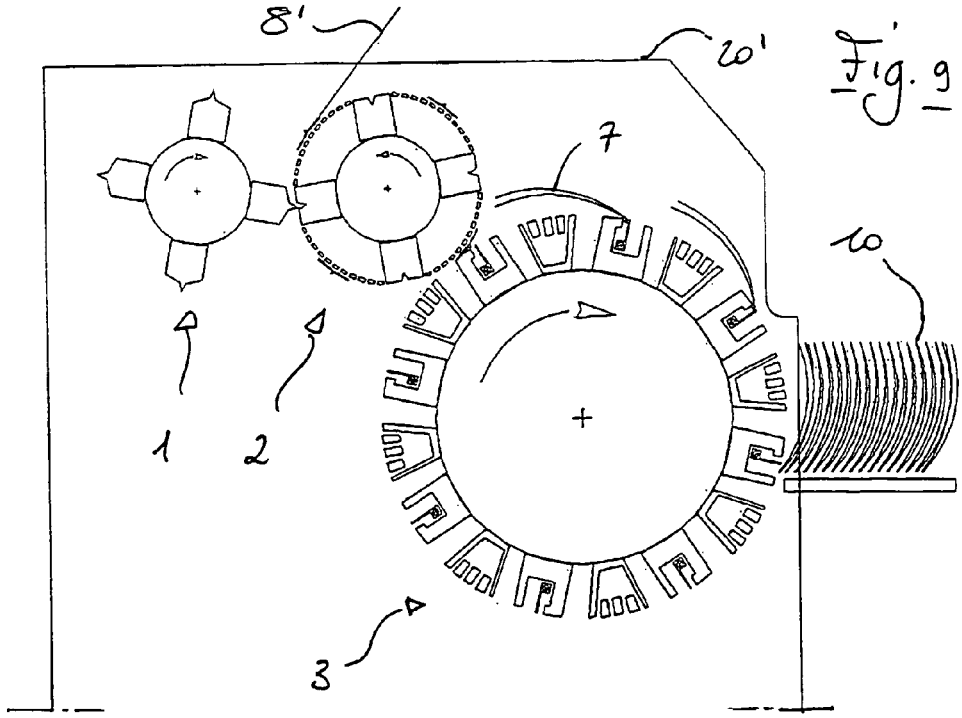
Figure 10:
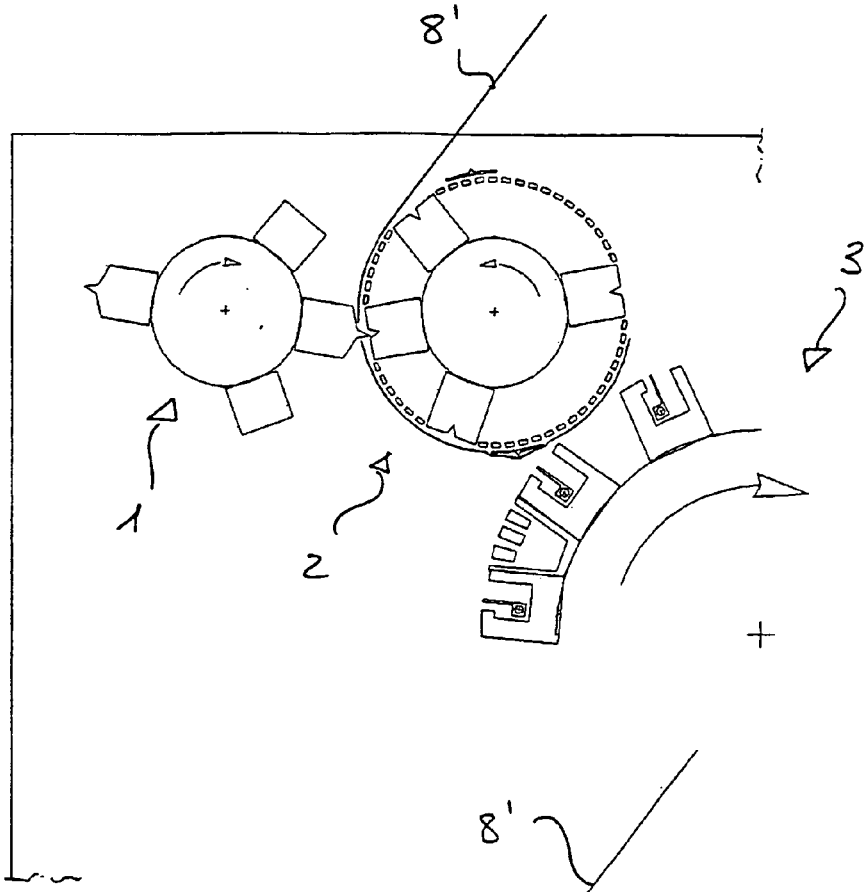
Figure 11:
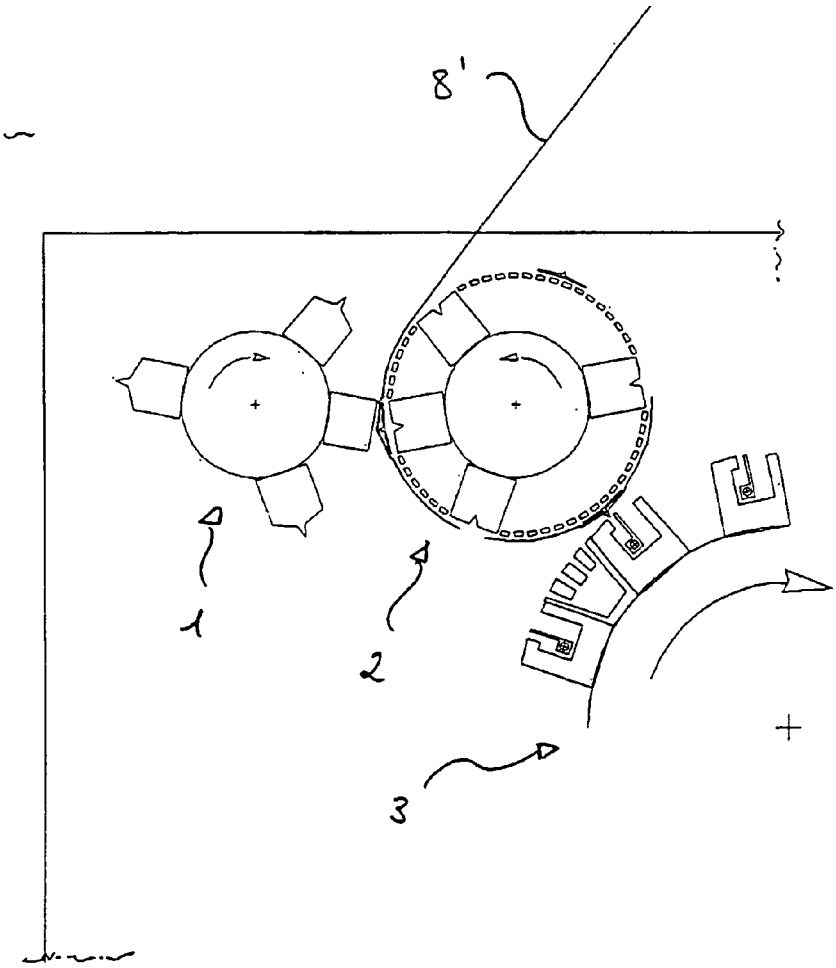
Figure 12:
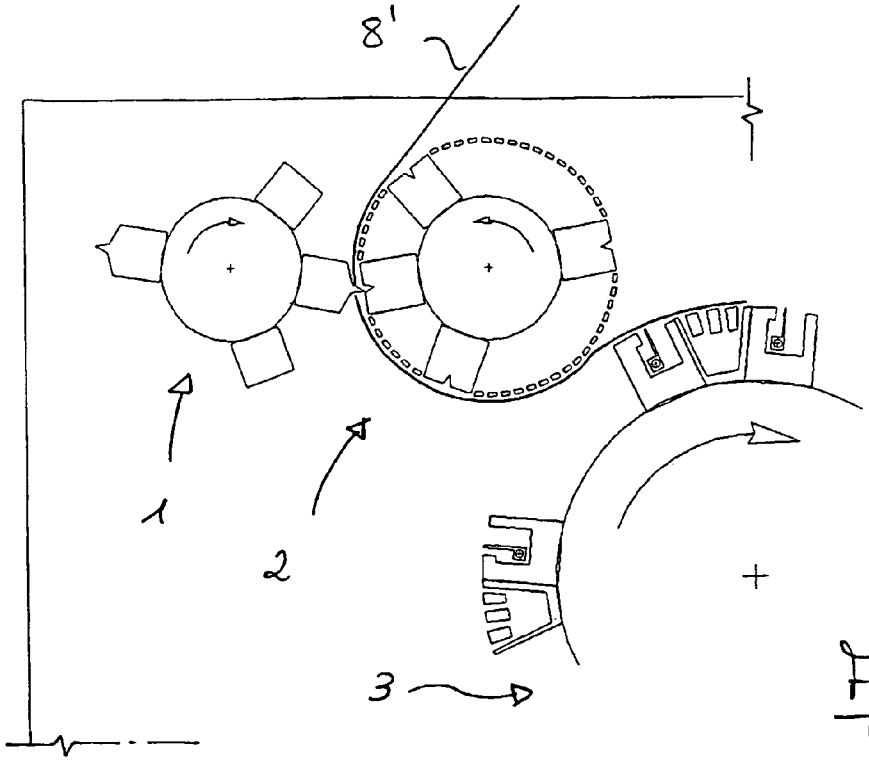
Figure 13:
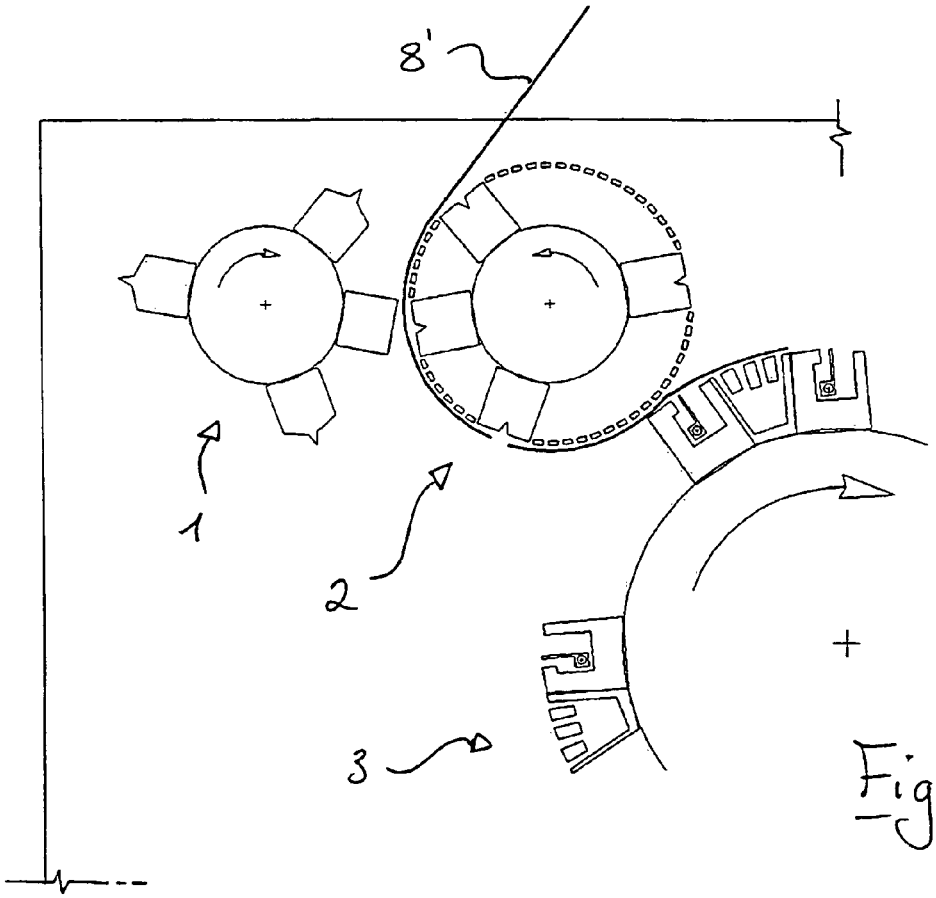

The item to be produced is selected on the control panel, whereby minimizing the mechanical changes. FIGS. 7 to 12 illustrate the configuration shown in FIG. 6, showing the rapidity in changing between four different products within the same configuration, which is the unique characteristic of the design.

It is sufficient to act on the quick change shears transversal blades, mounting only the necessary blades in order to change product and format. The combs that introduce the paper in the grippers can be rapidly dismantled for conveying the flat place mat without pinching it. The angular timing of the gripping cylinder must be slightly shifted to present the edge of the product on the suction box, or grippers. This operation is carried out by means of the touch screen and implements a totally original system for the angular timing of cylinders 2 and 3.

Figure 14:
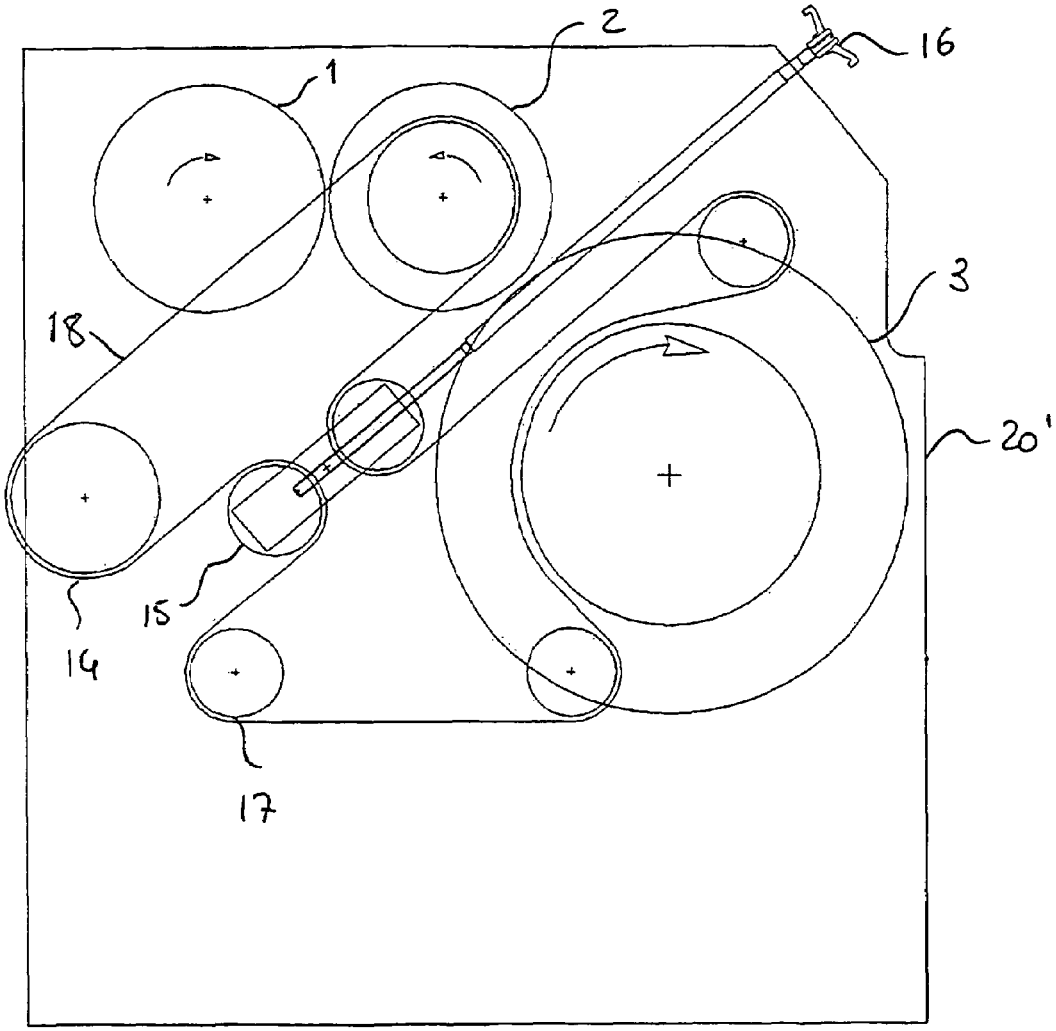

When switching from one item to another, the angular timing of the cylinders 2 and 3 must be changed, as shown in FIG. 14. This operation is required to present the grippers, or the suction boxes, in the correct position to take the product from cylinder 2 and pass it to cylinder 3.

In practice, FIG. 14 shows the main motor 14 of the machine 20 with encoder and axis control system, as well as a pair of pulleys 15, mobile on a precision runner, for timing the cylinders 2 and 3.

Attention is drawn to the presence of a screw device 16 for moving the pulley runner 15; this device 16 can be either manual or equipped with a servo motor to be controlled via the touch screen. There is also a set of transmission pulleys 17 to wrap the double toothed drive belt 18 on the cylinder 3. The double toothed drive belt 18 controls the entire machine 20. The cylinder 1 is driven by the gears driven in turn by the cylinder 2.

In practice, the double toothed drive belt 18 transmits the movement from the motor 14 to the cylinders 2 and 3. The length of the taut branch and the slack branch of the drive belt 18 is varied by moving the pair of pulleys 15 by means of the screw 16 along the runner of the pulleys. The length of the runner 15 permits angular timing of over 360°.

This device is also used to adjust the ¼ folding timing, for products such as napkins for dispenser. A perfectly similar toothed drive belt also controls the interchangeable ⅛ folding cartridge.

The production format is set on the control panel by means of the touch screen. This innovation is not implemented in other realizations which still employ a mechanical gear system or a geared pulley system for changing the format with the consequent disadvantages.

The possibility of changing the format by means of the touch screen is implemented as follows. The main drive 14 accelerates the rotation of the cylinders with respect to the reel unwinder so as to make the paper continuously slip on the cylinder 2, which is provided with suction through the holes on the external surface.

The length of the section of paper comprised between the two cuts of the transversal blades on the cylinder 1 is practically reduced by increasing the speed of the cylinders and keeping the speed of the incoming paper constant, thanks to the slipping mentioned above. Consequently, computing the transmission ratio needed to reduce the cutting length by acting on the axis control system of the main motor 14 and on the axis control system of the unwinder motor is simple. This transmission ratio is set by means of the touch screen.

The peripheral development of the cylinders 1 and 2 is equal to 960 mm. If the paper and the cylinders have the same relative speed without slipping, the cut between the two section will be exactly equal to 480 mm, when using the "30-48" kit with two 180° transversal blades. In the same kinematic conditions, the cut with be exactly 320 mm long using the "20-32" kit with three 120° transversal blades. The same cut with measure 240 mm with the "15-24" kit with four 90° blades.

It is obvious that the upper limit of the cutting length, valid for each format kit, cannot be changed and is equal to the external development of the circumference on the suction cylinder 2. The lower limit is established only by the capacity of the raw material of withstanding strong pulling without tearing, due to the friction on the suction cylinder 2, whose peripheral speed is much higher than that of the paper. A lower limit equal to approximately 60–70% of the maximum format measurements is usually used.

Figure 15:
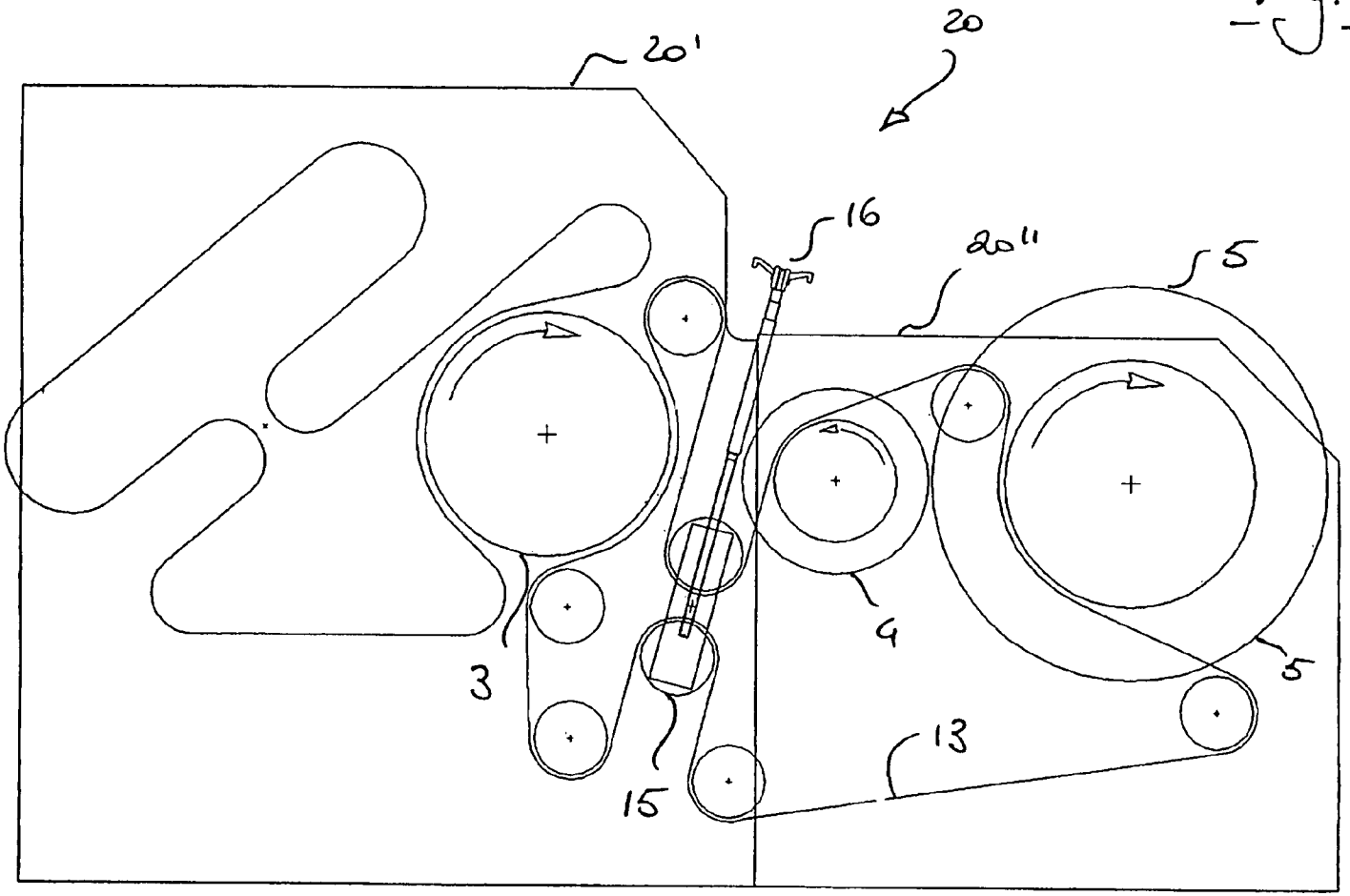

The method for adjusting the timing of the fold by means of the touch screen will now be described, with particular but not exclusive reference to FIG. 15. This folding timing is used very frequently for ¼ folded napkins and for ⅛ folded napkins, because in this way the napkins can be easily picked from a dispenser box.

By replacing the knob 16 with a stepper motor or with a brushless motor equipped with encoder and axis control system, the ¼ fold timing and the ⅛ fold timing can be set on the touch screen. Furthermore, the timing can be stored and recalled when needed, also in computerized form. This possibility exists for all the described rapid production change operations. This is because the mechanism we designed ensures an accurate ratio between the position of the timing carriage 15 and the reciprocal angular position of the cylinders 3 and 4. The same is true for cylinders 2 and 3.

The timing system illustrated herein offers a number of important advantages:

- Possibility of continuous angular timing by approximately 720°, suitable for all needs.
- Great simplicity, combining the movement transmission function and the angular timing function in a single system by means of a toothed drive belt.
- Elimination of costly epicyclical gears commonly used for timing, which are responsible for angular play, dissatisfying precision and subject to wear.
- We have eliminated all the gears, reduced noise and eliminated the need for lubrication by means of the toothed drive belt. No play in transmission, no mechanical wear, high torsional rigidity.
- Generously overdimensioned toothed drive belt for long maintenance-free operation.

Figure 16:
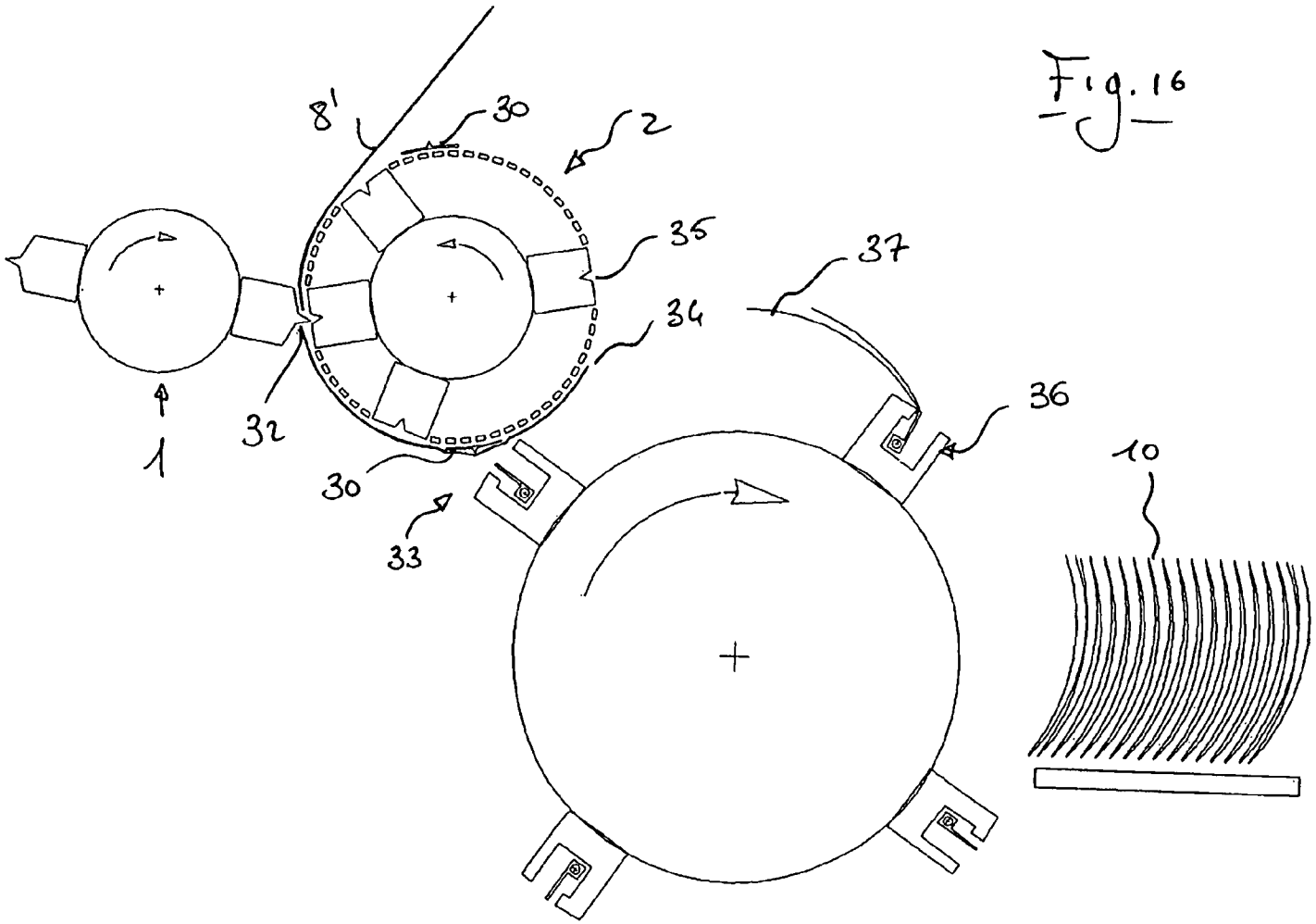
FIG. 16 shows an additional cross-sectional view of the machine according to the invention.

FIG. 16 shows the unit illustrated in FIG. 6 on a larger scale with two 180° blades ("30-48" format kit).

The comb 30 turns with the cylinder 2 and consequently is about to slide under the paper. The transversal blade 32 has just cut the paper and the comb-gripper 33 is about to grip the cut napkin. The previous gripper 36 has already carried out the gripping and folding operation and is about to place the napkin on the gathering table.

With reference to the previously described slipping, the edge 34 of the napkin is retracted from the cutting edge 35, as noted by the distance between the points referred to by numerals 34 and 35. This means that the selected format of this process (in this case, 40 cm format) is sensibly smaller than the maximum format equal to half of the development of the suction cylinder (48 cm format), consequently the transmission ratio is equal to 48/40=6/5, i.e. TR=1.2. The speed of the suction cylinder is thus equal to 1.2 times the speed of the paper.

With reference to the fold timing described above, it is noted that in FIG. 16 (point 33), the comb covered by the paper is not on the middle line with respect to the cut napkin, i.e. it is closer to point 34 than to point 32. This means that the gripping will produce a staggered fold, with reference to one of the types of product which can be obtained with the machine according to the invention as shown by staggering 37.

Consequently, to align the edges, eliminating the staggering 37, the two combs 30 must be turned by approximately 20° counterclockwise, changing their angular position on the suction cylinder 2. However, the centering must be kept with respect to the open grippers about to grip the paper, as shown in FIG. 16. In order to obtain this important result, the machine according to the invention comprises these exclusive characteristics: combs 30 mounted externally with respect to the perforated surface of the suction cylinder 2, free to turn on the cylinder 2 and to move, if required, from the cutting edge 32 to the opposite cutting edge 35. No other existing realization today offers this solution, which allows very wide angular timing.

A second innovative characteristic is given by the presence of combs fitted on toothed rings which are coaxial to the suction cylinder but free to turn on said cylinder. The toothed rings mesh similar toothed rings fitted on the gripping cylinder and consequently forming a solid part with the gripper. This solution ensures the perfect coupling between comb and gripper also during timing during production without limitations of any kind.

Figure 17:
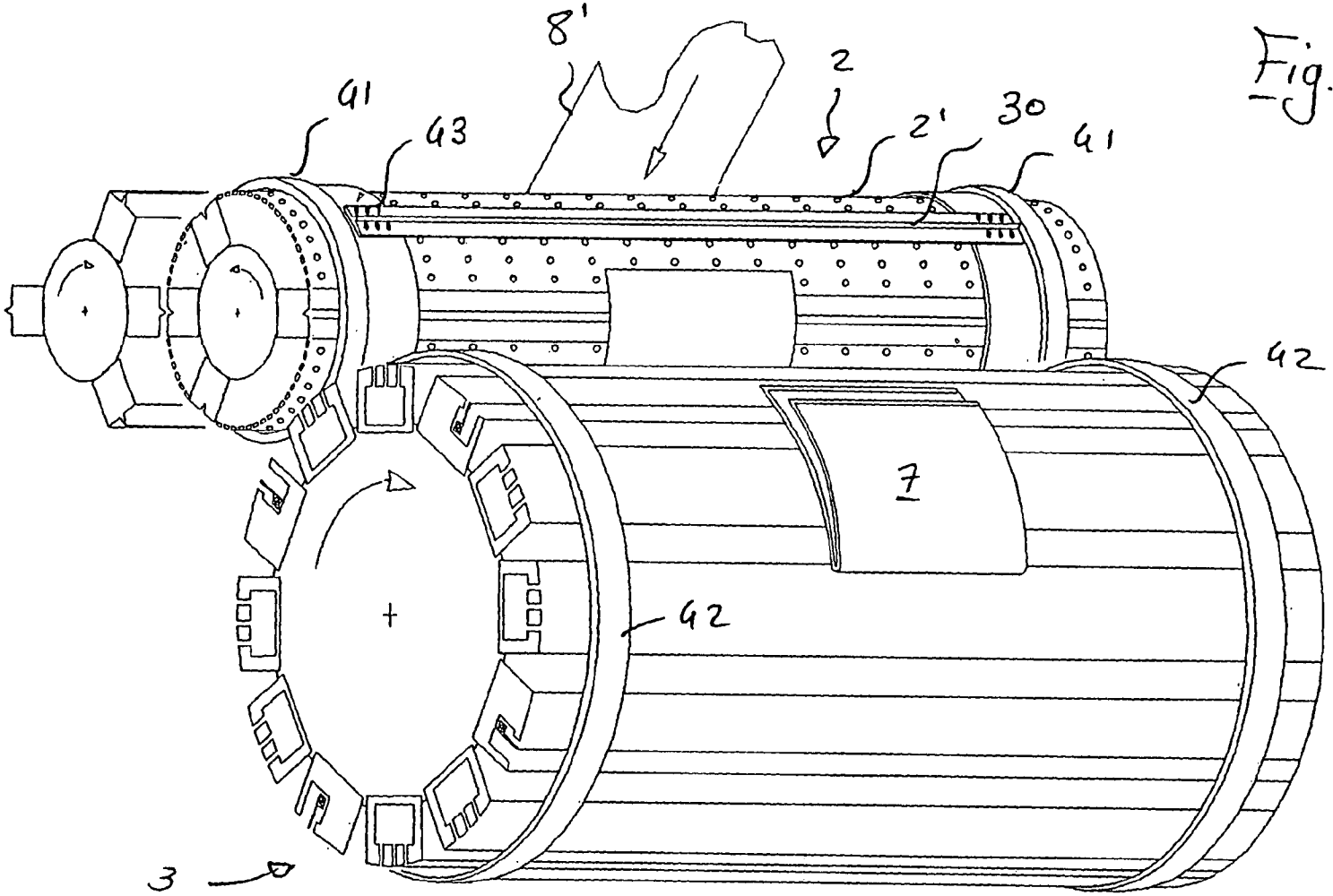
FIGS. 17 and 18 show a perspective view and a cross-sectional view illustrating the assembly of the combs on the rings which are coaxial to the suction cylinder, respectively.
Figure 18:
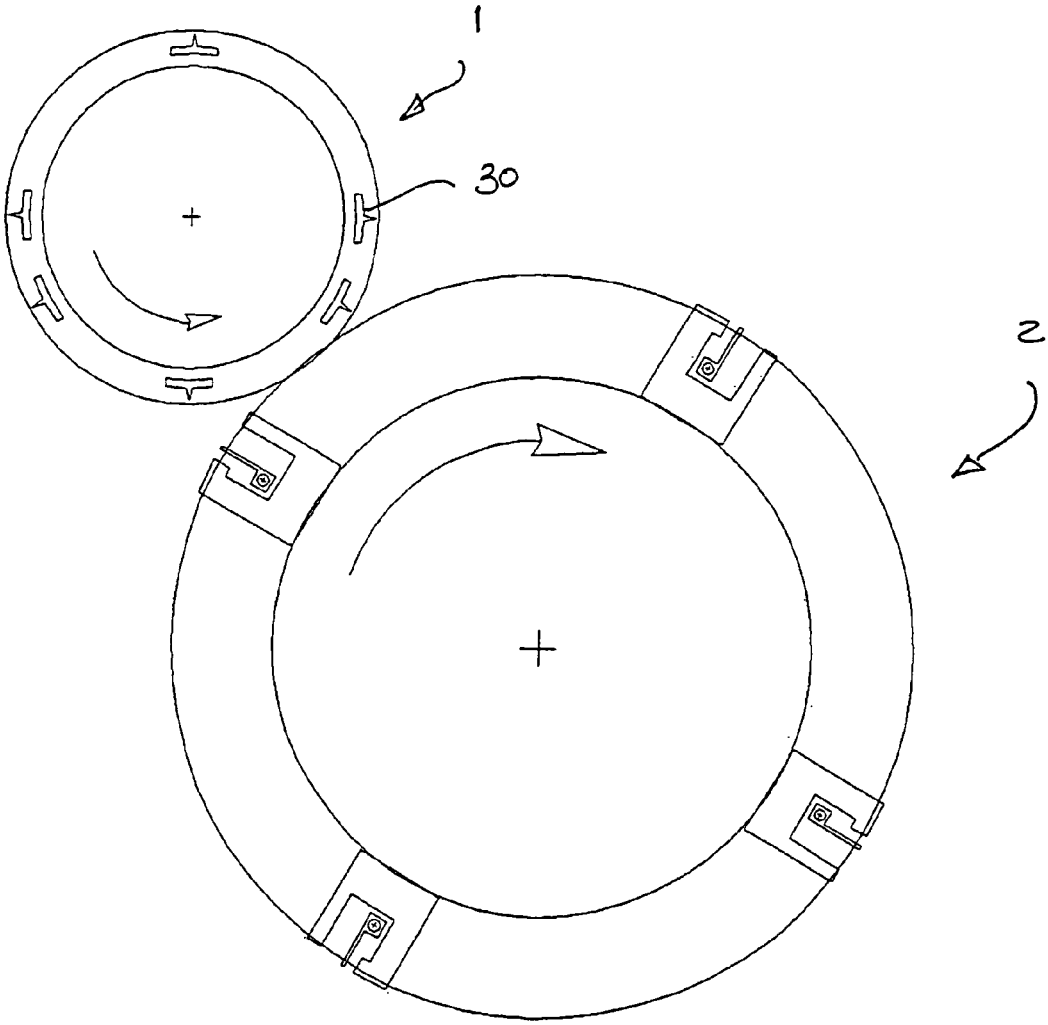

With reference to FIGS. 17 and 18, note that the presence of the toothed rings 41, mounted idly on the suction cylinder 2 for mounting the combs at either 90°, 120° or 180°, and the rings 42, solidly mounted on the gripping cylinder 3 for driving the combs so that they are timed with the grippers.

There are also combs 43, transversally mounted on rings 41, at either 90°, 120° or 180°.

Figure 23:
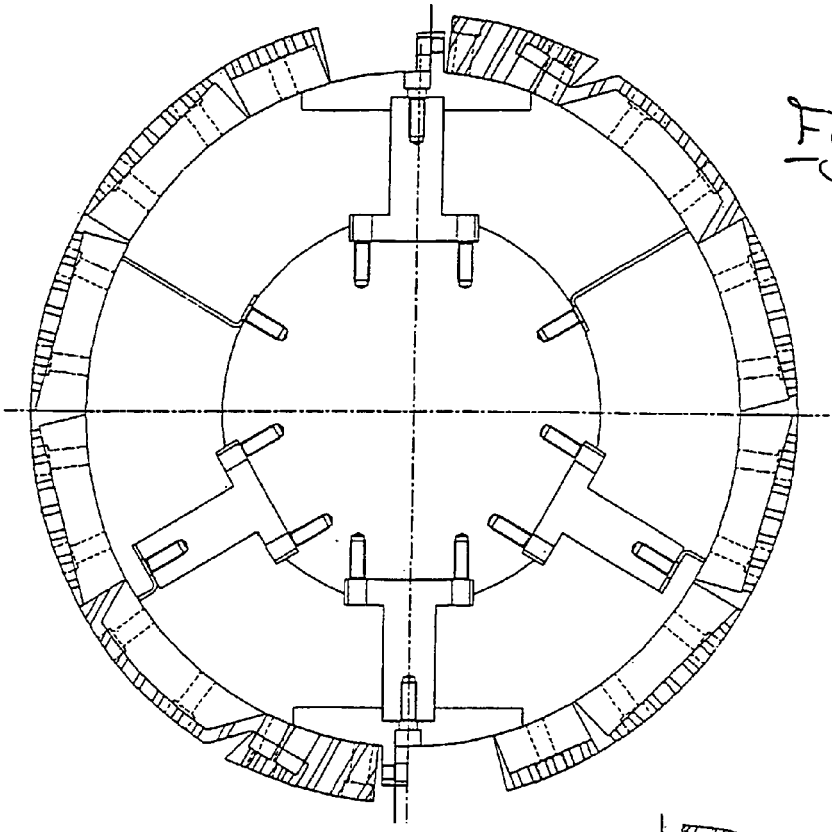

The two rings 41 coaxial to the suction cylinder 2 are mounted such as to be free to rotate, i.e. capable of varying the timing of the combs with respect to the transversal cutting edge. The two corresponding rings 42, coaxial with respect to the gripping cylinder 3, form a solid part with the cylinder 3. The rings 41 and 42 are both toothed and the teeth reciprocally mesh, as illustrated in FIG. 18. The combs 43 are transversally fastened on the two rings 41. As shown in FIG. 23, four housings are arranged at 90°, three housing are arranged at a 120° and two housings are arranged at 180°, according to needs.

Only the combs needed for the format kits described above need to be mounted at any one time, not all six, as shown in FIG. 18.

The combs are required to introduce the paper in the folding grippers and must all be removed for the production of flat place mats without transversal folds. This is obtained, for example, by means of screws.

Figure 19:
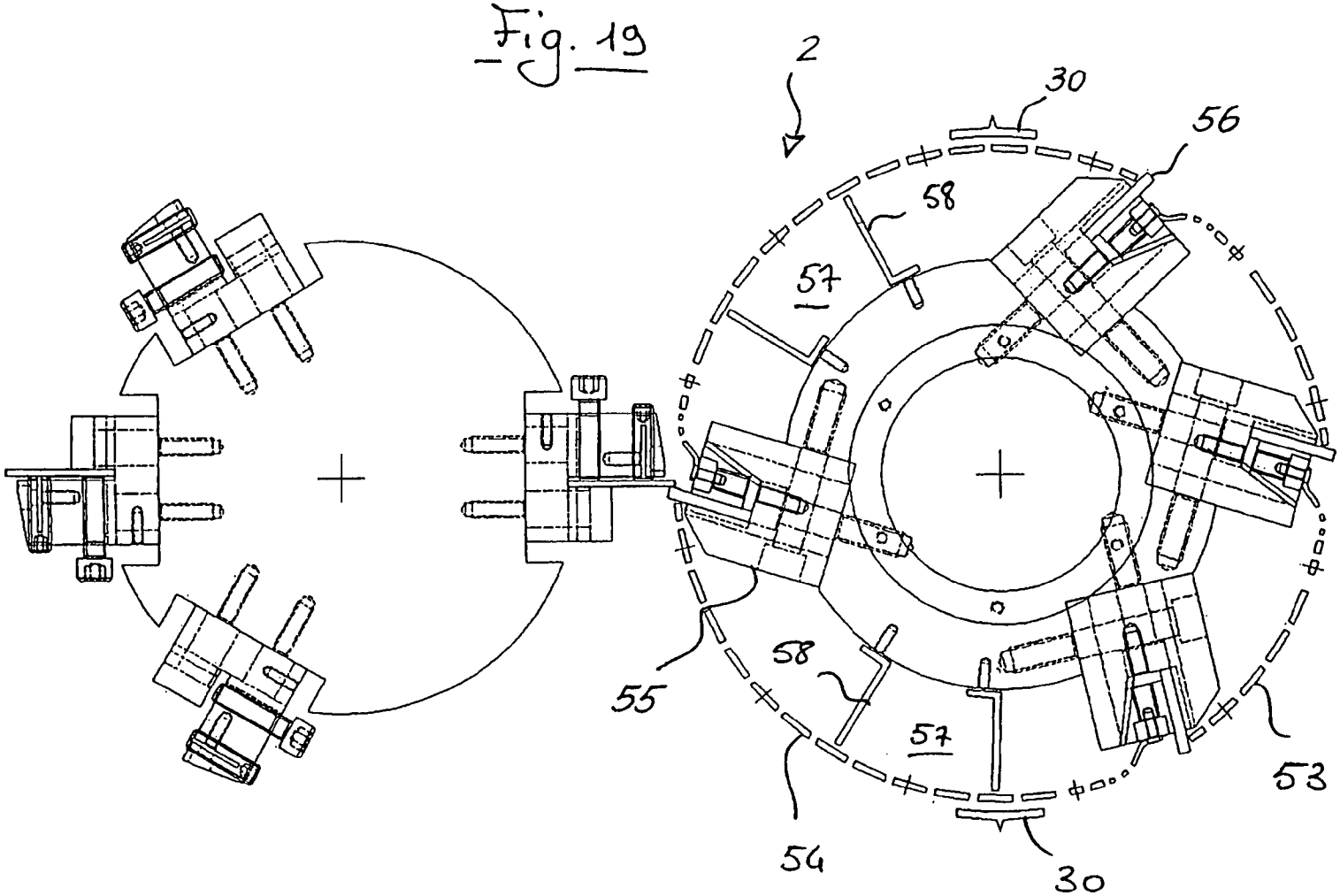
FIG. 19 shows the cutting cylinders and the suction cylinders with two different format kits fitted at the same time but used alternatively.

FIG. 19 shows the cutting cylinders and the suction cylinders with two different format kits mounted at the same time and used alternatively. As can be seen, the only difference when exchanging from one kit to another is the exchanged position of the blades on the cylinder 1. This exchange is extremely simple and rapid and is described in detail below. The suction cylinder 2 is not modified in the passage between the two configurations, except for shifting the external combs in the 2×180° housings or the 3×120° housings (FIG. 19 shows the 2×180° housings).

Here follows a brief description of the architecture of the suction cylinder 2 on the right of FIG. 19. The system is based on a central shaft which houses the blade holders 55 for counterblades 56. This solution offers considerable flexural rigidity, much better than in any previous realization. The space between the internal core of the cylinder and the external surface is delimited by the relatively wide suction sectors 53 and 54, which are 60° and 120° wide respectively and which are perforated for the passage of external air to the annular suction chamber 57. The annular chamber is subdivided into 30° sectors by partitions 58 to maximize efficiency of the lateral vacuum valves (not illustrated) and to accurately ensure the beginning and the end of the circumference arc which is subject to suction.

The considerable mechanical rigidity of the assembly comprising the cylinder 2 and the blade holder 55, combined with the large annular chamber 57 available for the suction flow, permit widening the machine in the transversal direction, over the 530 mm of working width of project 530 to 1060 mm, with possible subdivision on 2, 4, 6 and 8 production lines.

The cutting cylinder 1, adopting the transversal shear cutting system of the invention, is shown on the left side of the FIG. 19. The system will be described in detail below.

The rapid passage from the "20-32" kit to the "30-48" kit or from the "15-24" kit to the "30-48" kit, an exclusive concept of the invention, is extremely rapid and enormously extends the versatility of the machine. For example, the conservative solution we developed, described below with the combs fitted internally with respect to the suction cylinder, requires the adaptation of suction cylinder 2 and of the curved suction sectors 53 and 54, which are very large and complex, not only to pass from one format kit to another but also for simply adjusting the folding timing and for changing the format within the range offered by each format kit.

Figure 20:
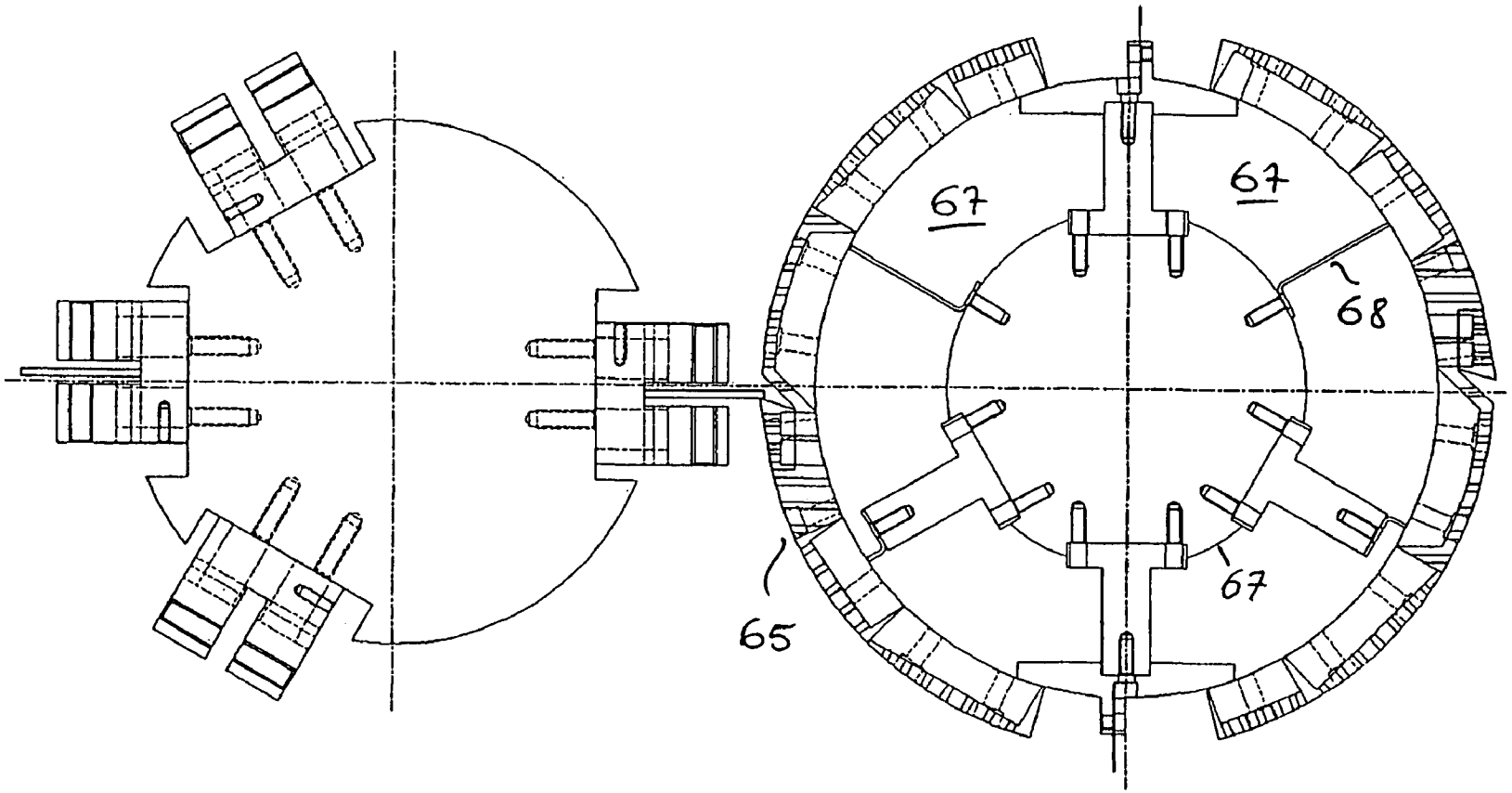
FIG. 20 shows the cutting and suction cylinders in another embodiment of the invention.

An alternative solution, illustrated in FIG. 20, can be adopted in relation the destination of use of the machine. In this figure, the toothed rings 61 are idly mounted on the suction cylinder, for 90° or 120° or 180° comb mounting configurations, and the rings 63 are solidly mounted on the gripping cylinder for driving the combs in time with the grippers. The combs 64 are also shown, which are mounted transversally on the rings 61, in a position either at 90°, 120° or 180°.

The gripping cylinder is responsible for driving the pairs of rings 61 and 62, while the suction and transversal cutting cylinder, over which the rings 61 are idly mounted, is responsible for driving the transversal grippers, whose timing with respect to the grippers 63 is guaranteed by the toothed synchronizer rings 61 and 62.

This "internal comb" configuration offers a lower projection of the combs from the surface of the suction cylinder. This characteristic can be useful also for the production of extremely delicate raw materials because it greatly reduces the rubbing of the combs on the paper, as illustrated above and in the following notes, which describe the slipping of the paper on the suction cylinder for varying the cutting format. Furthermore, the internal assembly of the combs can be advantageous when processing high printed quality decorative paper, because of the minimum rubbing on the decorated surface.

The internal cylinder 67 must be able to turn with respect to the suction sector 65 to allow timing of transversal folding. In order to obtain this essential characteristic, the counterblade 61 and the perforated sector 65 must be fitted on removable lateral flanges, capable of turning on the axis 67; this solution reduces the rigidity of the assembly and cannot be advantageously used to widths exceeding 530 mm.

This notwithstanding, an annular chamber 612 has been added instead of using narrow coaxial suction ducts having Ø 50 or Ø 70 along with the concept of the internally mounted 3×120° or 2×180° combs. The exchange between the two format kits is always possible and necessarily also involves the suction cylinder, when—in the original solution described above—the change does not require modifications to the suction cylinder. Finally, 60° partitions 68 have been added to subdivide the internal volume and increase the efficiency and the accuracy of vacuum distribution with respect to the solutions developed some years ago mainly by German designers.

FIGS. 21 and 22 show the suction cylinder disassembled in the left of FIG. 21, illustrating the internal core supporting the combs and highlighting how it is possible to use the two 3×120° and 2×180° kits. FIG. 22 shows the assembly of the suction sectors leaving a gap for staggering 66' which highlights the lower flexibility of this solution. For larger staggering, and for changes in format, the sector 66 must be moved from the left to the right over the gap of the comb, and so forth on the adjacent sectors.

The sector 65 on which the counterblade is mounted cannot ensure the same rigidity to dynamic shearing stress offered by the external comb solution.

Finally, the suction capacity near the combs is canceled due to the seal formed by the supports of the combs 69.

Figure 24:
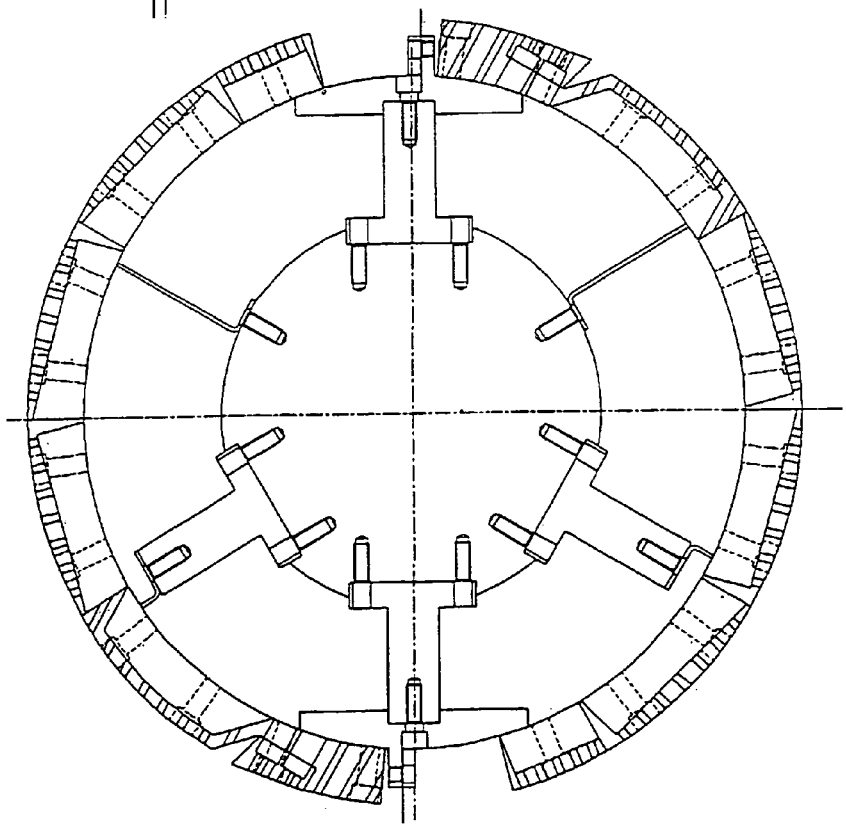

FIGS. 23 and 24 show the adaptation required to change the combs, passing from a 3×120° kit to a 2×180° kit.

Concluding, despite the mechanical complexity, the internal comb design ensures less possible projection of the combs with respect to the suction surface.

We will now focus on the concept of combs with lateral prong located external with respect to the gripper. This new concept concerns a detail in the comb-gripper system which is important to offer important improvements in the functionality and the efficiency of the system. For greater clarity, we will refer to the solution presented above, illustrating how the comb is constantly "held by the gripper" along with the paper and must be extracted as the cylinder rotation continues. This "extraction" causes a slight flexion of the combs and generates a mechanical stress sufficient to reduce duration in time. The pressure of the gripper on the combs determines a considerable wear of the combs for friction. This shortcoming appear in machines other than that of the invention, all of which adopt the concept of holding the comb along with the paper during the gripping operation.

Figure 25:
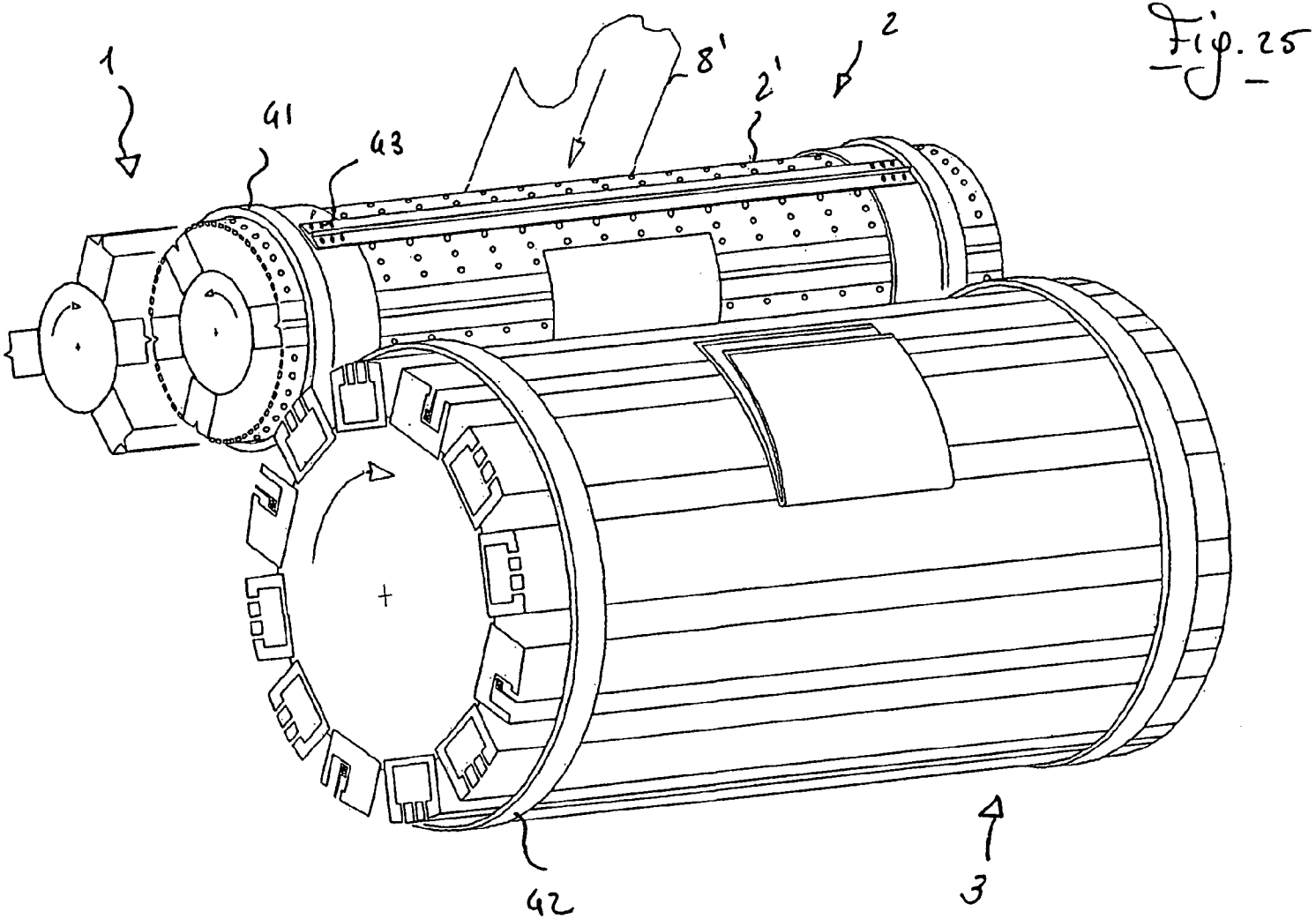
FIG. 25 shows an enlargement of FIG. 17.

FIG. 25 shows an enlargement of FIG. 17 and illustrates the solution with external comb formed on a transversal bar 44, which in turn is mounted on the toothed rings 41 by means of screws 43. The illustrated comb, comprising a continuous edge, is gripped with the paper by the gripper 45 during the gripping operation which produces the transversal fold.

Figure 26:
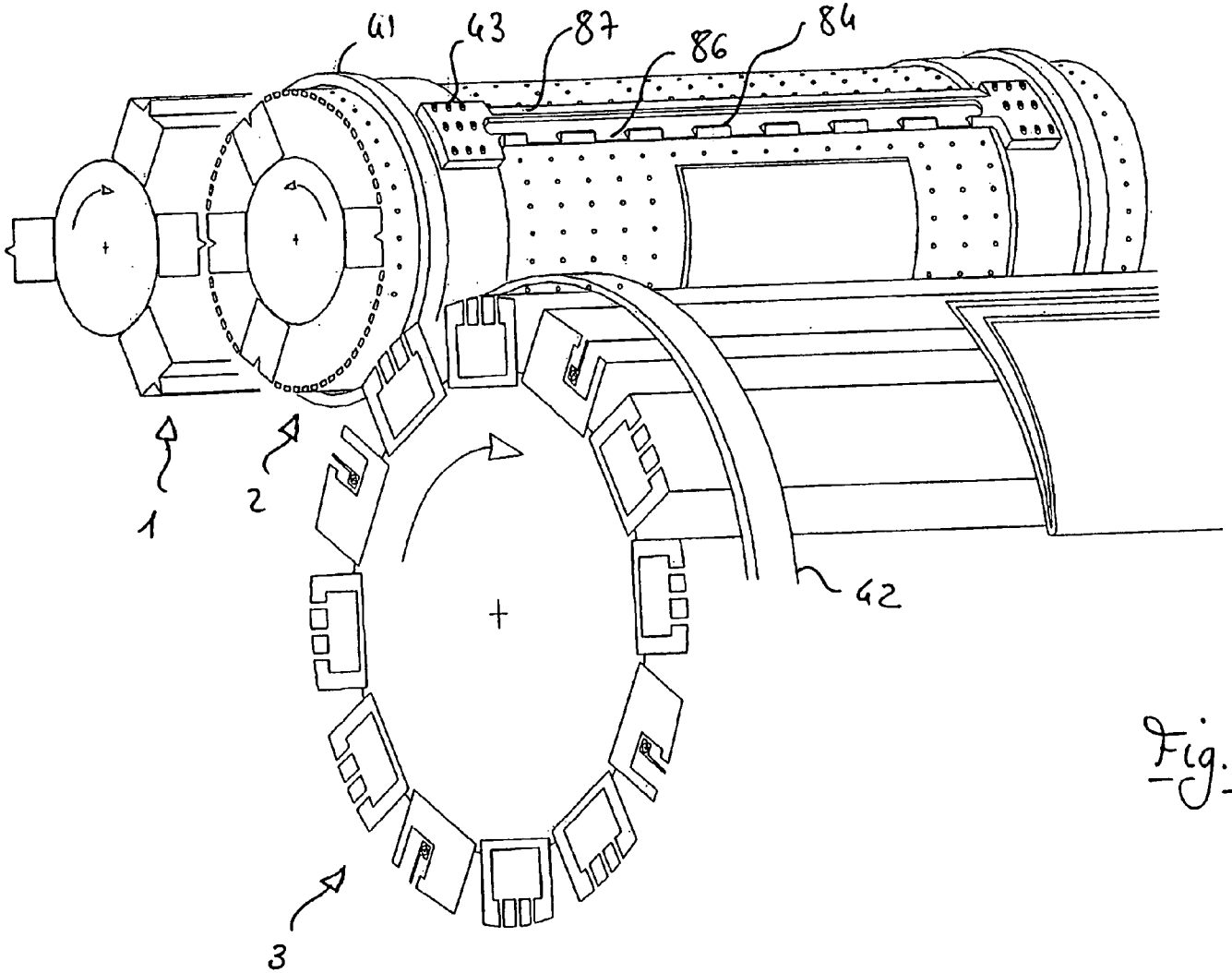
FIG. 26 shows an additional embodiment of the assembly of combs on the rings which are coaxial to the suction cylinder.

Already this basic solution, which is entirely original both for the design of the comb 44 and for the assembly system 43 of the rings 41, is the object of the invention. An additional innovative solution will be illustrated below. In this solution, a comb, as appears in FIG. 26, presents an edge 84 which is interrupted to prevent being grasped by the grippers.

Furthermore, the transversal bar on which the comb is made is effectively jointed to the perforated surface of the cylinder, thanks to the tapered edge 87. This reduces rubbing of the comb on the paper described above, i.e. the comb is shielded from the paper by means of the smooth surface of 87. Reducing this rubbing will improve production quality.

The paper is gripped since it is tensioned between the upper edges of the projections forming the comb, but the grippers are reciprocally distanced and positioned in the gaps 86 of the comb, ensuring a nearly unlimited duration of the comb and a lower stress on the cam and on the bearing which operates the grippers.

Figure 27:
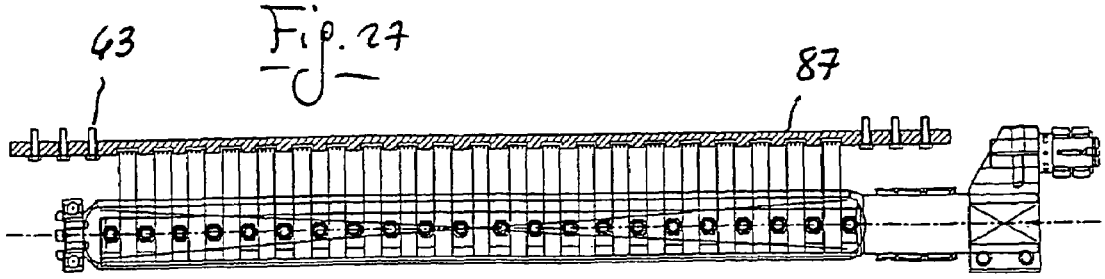
Figure 28:
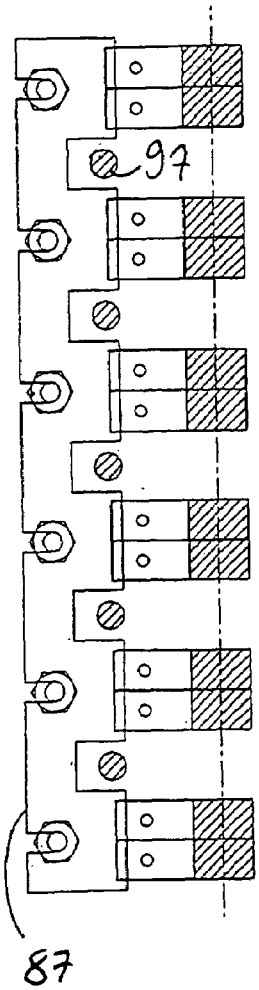
FIG. 28 illustrates a similar detail with reference to the known art.

FIG. 27 illustrates a detail of the machine according to the invention, while FIG. 28 illustrates the same part with reference to known art for highlighting an important difference between the concept of the invention and other known designs. Also in other realizations, the edge of the gripping comb is interrupted, but not for the original reason, i.e. not to prevent the grippers from clamping the comb. As illustrated in the figure, the recess 97 is required to house the product ejection teeth, which in the design are positioned elsewhere. Conversely, in the known realizations the combs were gripped along with the paper.

Another important point in favor of the machine according to the invention, shown in FIGS. 27 and 28, is the larger working gripping width, equal to 530 mm, which is nearly double that of other realizations.

This characteristic is joined to a very narrow and close arrangement of a high number of grippers. This combination of characteristics was studied to offer the possibility of working on a number of parallel production lines which can vary from one to four, dividing the working width of 530 mm into several contiguous segments.

Furthermore, an innovative ejection system of the products implementing an orbital mechanism is implemented.

Figure 30:
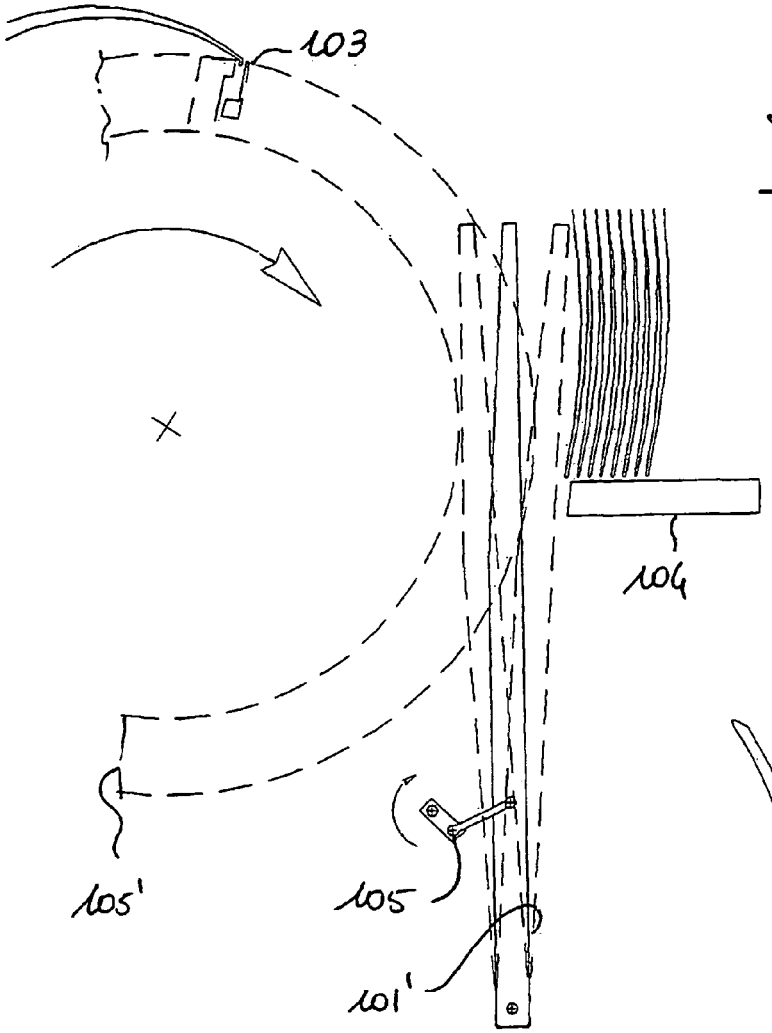
FIG. 30 illustrates a similar detail with reference to the known art.

This innovation was studied to permit a considerable increase in production speed, whereby solving the problems described with reference to FIG. 30 which limit the speed.

Figure 29:
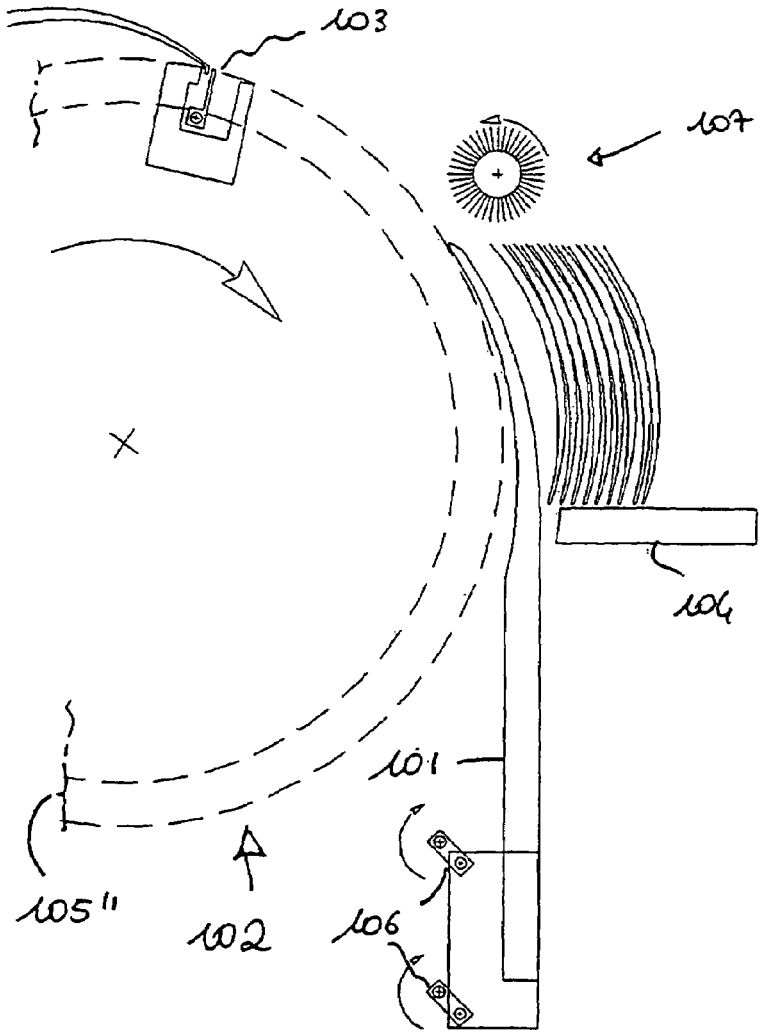

With initial reference to FIG. 29, reference numbers 101 and 101' respectively indicate the combs for ejecting the product from the grippers to the output table, reference numeral 102 indicates the edge of the gripping cylinder and reference numeral 103 indicates the gripper with the next incoming napkin. Furthermore, reference numeral 104 indicates the manual gathering table (which can be replaced by the conveyor) and reference numeral 105 indicates the connecting rod-crank mechanism for controlling the teeth in the known art, while reference numeral 106 indicates the double eccentric for orbital tooth control according to the invention and reference numeral 107 indicates the rotating brush for stopping the upper edge of the napkins. FIG. 30 shows the most common system for controlling the ejector teeth by means of connecting rod-crank mechanism 105, which impresses a purely alternating movement to the comb 101', pivoting on the bottom. At speeds close to the limit of 900 napkins per minute, the inertia of comb 101' causes repeated elastic deflections, with consequent knocking on the gathering table 104 and on the bottom of the recess in the cylinder, indicated by reference numeral 105".

The invention introduces an absolute novelty represented by the orbital movement impressed to the ejector teeth, which considerably reduces the stress due to inertia to obtain higher speeds, over the limit of 900 napkins per minutes. Furthermore, the shape of the tooth is optimized to obtain the advantages indicated below.

Another advantage is given by the napkin braking effect while it is stopped on the gathering table 104 after the gripper 103 opened and released it. The high speed at which the napkin impacts the gathering table can cause a permanent marking which may damage appearance.

Figure 31:
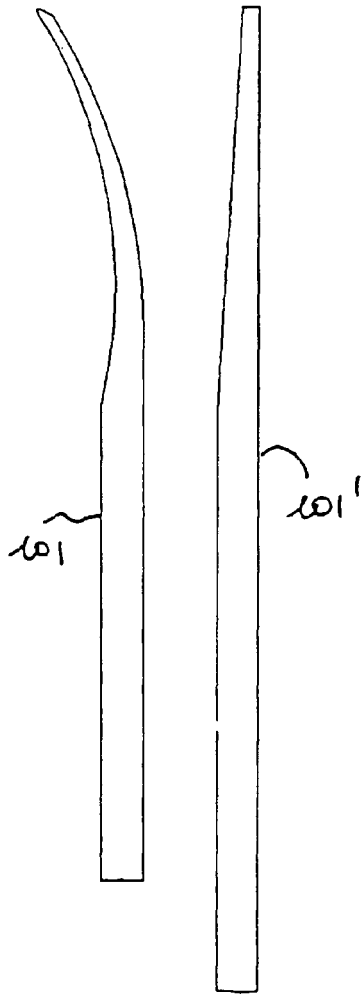
FIG. 31 is provided to compare a detail of the invention with commonly used solution.

FIG. 31 compares the curved comb 101, specific of the invention, and that commonly used 101' (which is straight) and highlights the study conducted to optimize the curvature and reduce the weight. The upper curved surface facilitates ejection of the napkin, taking it near the rotating brush 107. Furthermore, it considerably reduces the depth of the groove needed to house the comb in the folding cylinder, in the position shown in FIG. 32. The reduction of depth appears evidently by comparing the two FIGS. 29 and 30 and is indicated by reference numerals 105' and 105".

The orbital movement causes a downward descent phase in which the tooth accompanies the napkin down. The tooth in this phase has a much slower speed, favoring braking of the napkin and making it stop softly on the gathering table 104. This effect is entirely missing in the common teeth connecting rod-crank system and is consequently an exclusive of the invention.

Figure 33:
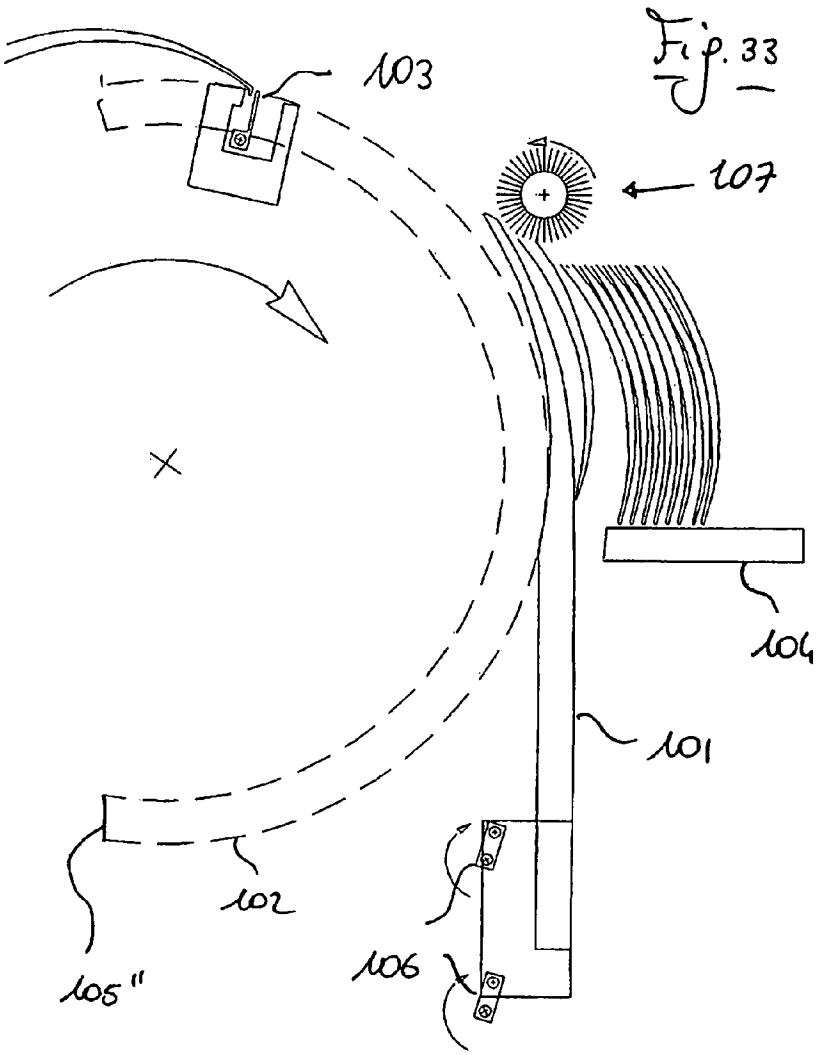
FIGS. 32 to 34 illustrate an operating sequence of the ejection system in the machine according to the invention.
Figure 32:
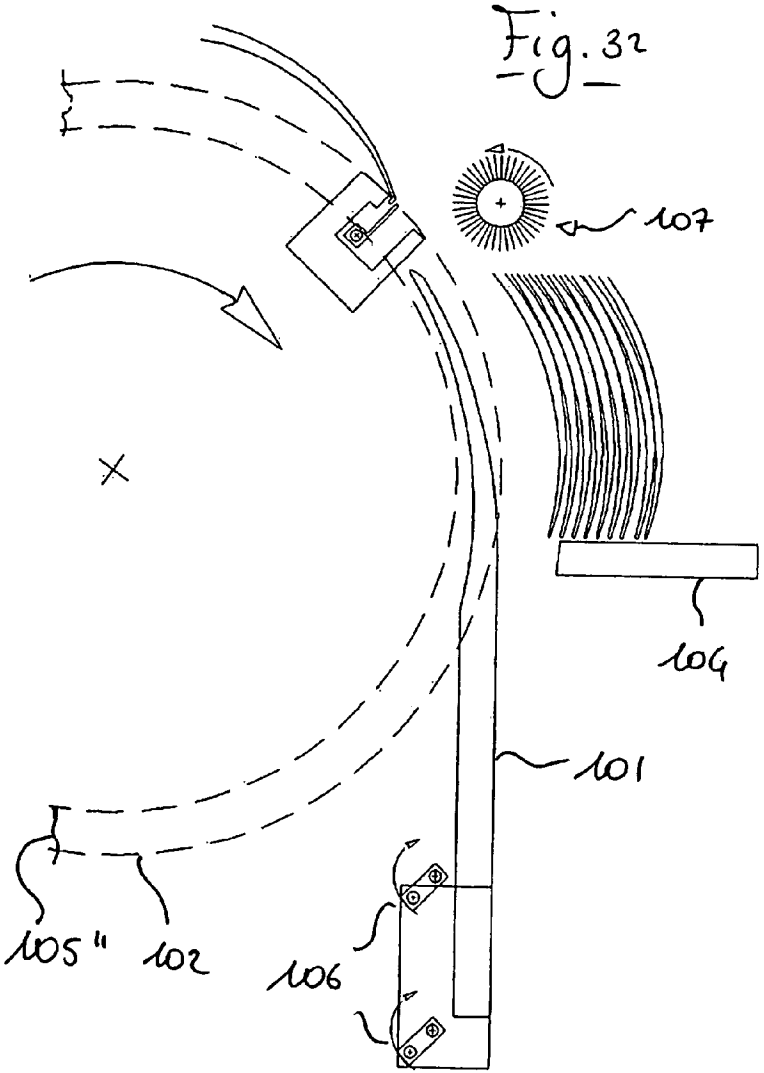
Figure 34:
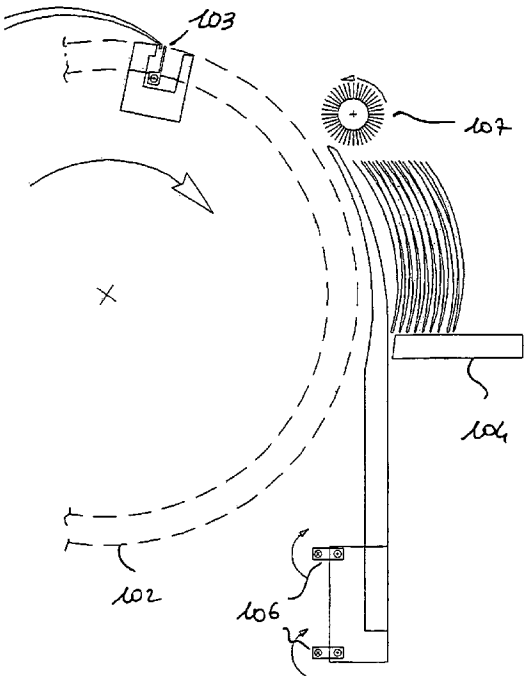

The reduction of inertial stress is obtained by means of the orbital movement, for three main reasons, which evidently appear in the comparison of FIG. 31 and the kinematic sequence in FIGS. 32 to 34.

Firstly, there are no dead centers: the movement is constant at all times, without acceleration.

The stress causes traction and compression, in addition to flexion, in the direction of the stem of the tooth. This stress is much better withstood without deformation.

The shape of the tooth—shorter and tapered in the upper part—considerably reduces weight, especially in the point further from the fasteners, where it is less rigid.

Gripping is obtained by pressing the gripper against the gripping anvil. This pressure is exerted by means of a flexion stressed elastic element (flexible laminar gripper) or by means of a flexible element (rigid gripper) pressed against the anvil by means of a coil spring 119. The invention comprises a combination of both and also in this case this solution is an innovation as described below. The movement of the gripper is obtained by means of a cam with a bearing fitted on a lever which is solidly fastened to the grippers.

Figure 35:
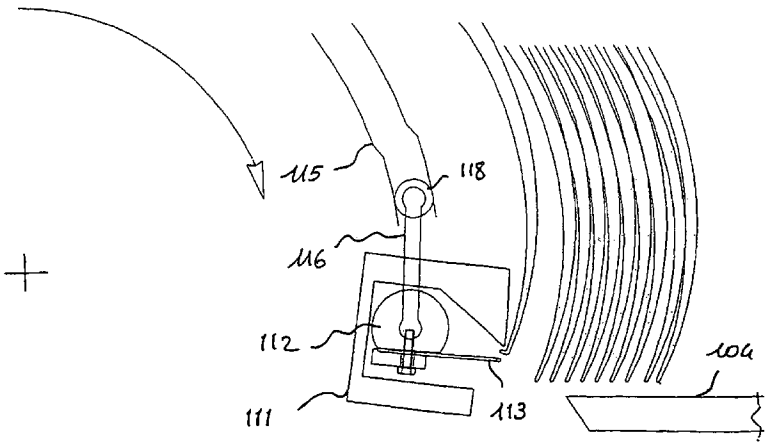
FIGS. 35 and 36 illustrate additional details related to ejection systems in known machines.

FIG. 35 shows the gripping supporting cradle 111, the gripper holder shaft 112, and the gripper 113 in open position. The gripper anvil 114, the upper gripper cam 115, the lever 116 with gripper control roller 118 and the accumulation of product on the gathering table 104 after the grippers open also appears.

FIG. 35 shows the gripping system with flexible laminar gripper, commonly found in German designs. According to this concept, the gripper is pressed against the anvil 114 by the cam 115 by means of the gripper holder shaft mechanism 112 with the lever 116 and the roller 118. In this case, the cam presses the grippers 113 against the anvil during the closing phase in which the paper is gripped by the grippers. In this phase, the gripper 113 bends slightly, being made of a tempered steel reed. After the cam 115 commands the opening of the grippers 113, the grippers are "straightened" and the system cancels all the loads transmitted by the roller 118. No loads are applied to the cam 115 during the stroke in vertical position.

Figure 36:
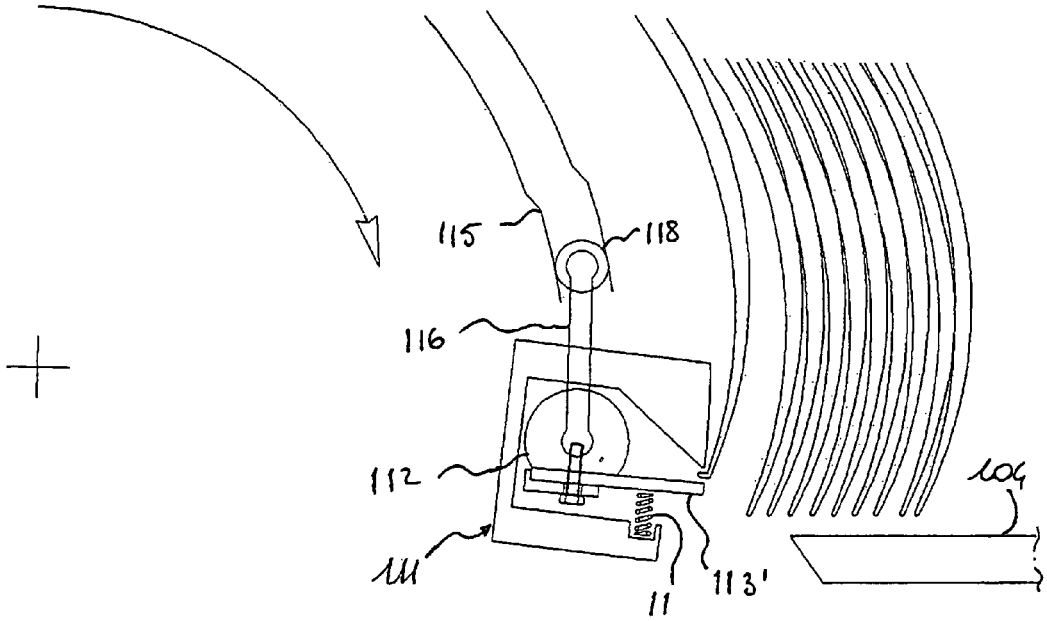

Conversely, the system implementing a stiff gripper and coil spring 119 illustrated in FIG. 36 and belonging to the known art, applies the loads in the opposite way: the spring 119 is stressed when the grippers are opened and is released during closure. Unlike the solution in FIG. 35, the entire load of the spring 119 is supported by the roller 118 during the open position stroke.

The roller 118 is subjected to a high load in both of the illustrated solutions, but only for a portion of its travel. These two solutions are currently used by all the manufacturers of folding machines.

Figure 37:
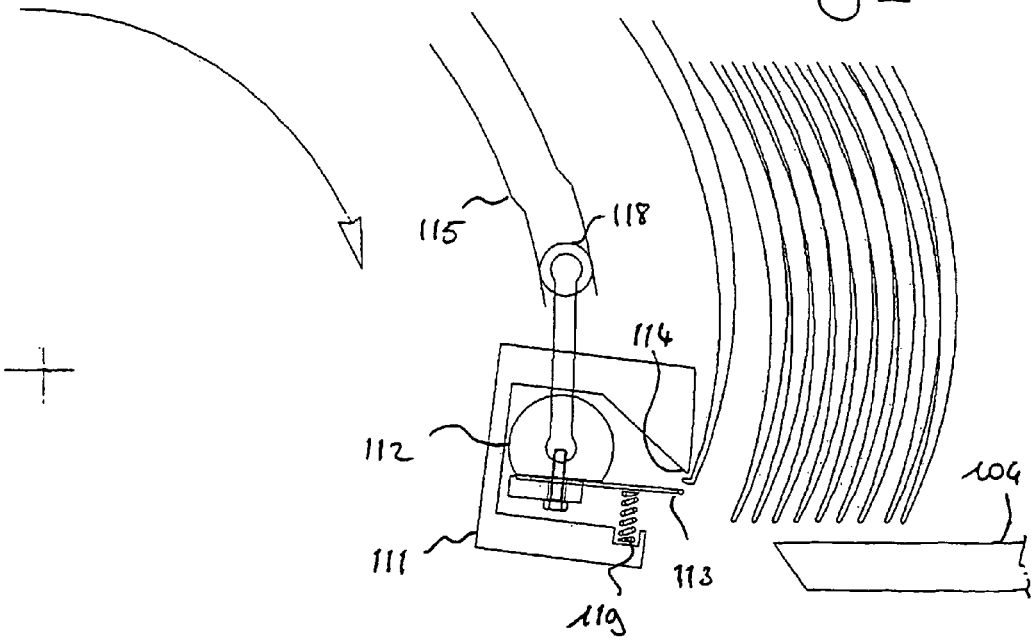
FIGS. 37 and 38 illustrate details related to the ejection system of the machine according to the invention.
Figure 38:
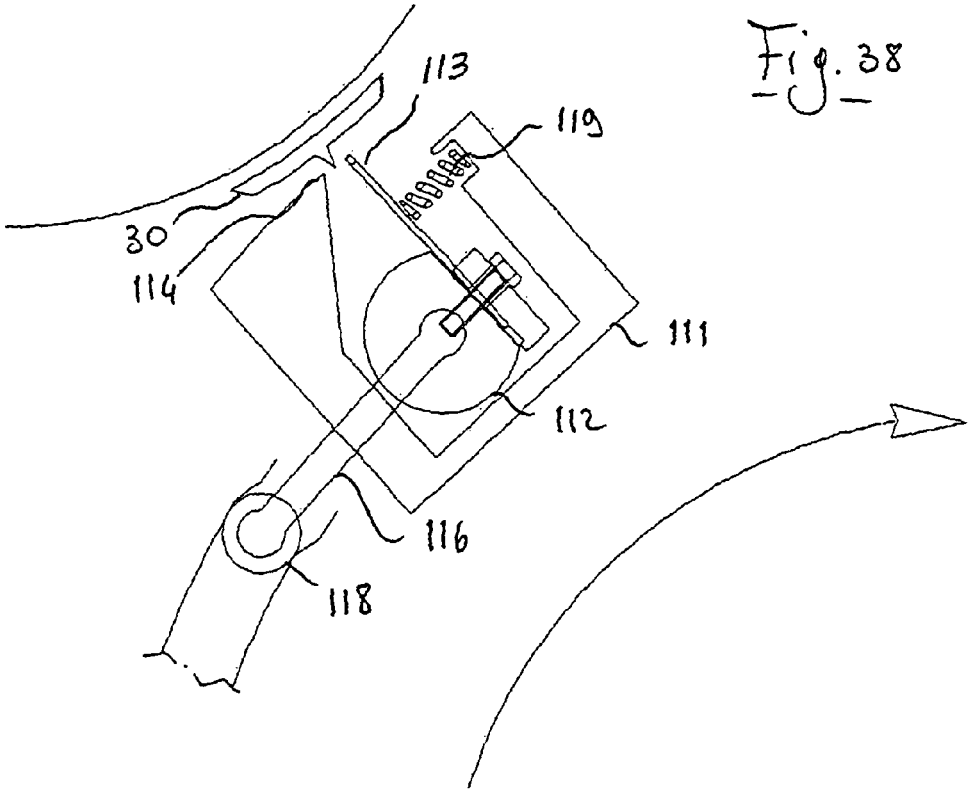

FIGS. 37 and 38 illustrate details related to the ejection system of the machine according to the invention. In particular, FIG. 37 shows the machine during gripper opening and FIG. 38 shows the same machine during gripper closure.

The machine according to the invention works by combining both solutions, whereby obtaining the result of halving the total load on the roller 118, leaving the load applied in one direction during the opening phase and in the opposite direction during the closing phase. Consequently, the life span of the roller 118 can be extended, as illustrated in FIG. 37.

The cam 115 closes the gripping system, deforming the laminar gripper and applying a flexural load equal to approximately half of the solution in FIG. 35. This is because one part of the load needed to grip the paper is provided by the coil springs 119, in FIG. 37, which are considerably weaker than the springs in FIG. 36 and apply a load which is approximately halved.

During the opening phase, the roller must overcome the springs 119 shown in FIG. 37, considerably weaker that those shown in FIG. 36, consequently the roller 118 withstands a load which is equal to only 50%.

In the solution in FIGS. 37 and 38, the total load on the roller 118 is equal to approximately 50% of the load obtained with the solutions in FIG. 35 or FIG. 36. Furthermore, the load is applied in a direction during opening and in the opposite direction during closing. For this reason, the roller 118 is much less stressed.

Also the laminar grippers 113 are less stressed, because the load is lower and because the movement is alternating in the two directions. The grippers 113 consequently loose the tendency to yield, i.e. to assume a permanent set by effect of the high loads constantly operating in the same direction. The yielding is a serious shortcoming, common to the manufacturers adopting the solution in FIG. 35, which forces the replacement of the grippers 113 after every 1500–2000 hours of work. This problem is totally eliminated by "combined" gripping solution schematically described in FIGS. 37 and 38.

Figure 39:
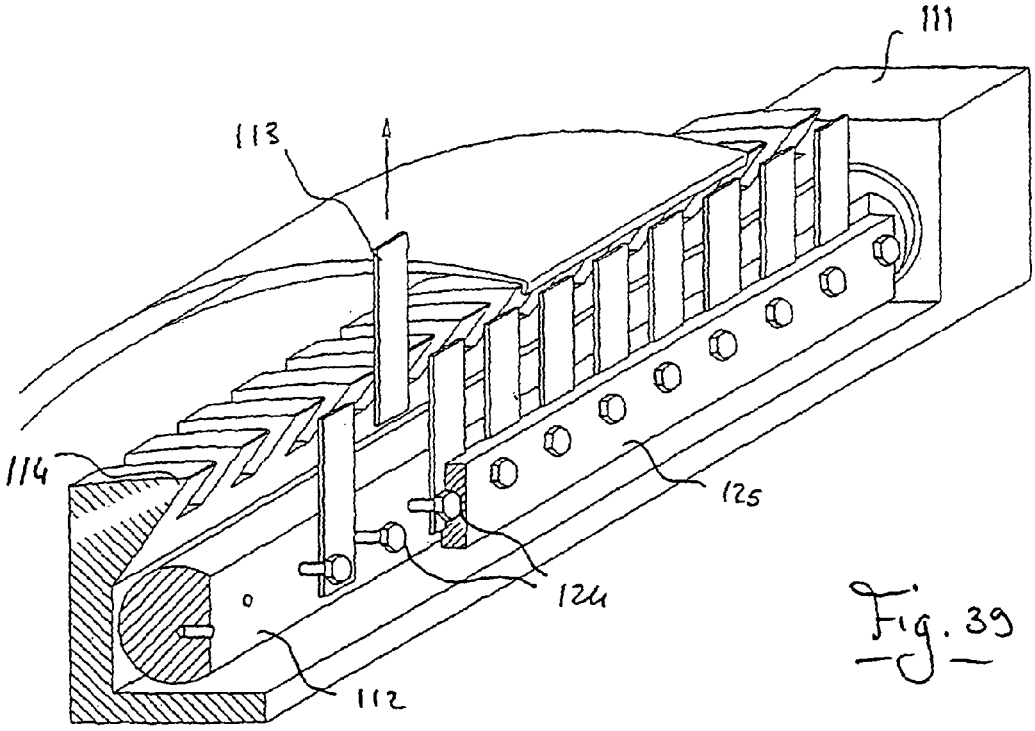
FIG. 39 illustrates in perspective a detail of the laminar grippers change system in the machine according to the invention.

FIG. 39 illustrates a perspective view of a detail of the change system for the laminar gripper 113 of the machine according to the invention. The assembly of the laminar grippers 113 allows a rapid change of the grippers 113 by means of screws applied to the grippers 113, to replace them without needing to remove the entire gripper holder shaft 112. However, the machine according to the invention implements a system which is more rapid and faster, even if the need to change the grippers frequently has been overcome by the lower yield to which they are subjected.

The rapid change system is illustrated in FIG. 28, showing a complete gripper holder shaft with all grippers fitted, and in FIG. 39, showing a perspective view of an exploded assembly.

Briefly, the rapid change is obtained by removing the gripper 113 fastened between the jaw 125 and the gripper holder shaft 112. By loosening the two contiguous screws 124 on the upper jaw 125, the gripper 113 can be easily removed upwards, also individually, while the other grippers remain fastened. The system permits easy intervention, also in the gap between the gripping anvil 114 and the edge of the gripper supporting cradle 111.

The grippers 113 are rectangular steel plates made of tempered steel for springs, whose shape is simple and symmetric. They can be turned if worn, presenting several edges suitable for gripping the napkin.

The cutting system comprises the following innovative characteristics: possibility of rapid change of worn blades, without adjusting the cutting pressure or by requiring minimum adjustments. The blades have four cutting edges and can be turned four times before being replaced.

A similar quick change option is provided for the transversal shear cut counterblades, without requiring adjustments. These are also equipped with two or four cutting edges, according to the adopted rake angles. An additional innovative characteristic is the operation of from one to four parallel production lines according to the various blade assembly configurations.

The working width of 530 mm can be subdivided in various cutting configurations: a 520 mm blade, two 259 mm blades, three 172 mm blades, four 129 mm blades.

FIG. 40 is an enlargement of FIG. 19 and illustrates in detail the concept used for rapidly changing the transversal cut blades and counterblades.

In detail, the FIG. 40 shows the transversal shear cut blade holder 141, as well as the transversal shear cut blade 142 and the blade fastening screw 143. It also includes a dowel screw 144 for adjusting the cutting pressure, the blade holder 55 for the transversal cut counter blade 56 and the fastening wedge 148 of the counterblade 56.

The blade holder 141 fastens the blade 142 by means of the screws 143. The cutting pressure is adjusted by means of the dowel screws 144. When the cutting edge is worn, the screws 143 can be loosened and the blade 142 can be turned, thus presenting a new cutting edge. This operation does not alter the cutting setting because the pressure was not altered by means of the dowel screw 144.

The counterblade 56 is not subject to settings. The fastening is obtained by means of the wedge 148 on the blade holder 55. The blade holder 55 is fastened directly to the anvil and suction cylinder. This assembly permits efficient, extremely rigid fastening, ensuring excellent repeatability of assembly position whenever the counterblade is changed.

This essential requirement is exclusive to the invention. By turning the counterblade when worn, the new cutting edge will be in the same position as the previous edge, whereby ensuring rapid restarting of the machine, with no or minimum cutting adjustments, by means of dowel screw 144. The illustrated blade and counterblade assembly solution is capable of offering this advanced performance.

FIG. 41 illustrates a particular type of counterblade 147', which is different from type 56. The difference consists in a positive rack on the cutting edge allowing more convenient cutting of some special materials.

This characteristic implements a "rhomboid" cross-section of the counterblade, which offers only two interchangeable edges instead of four edges offered by the "rectangular" configuration 141. The machine user can choose which of the two types is most convenient in relation to the material to be cut.

Figure 42:
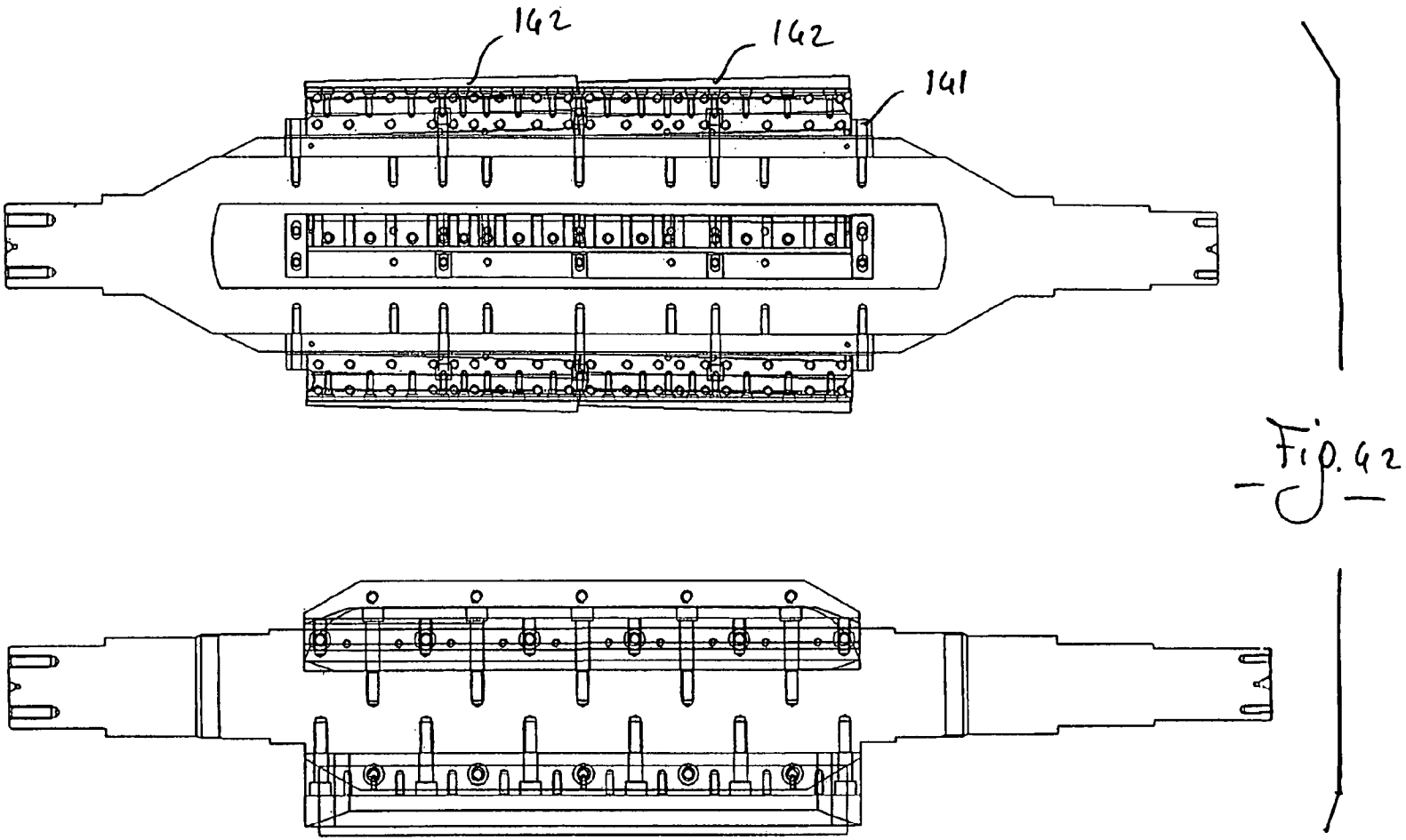

FIG. 42 shows the cutting system along the longitudinal axis of the cutting and anvil cylinders. The reference numerals are the same as FIG. 40. A different view of the same assembly is shown.

Figure 43:
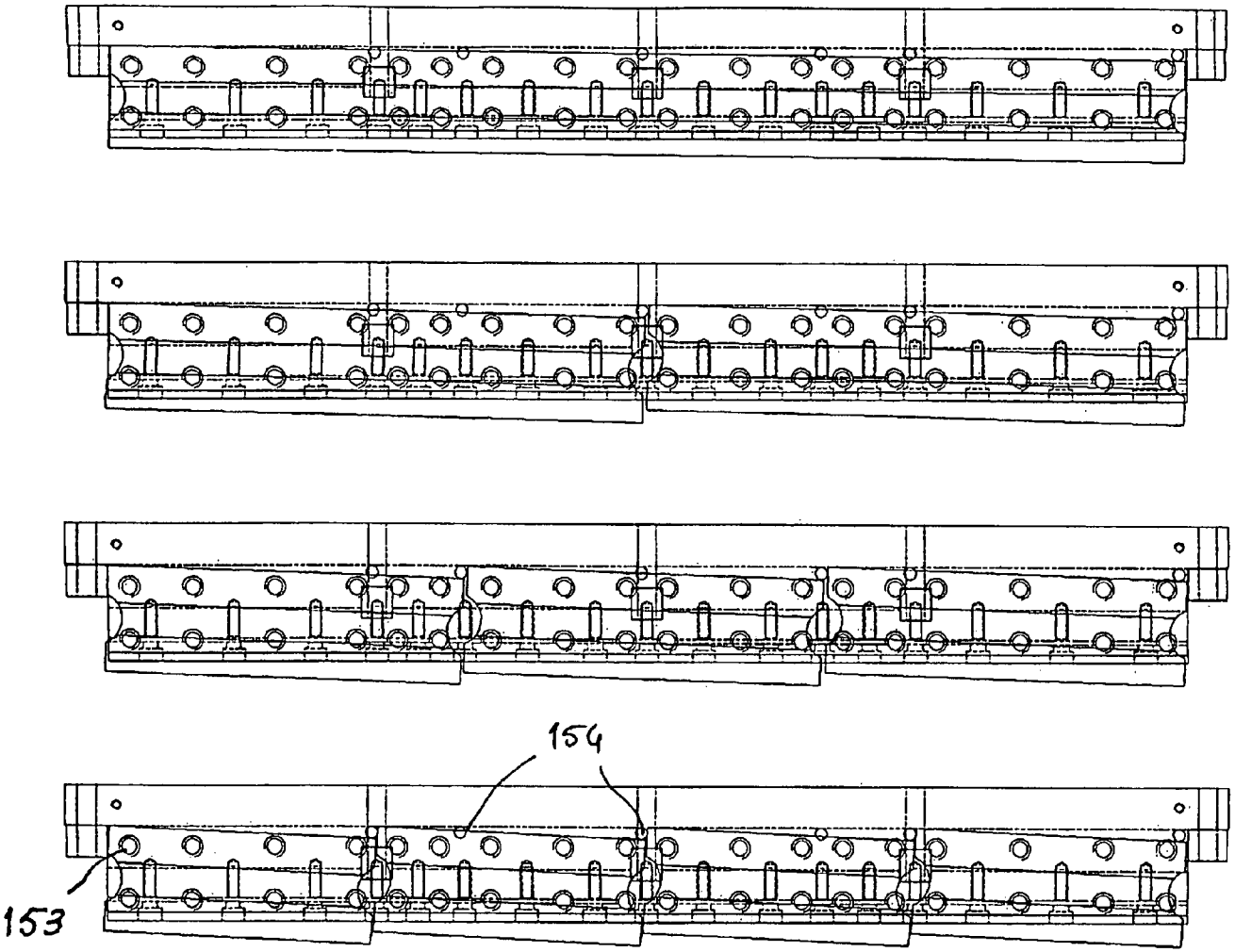
FIG. 43 illustrates the possibility of fitting several blades of different lengths in the same blade holder.

FIG. 42 shows the configuration with two cutting blades 152 fitted in a single blade holder 151. The blades are 265 mm long and are mounted in the same blade holder 151 to form the working cutting length of 530 mm. Evidently, this configuration is valid for working on two lines or four lines, but is not suitable for three lines or for one line, because the same strip of paper must be cut by a single blade, without interruptions. In FIG. 42, a single transversal counterblade is used and does not need to be replaced for passing from one to four production lines. This is a key possibility for a rapid change, because acting on the blades is very rapid, thanks to the cutting assembly. FIG. 43 shows how to mount more blades of different lengths in the same blade holder.

The working width of 530 mm can be subdivided into various cutting configurations: a 520 mm blade, two 265 mm blades, three 175 mm blades, four 132 mm blades. The configuration change is extremely rapid.

The blade fastened screws 153 and the cutting adjustment screws 153 are the key to this flexibility. These are arranged on two parallel rows formed by 18+18 screws, along the working length of 530 mm. However, the screws are not uniformly distanced. They are slightly closer in correspondence of the blade joint points, for guaranteeing an optimal cutting control in the most critical point, i.e. the tip of the blade.

Notice the hole 154 for the pin, in FIG. 43. By introducing a pin in one or more holes, the transversal cutting knife assumes a slanted projection which makes it possible to start cutting on the left and end cutting on the right, on an arc of rotation of the cutting cylinders equal to approximately 10°. Shifting the pin is extremely rapid and is required when changing from one to four transversal blades. This pin has another important function: it holds the transversal position of the blades, because while one blade rests on the step formed by the pin, the next blade is arranged transversally by the side. The precision thus obtained makes it possible to arranged up to four blades side by side in the 530 mm working dimension.

The possibility of using a single blade with a width of 530 mm for all configurations from one to four lines may save time in changes but the single 530 mm long blade is subject to being adjusted in 18 points along its length and the adjustment may be more delicate. The machine users can select the most appropriate configurations for their needs.

The system adopted for the transversal folding or the ⅛ folding is configured as an interchangeable cartridge to be inserted after the ¼ folding unit and before the automatic conveyor. This unit offers the following innovations: the capacity of managing different transmission ratios with the ¼ folding unit, corresponding to the various format kits installed, automatically, without changes. Reference is made to the following format kits: 2×180°=30-48 cm, 3×120°=20-32 cm, 4×90°=15-24 cm described above.

This unit also offers the possibility of conveying the flat product, without the fitting of additional transversal folds and the possibility of using the same automatic conveying unit used for the ¼ folding unit without changes or adaptations, as described below.

FIG. 44 illustrates a cross-sectional view of the ¼ folding unit and the ⅛ folding unit fitted together. The ⅛ folding unit can be removed or added to the production lines at any time and without changes. It does not need to be physically removed to produce items without folds or without ⅛ folds, as described below. This characteristic is very original.

The ⅛ folding head takes the product from the gripping cylinder to the ¼ head. This cylinder can convey the ¼ folded napkins with the following transmission ratios:

4:1—for 2×180° kit; 30-48 cm format

6:1—for 3×120° kit; 20-32 cm format

8:1—for 4×90° kit; 15-24 cm format

For example, TR=4:1 means that the gripping cylinder delivers four ¼ folded napkins every circumferential turn, distanced by 90°.

The key for obtaining this possibility is the ⅛ folding cylinder, indicated with reference 5. This is equipped with suction, with six vacuum boxes accepting the 90°, 120° and 180° combinations according to the adopted format kit.

It is noted that the ⅛ folding cylinder, indicated with reference numeral 5, is identical to the ¼ folding cylinder, also indicated with reference numeral 5. It consequently preserves the possibility of mounting suction kits and/or folding kits in a different proportion according to the different angular timing solutions.

Particularly, the cylinder 5 in FIG. 44 preserves the ejection system with orbital movement described above. Either the manual gathering table 10 or the automatic conveyor can be fitted on the output. The automatic conveyor will be described below.

FIG. 45 shows an enlargement of FIG. 44, referred to the ⅛ folding cylinder, indicated with reference numeral 4, to describe the suction system.

The number and the angular timing of the vacuum boxes 164 are studied to be timed with the ¼ fold, with any format kit mounted on the machine. An automatic lock pin system blocks the suction of the box 164 to allow the napkin 163 to turn, whereby completing the ⅛ folding.

The vacuum chamber 167 grips the napkin at the suitable moment by means of the distribution sector 162, when the grippers 165 open and release it onto the conveyor cylinder 5. The ⅛ fold—indicated by reference numeral 163—is carried out during the travel.

Always with reference to FIG. 45, it is noted that flat unfolded products (place mats) or ¼ folded products (such as napkins) can be conveyed without adding an additional transversal fold. More specifically, this characteristic allows to exclude the specific function of this unit without needing to remove it from the line. This possibility considerably increases the flexibility of the invention.

In practice, by anticipating the rotation of the cylinder, the vacuum grips the ¼ folded napkin near the gripped end instead of in the middle. This means that the product can be conveyed without being additionally folded. The illustrated concept is applied also to flat place mats, without transversal folds.

This "re-timing" of the cylinder is obtained by means of the mechanism described in detail above and illustrated in FIG. 14. It is also possible to accurately adjust the ⅛ fold staggering, in a similar way as the ¼ fold staggering described with reference to FIG. 15.

FIG. 46 illustrates the automatic conveyor fitted after the ¼ folding unit, while FIG. 47 shows the same unit fitted on the ⅛ folding cartridge. There are no differences of assembly or adjustment, except for the height adjustment required because the ⅛ folding cylinder output is lower than the corresponding ¼ folding cylinder.

We will now examine the conveyor unit with initial reference to FIGS. 48 to 50 showing that the unit is entirely different from similar constructions, presenting the innovative concepts it contains which are summarized in the list that follows. The single points will be analyzed in detail.

The unit permits variable pitch counting with separation by means of flexible tongues and can be automatically adapted for several production lines, by rapid setting from one to four lines. Furthermore, the unit permits rapid adaptation for the production of several items with different shapes and formats.

Some innovative details, described more in detail below, are the flexible reed counting teeth on belt, the double air cushion separating vanes and the package tipping wheel.

Counting is the beginning of the process. This phase consists in subdividing the produced stack by inserting a separating element in the stack. FIG. 48 shows the solution we devised, enlarged in the views in FIGS. 46 and 47.

The toothed belt 171 turns slowly at the speed of accumulation of the product released by the grippers 174 on the belt. The ejection teeth 101 distance the product from the gripping cylinder, whereby contributing to forming the stack being accumulated on the toothed belt 171. The brushes 177, provided with rotary and alternating movement, contribute to advancing the stack with teeth 101.

When the next counting tooth reaches position 175, the belt stops for two or three napkins, thus accumulating a delay in the cycle.

At this point, the counting is carried out by means of a sudden jerk of the belt 171, which thus inserts the tooth 175 in the middle of the napkins, whereby counting the product.

This alternation of slow movement, pauses and acceleration is governed by a motor subjected to axis control, and is consequently capable of providing the counting "jerk" in a few hundreds of a second. This quick jerk is fundamental for making the tooth 175 complete the entire rotation arc before reaching the next napkin. At a speed of 1000 napkins per minute, this frequency is equal to one napkin every 0.06 seconds. Consequently, the tooth has a time of 0.03 seconds to complete its rotation. This interval is perfectly compatible with modern computerized axis control systems.

The counting tooth 175 consists of two flexible reeds whose upper part is closed and slanted so that the lower part is distanced. The reeds can be separated to permit the subdivision in packages described below.

The computerized axis control system perfectly stores the number of napkins inserted between the two subsequent counting teeth and can be varied to make packages containing a different number of napkins. The range of this variation can be vary high, as described below.

A solution called "variable pitch counting" has been devised for counting variable numbers.

For the sake of clarity, the concept will be illustrated in a sequence of steps. If the count to be obtained is comprised in the range from five to ten items per package, the space between the two teeth 175 is sufficient to hold an entire package and the separating vane 178 is inserted in all divisions to advance the package 179 on the wheel. This condition is illustrated in FIG. 48 for packages containing ten items.

The operation of the separating vane 178 will be described below (with reference to numerals 206 and 207 for explaining functions).

If the count to be obtained is higher and the number is even, e.g. twenty items, the example show in FIG. 48 will be valid but the vane 178 will be inserted once every two counts. This alternation is governed by the computer and set by the touch screen panel.

If the count is comprised in the range from 11 to 19 items, and the number is odd, the tooth 175 will be inserted as shown in FIG. 50, making one even count and one odd count, the sum of which is the required number. In this case, 10+9=19. For example, number 29 can be composed this way: 10+10+9=29, as shown in FIG. 50.

Some examples of counts which can be obtained are:

8 napkins=8 pitches
10 napkins=10 pitches
13 napkins=5+6
17 napkins=8+9
20 napkins=10+10
25 napkins=8+8+9
31 napkins=10+10+11
40 napkins=10+10+10+10
60 napkins=10 pitches×6
100 napkins=10 pitches×10

There are no restrictions to subdivisions of this kind, except for the need of avoiding useless complications and uneven combinations. For example, several combinations can be used to obtain 45:

45 napkins=10+10+10+10+5
45 napkins=10+9+9+6+11
45 napkins=12+5+5+5+5+13

However, it appears clear that the most logical subdivision to obtain 45 is:

45 napkins=7+8+7+8+7+8

This subdivision ensures an even arrangement of napkins on the counting belt, avoiding alternating excessive compression (subdivisions higher than 10) and excessive rarefaction (subdivisions of 4 or 5 items). The computerized system is programmed to account for these parameters.

A single production line is shown in the lateral views in FIGS. 48 and 49 and FIG. 50 shows a single counting belt 171, a single ejection tooth 101 and a single separating vane 178. In practice, there are more than one of these components, arranged side by side along the working width of the cylinders, equal to 530 mm, similarly as the grippers on the gripper holder shaft described in FIG. 39.

This is a key characteristic for obtaining the flexibility needed to rapidly change the number of production lines, variable from one to four. This concept is a nearly revolutionary innovation in the production of napkins, place mats, coasters, towelettes and towels. FIG. 51 illustrates the application in the conveyor unit. As can be seen, various belts 171 arranged; side by side form a continuous mat from which the counting teeth 175 project vertically. The ejector teeth 101 detach the product from the gripper cylinder 5 and place it on the conveyor belts. This picture does not show the accumulation of product on the belts 171 to show the belts and the teeth 175.

The separation vanes 178 in home position are under the belts. When the package is separated, they move upwards and insert themselves between the two elastic reeds forming the tooth 175. These spread to allow the passage of the vane, opening the napkins and allowing the vanes to separate the packages. This concept for separating the packages is entirely innovative and will be described below.

FIG. 52 shows the assembly shown in FIG. 51 with the addition of product accumulated on the conveyor belts 181. As can be seen, production is organized on three lines.

Herein we will only add that the entire machine, the ⅛ folding cartridge and the conveyor units are set up for this operation on a variable number of lines from one to four, leaving a narrow gap between two contiguous lines. This gap can be equal to approximately 10–20 mm. The number of belts 181 and their reciprocal distance were studied to position a sufficient number of separator teeth 175 in any case, regardless of the width of the produced napkins and the number of adopted lines.

In practice, the conveyor unit does not need to be adjusted when varying the number of lines and the width of the product. Only the paper will need to be positioned transversally on the cylinders in the machine in such as position to find a lateral correspondence with the separator teeth 185. Changing the configuration of the production line will be very quick.

The machine according to the invention presents a high adaptability in producing different items, with different shapes and formats.

This characteristic is very important for the flexibility offered. Indeed, no other design counts on the lower side of the napkin, the side which rests on the conveyor belts 171 in FIG. 52. By counting on the lower side, the height of the product is not relevant.

No other construction counts by means of flexible tongues 175, fastened at a constant distance on a conveyor belt 171. The high number of counting elements arranged side by side permits working on any width of product, also when the width is subdivided on several lines.

The thickness of the product is easily compensated by varying the number of napkins between two teeth 175. Not even this thickness effects operations.

It can be stated at this point that the width, the height and the thickness are not relevant for the operation of the conveyor; consequently this concept can accept a high variety of reciprocally different products.

FIG. 53 illustrates different products with different thickness and height presented on the same conveyor, to compare the different dimensions and the different number of products comprised between two subsequent counting teeth 175. This composition is not typical of real production and is presented primarily to compare the different products which can be obtained as well as the facility of production change.

The products shown are, in order: ¼ napkins, format 33×33, indicated with reference numeral 191, flat place mats, format 33×45, indicated with reference numeral 192, ⅛ napkins, format 40×40, indicated with reference numeral 193 and ¼ napkins, format 40×40, indicated with reference numeral 194.

The machine of the invention presents a specifically designed counting system for obtaining a high flexibility in counting and a high reliability. The system comprises two tempered steel tongues 202 and 203, flexible, resistant and reciprocally symmetric in shape, indicated in FIG. 54. They are mounted by means of screws 204 on the plate 205, in turn fastened to the internal side of the product conveyor belt 201.

FIG. 55 presents a variant of the flexible reeds described in FIG. 54. The operation and the assembly is identical. In this variant, the reeds 202', 203' are narrower in the upper part and wedge between the napkins presenting a lower thickness. The two solutions are rapidly interchangeable.

The concept of separation by means of two flexible reeds side by side and fastened onto a belt is entirely original.

The machine according to the invention also presents a set of double separating vanes side by side with the insertion of an air cushion.

This solution was carefully studied to maximize the advantages offered by the flexible reed counting means. When the computerized control system controls package separation, the vanes 206 and 207 shown in the FIG. 56 move upwards perfectly joined and synchronized while a jet of air is let out from the holes 209 through a conduit on the stem of the vanes. The holes 209 are present on both vanes 206, 207. The purpose of this jet of air is to reduce the friction of the vanes on the paper being separated, whereby improving sliding.

During their upwards movement, the vanes "cross" the counting tooth formed by the two flexible reeds 202' and 203'. The latter are spread and open the way through the napkins, whereby facilitating the upwards movement of the vanes 206 and 207. Proceeding with their upwards movement, the vanes "hang over" the tooth 202' and 203' because their cross-section is narrower in point 206. This solution allows the belt 201 and the counting teeth 202' and 203' to continue advancing. This solution avoids dead time in belt advancement, permitting very rapid package separation cycles.

The continuation of the separation cycle is illustrated in FIG. 58. The vanes 206 and 207 have now completed their upwards movement "through" the tooth 205. This is illustrated as still spread, only to show the opening. Actually, at this point the reeds are already closed, as the others in the drawing 204, thanks to the section reduction shown in FIG. 57.

At this point, the belt 201 and the vanes 206 and 207 are completely released, and continue the movements entirely freely, without reciprocal interference. This allows to greatly abbreviate dead time in the cycle.

The vane 206 is held up to support the napkins while the vane 207 is moved leftwards to take the already subdivided package in the wheel 208. At this point, the separation of the package is ended, the two vanes 206 and 207 are joined and lowered under the belts, following a route which avoids interference with the teeth 205 and the belt 201.

We will now draw attention to the details. As shown in FIG. 52, the system according to the invention for separating the packages is equipped with numerous belts 201 side by side and a rack with different vanes 206 and 207 in line. This is used to manage considerable lengths, also when subdivided on several production lines side by side.

The machine according to the invention presents a wheel of the innovative type for tipping the package.

This device allows tipping the package in the horizontal position with a rapid and smooth movement without mechanical parts subject to an idle return stroke, whereby avoiding delay and dead time in the cycle.

The cycle comprises that the wheel 218 starts rotation (FIG. 59) before the vane 207 is detached from the package, allowing the stabilization of the resting point of the package in the wheel compartment and shortening the cycle time.

Three different solutions have been developed, respectively with four, five or six stations, which offer different tipping angles, and consequently perform the tipping operation turning at different angular speeds. The three solutions are shown in FIGS. 59 to 63. This tipping system is entirely innovative and has never before been developed in any realization.

The concept developed for four stations allows to have a package in parking portion 212, for the five and six stations illustrated in FIGS. 61 and 62, respectively.

Figure 60:
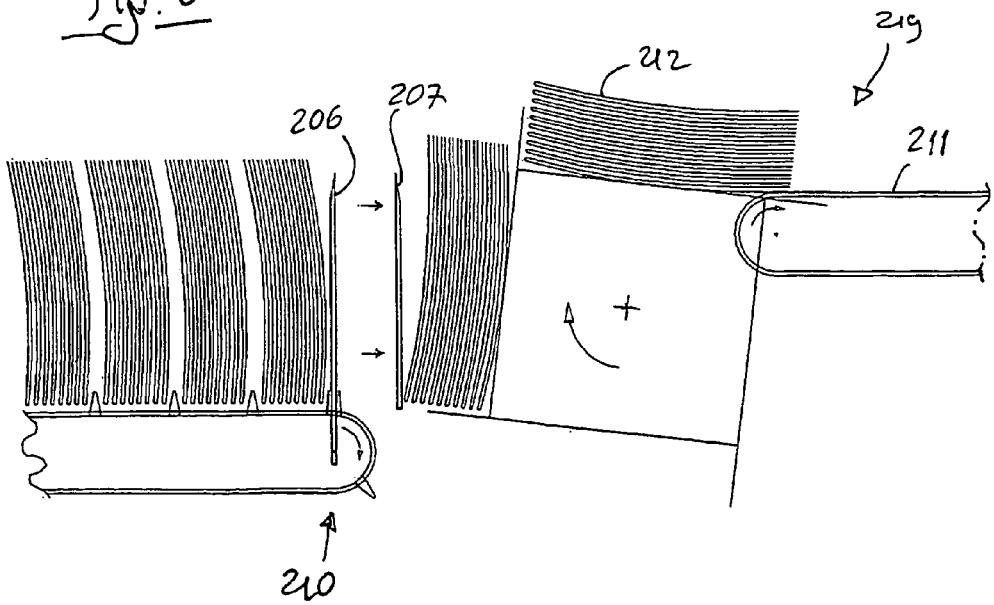

The four station solution illustrated in FIG. 60 is the simplest and requires a 90° rotation which must be carried out very rapidly. Consequently, the package turns faster with respect to the solutions with five or six stations and may slightly come apart during the rotation.

Figure 59:
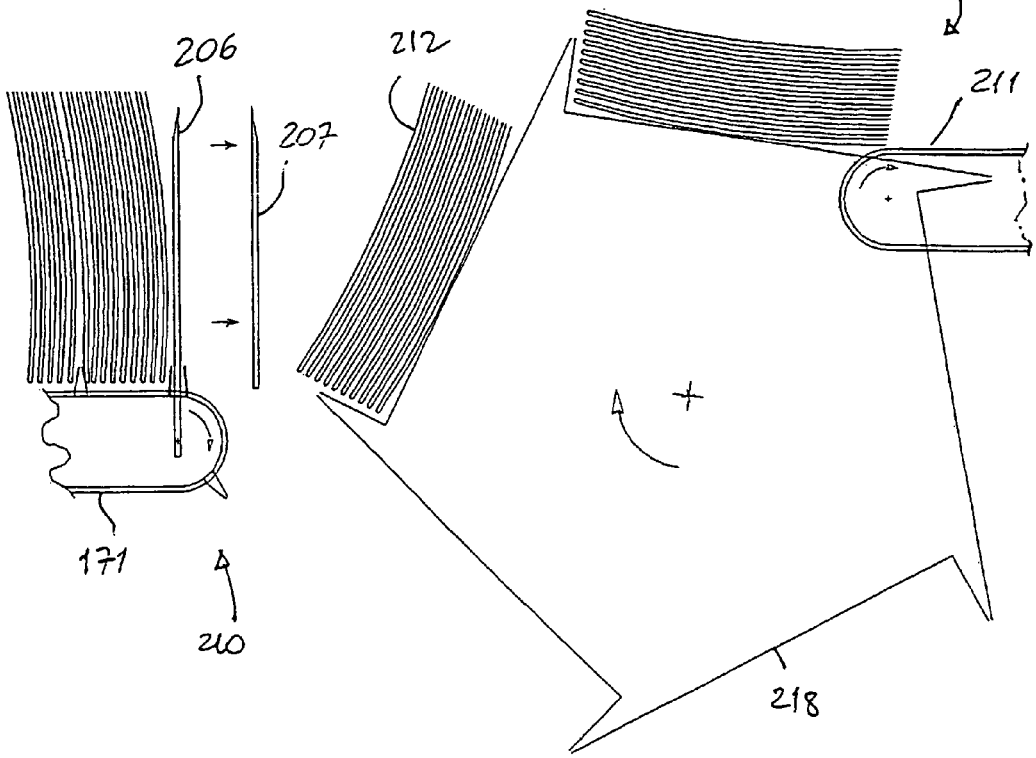

The solution in FIG. 59 and that in FIG. 61 are identical, both presenting five stations. However, an intermediate parking station 212 can either be obtained or eliminated by adjusting the slant of the wheel. The slant also effects the slant of the package input station 210 and output station 219. The height of the output belts 211 can be adjusted to be arranged in the position most suitable for collecting the package. These belts are distanced to avoid interference with the teeth of the wheel.

The machines for the production of folded items (towelettes, cloths, towels) and tableware items (napkins, coasters, place mats) can have an output in line or inclined at 90° with respect to the initial direction of the paper off the reel. Generally, machines with mechanical folding system and belt saw have an output in line, while machines with aspirated-mechanical folding system and transversal shear cut have the finished product output at 90° with respect to the unwinding direction of the paper. The machine according to the invention belongs to the second type of machines.

However, this is the only machine in which the product output can positioned in both directions without requiring mechanical modifications.

As illustrated in FIG. 63, the folding head can be mounted in line with the unwinder, i.e. with the rotation axles of the folding cylinders, parallel to the axis of the mother reel. Alternatively, the folding head can be positioned at 90° with respect to the direction of unreeling of the paper, because the base 232 has the attachments and the mechanisms for turning by 90° as needed, rightwards and leftwards.

In order to work correctly in both configurations, longitudinal folding plates 231 are provided (FIG. 64) for both requirements. For example, in FIG. 63, a simple free roller is fitted in 231 instead of the folding plates to produce flat products without longitudinal folds.

The concept of orienting the base of the folding head in the selected direction and its practical implementation by means of a turning base are innovative. The base can also have a servo assisted turning system or can be set up to be turned manually, because it does not have to be changed frequently after the output is arranged in the correct direction.

The FIG. 64 shows the 90° output in left direction looking at the figure. By turning the base 232 by 180°, the output is arranged to unload the product in the opposite direction on the right looking at the figure.

The high flexibility of use of the machine according to the invention appears evidently in the description above.

In actual fact, to confirm the high flexibility of the machine according to the invention, different raw materials can be used, such as paper, cardboard, tissue paper, air-laid paper, TNT or non-woven material, synthetic material, laminate, imitation leather, vinyl, sky, cellulose and PVC mixtures, latex and other resins, coupled materials. In practice, any flexible material can be processed providing it is available as a semifinished product in the form of a continuous strip wrapped on a reel, where the reel can have several layers, either reciprocally free or joined by embossing or gluing.

Naturally, numerous changes can be implemented to the construction and embodiments of the invention herein envisaged without departing from the scope of the present invention, as defined by the following claims.

The invention claimed is:

1. Machine for producing flexible material sheets comprising at least one folding unit housing at least one cutting cylinder, to which a first suction cylinder is opposed, and a first gripping cylinder for transversal folding and/or for conveying flat products by suction, wherein said first gripping cylinder includes a plurality of assembly positions which can accept varying combinations of suction kits and/or transversal gripping units, and a mechanism for changing angular timing at least between the first suction cylinder and the first gripping cylinder, comprising a pair of pulleys, which are mobile on a precision runner, said runner being equipped with a screw device for adjusting the runner and for adjusting length of a taut branch and a slack branch of a toothed drive belt of said machine.

2. Machine for producing flexible material sheets comprising at least one folding unit housing at least one cutting cylinder, to which a first suction cylinder is opposed, and a first gripping cylinder for transversal folding and/or for conveying flat products by suction, wherein said first gripping cylinder includes a plurality of assembly positions which can accept varying combinations of suction kits and/or transversal gripping units, and a second suction cylinder for a second transversal fold and/or for conveying flat products, and a second gripping cylinder for conveying folded products or flat unfolded products which optionally is associated downstream to said machine and a mechanism for changing angular timing at least between the second suction cylinder and the second gripping cylinder, comprising a pair of pulleys, which are mobile on a precision runner, said runner being equipped with a screw device for adjusting the runner and for adjusting a length of a taut branch and a slack branch of a toothed drive belt of said machine.

3. Machine for producing flexible material sheets comprising at least one folding unit housing at least one cutting cylinder, to which a first suction cylinder is opposed, and a first gripping cylinder for transversal folding and/or for conveying flat products by suction, wherein said first gripping cylinder includes a plurality of assembly positions which can accept varying combinations of suction kits and/or transversal gripping units, and a plurality of combs mounted externally to a surface of said first suction cylinder and/or a second suction cylinder and which is free to turn on the first and/or second cylinder, and free to move from one cutting edge to an opposite cutting edge on the first and/or second suction cylinder.

4. The machine according to claim 3, wherein said combs are mounted on toothed rings, which are coaxial to the first and/or second suction cylinder and free to turn on said cylinder, wherein said toothed rings mesh with similar toothed rings mounted on a corresponding first gripping cylinder and/or a second gripping cylinder and consequently solid with grippers thereof.

5. Machine for producing flexible material sheets comprising at least one folding unit housing at least one cutting cylinder, to which a first suction cylinder is opposed, and a first gripping cylinder for transversal folding and/or for conveying flat products by suction, wherein said first gripping cylinder includes a plurality of assembly positions which can accept varying combinations of suction kits and/or transversal gripping units, wherein said first suction cylinder and/or a said second suction cylinder has a central shaft housing a plurality of blade holders for counterblades, wherein a between an internal core of the first suction cylinder and/or said second suction cylinder and an external surface of said first suction cylinder and/or said second suction cylinder is by a plurality of suction sectors which are perforated to allow passage of external air to an annular suction chamber subdivided into a plurality of sectors spaced by partitions to maximize efficiency of lateral vacuum valves and to define a beginning and an end of an arc of circumference which is subject to suction.

6. The machine according to claim 3, further comprising a plurality of toothed rings idly mounted on the first suction cylinder and/or said second suction cylinder for assembly of said combs, and a plurality of rings solidly mounted on a corresponding of said first gripping cylinder and/or a said second gripping cylinder for driving the combs timed with grippers, wherein said first gripping cylinder and/or said second gripping cylinder is responsible for driving the toothed rings, while the first suction cylinder and/or said second suction cylinder is responsible for driving transversal grippers, in which timing with respect to the combs is guaranteed by said toothed rings.

7. The machine according to claim 3, 4 or 6, wherein said combs present a lateral prong, external to a gripper, wherein each of said combs grips paper by the gripper, during a gripping operation to produce a transversal fold.

8. The machine according to claim 3, 4 or 6, wherein each of said combs presents at least one discontinued edge interrupted to prevent being gripped by grippers and wherein a transversal bar on which a comb is made is effectively joined to a perforated surface of the first gripping cylinder and/or said second gripping cylinder, due to a tapered edge.

9. The machine according to claim 3, further comprising a product ejection system with orbital mechanism, wherein said system comprises a pair of connecting rods operating on each of the combs for ejecting a product from grippers, in order to reduce inertial stress for obtaining higher speeds.

10. The machine according to claim 9, wherein each of said combs presents a tooth whose shape is curved, shortened and tapered in an upper part.

11. Machine for producing flexible material sheets comprising at least one folding unit housing at least one cutting cylinder, to which a first suction cylinder is opposed, and a first gripping cylinder for transversal folding and/or for conveying flat products by suction, wherein said first gripping cylinder includes a plurality of assembly positions which can accept varying combinations of suction kits and/or transversal gripping units, and a rapid transversal cut blade and counterblade change system, wherein cutting pressure is adjusted by means of dowel screws and wherein the blade turns when a cutting edge of the blade is worn by loosening fastening screws, thereby presenting a new cutting edge without altering a cutting pressure setting.

12. The machine according to claim 11, wherein counterblades present a positive rack on a cutting edge thereof to allow cutting of material.

13. Machine for producing flexible material sheets comprising at least one folding unit housing at least one cutting cylinder, to which a first suction cylinder is opposed, and a first gripping cylinder for transversal folding and/or for conveying flat products by suction, wherein said first gripping cylinder includes a plurality of assembly positions which can accept varying combinations of suction kits and/or transversal gripping units, wherein the machine provides transversal folding or ⅛ folding and includes an interchangeable cartridge to be inserted after a ¼ folding cartridge and before an automatic conveyor, which manages different transmission ratios with the ¼ folding cartridge, corresponding to installed format kits automatically, wherein said ⅛ folding cylinder is equipped with suction boxes.

14. Machine for producing flexible material sheets comprising at least one folding unit housing at least one cutting cylinder, to which a first suction cylinder is opposed, and a first gripping cylinder for transversal folding and/or for conveying flat products by suction, wherein said first gripping cylinder includes a plurality of assembly positions which can accept varying combinations of suction kits and/or transversal gripping units, and an automatic conveyor unit mounted after a ¼ folding unit or after a ⅛ folding unit, wherein said conveyor unit presents a flexible reed counting tooth on a belt, a pair of air cushion separating vanes and a package tipping wheel.

15. The machine according to claim 14, wherein said pair of vanes comprises two tongues, which are symmetrically counterpoised and which, when a computerized control system controls package separation, move upwards in a perfectly joined and synchronized manner while a jet of air exits holes in a conduit in a stem of the vanes, said vanes crossing a counting tooth formed by two flexible reeds during the movement; spread of the reeds being capable of opening a way through napkins.

16. Machine for producing flexible material sheets comprising at least one folding unit housing at least one cutting cylinder, to which a first suction cylinder is opposed, and a first gripping cylinder for transversal folding and/or for conveying flat products by suction, said first gripping cylinder being opposed to said first suction cylinder, wherein said at least one cutting cylinder and said first suction cylinder are constructed and arranged to cut by co-action a flexible material moving therebetween to provide sheets of said flexible material, wherein said first gripping cylinder includes a plurality of assembly positions which can accept varying combinations of suction kits and/or transversal gripping units for acting on said sheets, and wherein said first suction cylinder has a plurality of angularly spaced apart cutting edges and a plurality of outer combs with a suction surface between said cutting edges and said outer combs, wherein angular position of and number of said cutting edges being arranged around an axis of said first suction cylinder.

17. The machine according to claim 16, wherein said outer combs are arranged outside said suction surface of said first suction cylinder.

* * * * *

UNITED STATES PATENT AND TRADEMARK OFFICE

CERTIFICATE OF CORRECTION

PATENT NO. : 7,037,251 B2
APPLICATION NO. : 10/486786
DATED : May 2, 2006
INVENTOR(S) : Cesare Stefanomi It is certified that error appears in the above-identified patent and that said Letters Patent is hereby corrected as shown below:

Column 5,

Line 6, “exploding” should read -- exploiting --.

Column 18,

Line 65, “arranged; side by side” should read -- arranged side by side --.

Column 23,

Line 5, “and/or a said second” should read -- and/or a second --.

Column 23,

Line 7, “wherein a between” should read -- wherein between --.

Column 23,

Line 10, “cylinder is by a plurality” should read

-- cylinder is a plurality --.

Column 23,

Line 20, “and/or a said” should read -- and/or a --.

Signed and Sealed this

Twenty-ninth Day of August, 2006

JON W. DUDAS
*Director of the United States Patent and Trademark Office*